United States Patent [19]

Wada et al.

[11] 4,128,032

[45] Dec. 5, 1978

[54] ELECTRONIC MUSIC INSTRUMENT

[75] Inventors: Ryoichi Wada, Habikino; Katsumi Fujisaki, Katano; Masaya Nakajima, Neyagawa; Masahiko Tsunoo, Suita; Takeji Kimura, Hirakata, all of Japan

[73] Assignee: Matsushita Electric Industrial Co., Ltd., Kadoma, Japan

[21] Appl. No.: 627,473

[22] Filed: Oct. 30, 1975

[30] Foreign Application Priority Data

Nov. 14, 1974 [JP] Japan ..... 49-131704

[51] Int. Cl.[2] ..... G10H 1/00

[52] U.S. Cl. ..... 84/1.01; 84/1.17; 84/1.11; 84/1.19; 84/1.24; 84/1.26

[58] Field of Search ..... 84/1.01, 1.03, 1.11, 84/1.13, 1.17, 1.19, 1.24, 1.26

[56] References Cited

U.S. PATENT DOCUMENTS

| | | | |
|---|---|---|---|
| 3,422,718 | 1/1969 | Noehren | 84/1 .03 X |
| 3,515,792 | 6/1970 | Deutsch | 84/1.03 |
| 3,639,913 | 2/1972 | Watson | 84/1.01 X |
| 3,646,241 | 2/1972 | Ott | 84/1.17 X |
| 3,755,608 | 8/1973 | Deutsch | 84/1.24 X |
| 3,809,788 | 5/1974 | Deutsch | 84/1.01 |
| 3,833,750 | 9/1974 | Iorio | 84/1.03 X |
| 3,844,379 | 10/1974 | Tomisawa et al. | 84/1.26 X |
| 3,859,884 | 1/1975 | Grable | 84/1.01 |
| 3,969,969 | 7/1976 | Clark, Jr. et al. | 84/1.11 X |
| 3,986,423 | 10/1976 | Rossum | 84/1.01 |

*Primary Examiner*—Ulysses Weldon

*Attorney, Agent, or Firm*—Wenderoth, Lind & Ponack

[57] ABSTRACT

An electronic musical instrument has a plurality of tone selectors which select musical tones; a waveshape calculator which calculates a waveshape represented by amplitudes at two or more than two sampled points of one period of the selected tone and which is operative whenever the tone selectors are actuated; a plurality of waveshape memories which temporarily memorize the calculated waveshapes; clock signal generator which generates clock signals with high frequencies corresponding to pitches of depressed keyswitches of the musical instrument and which is operative whenever the keyswitches are depressed; a reading circuit which repetitively and successively reads out the memorized waveshape amplitudes by the clock signal generated by the clock signal generator; and a converter which converts the waveshape amplitudes read out by the reading circuit to a musical tone, wherein a musical tone is generated by repetitively reading out the temporarily memorized musical waveshape.

13 Claims, 54 Drawing Figures

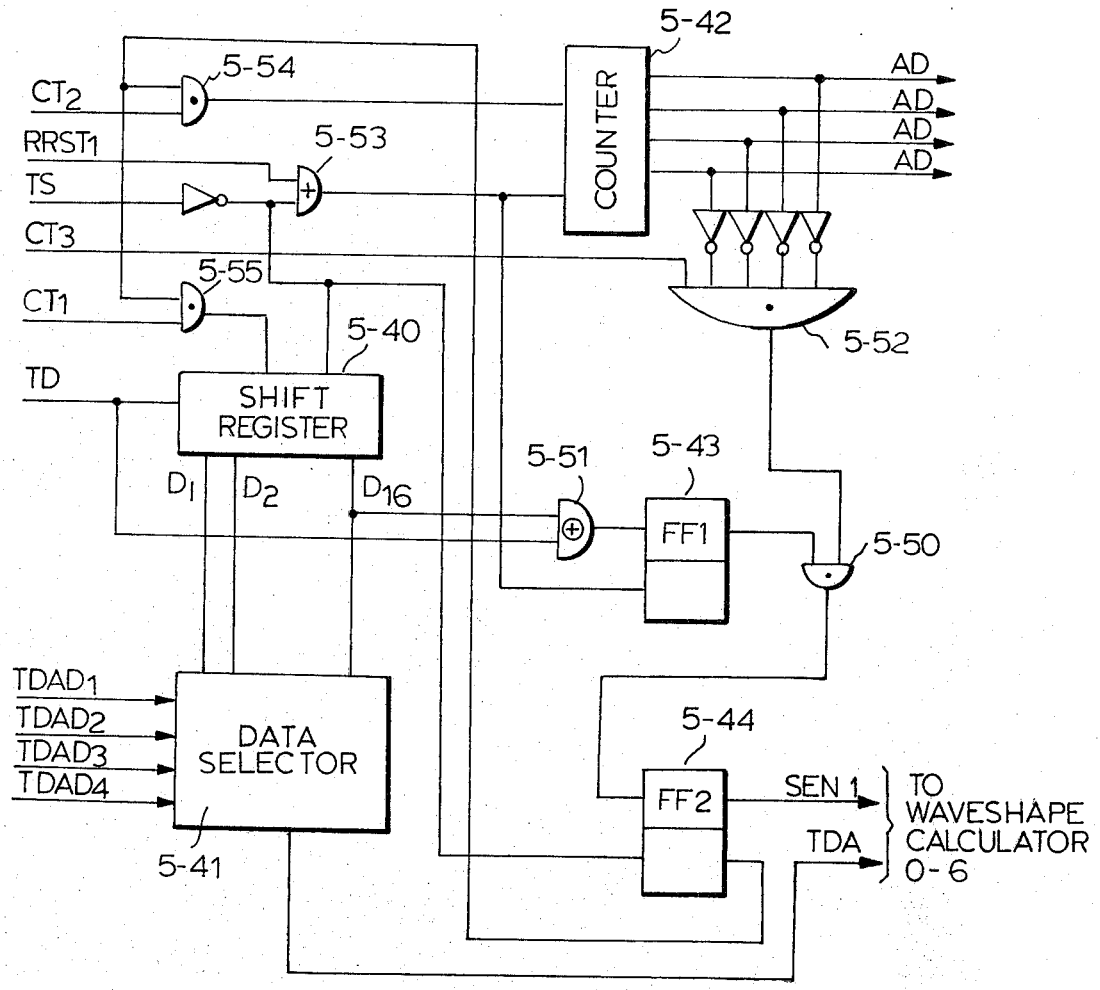
FIG. 5-5
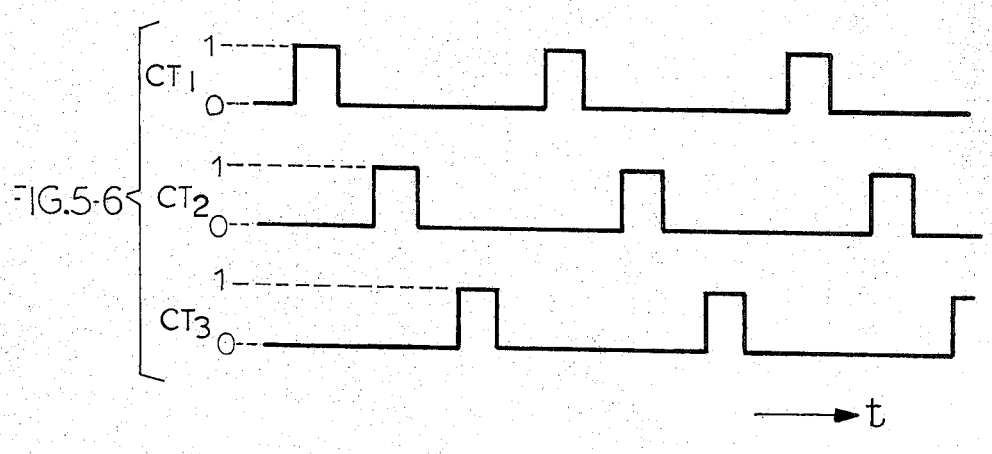

R/W
WDA
WC
1
2
3
4
5
127
N=
128
t

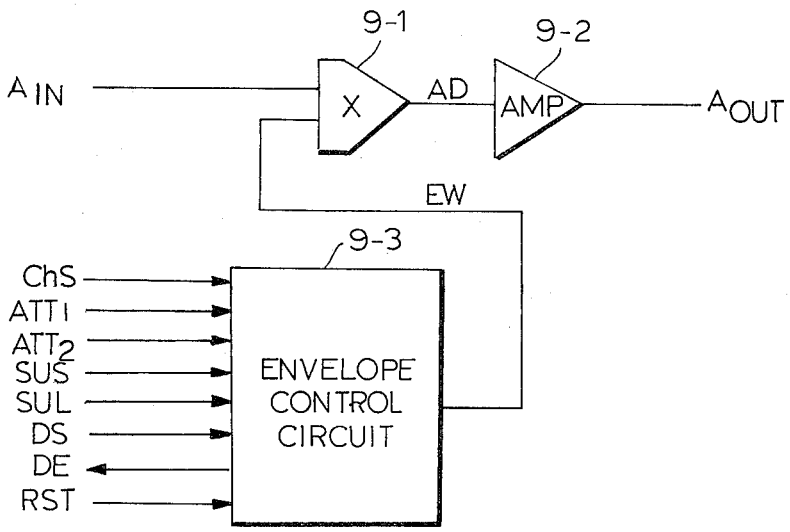
FIG. 9-1
FIG. 9-2
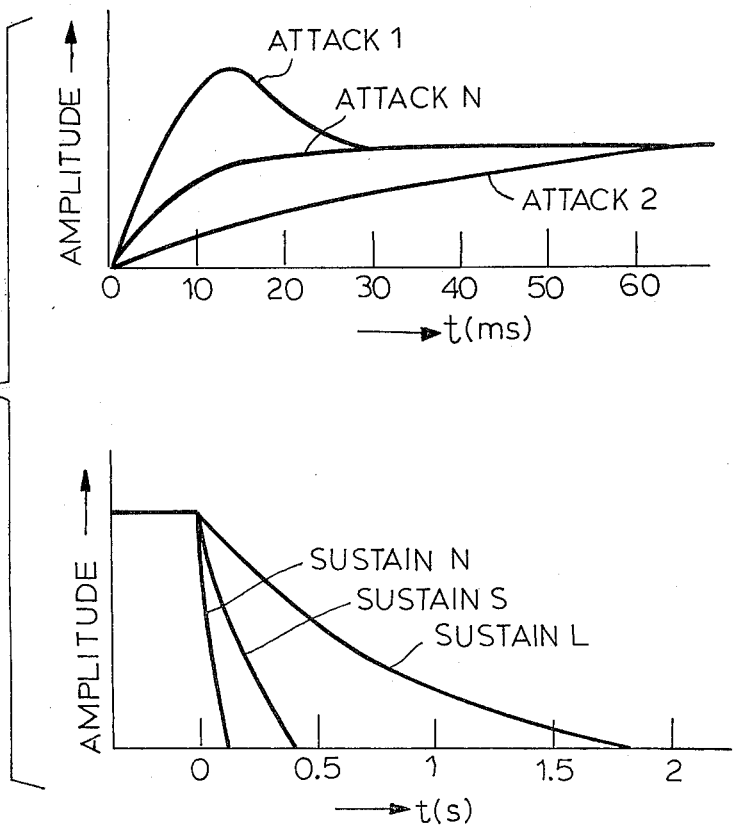

ELECTRONIC MUSIC INSTRUMENT

BACKGROUND OF THE INVENTION

This invention relates to an electronic musical instrument, and more particularly to an electronic musical instrument using a digital signal processing system in which the value of an amplitude at a sampled point of a desired waveform of one period of musical tone is calculated and a musical tone is generated by reading out the thus calculated sampled value with a note-clock signal having a frequency related to the desired pitch of a musical tone.

In the prior art, for example in U.S. Pat. Nos. 3,515,792 and 3,610,799, a digital organ has been proposed in which one period of the waveform of a musical tone for each tablet is sampled and stored in a Read Only Memory (ROM) in a digital-form. A musical tone is generated by reading out the stored data corresponding to the amplitude of the waveform at a sampled point with the note-clock signal having a repetitive frequency related to the pitch of the tone of the actuated key. As only one waveform stored in the ROM is prepared for each of the tone tablet switches, when several tone tablets are selected and assigned, two or more ROMs are accessed at the same time and their outputs are combined.

In the digital organ of the above system, when two or more keys are actuated simultaneously, as the ROM of the desired waveforms must be read out by two or more note-clock pulses with different repetitive frequencies, there is caused a read-out error at a coincident timing of the plural note-clock pulses. For avoiding this read-out error, each note-clock pulse should be prepared so as not to have any coincident timing, and moreover the ROM should be read out while being multiplexed in time by plural note clock pulses. Therefore, a complicated system is required for processing signals in complex form at a high speed in this prior art digital organ. Furthermore, the musical tone signal generated in digital form from the ROM is reshaped to have the desired envelope such as an attack, a rise or a decay, or a fall off of the signal. Such a processing for forming the envelope of the musical tone signal is also performed in digital form, and therefore the staircase changes of the amplitude of the signal inevitably results in a tone signal which has a disadvantage from the standpoint of a natural feeling, especially in the case of a very long decay time i.e., a so-called sustain. Moreover, such a digital organ has a further disadvantage that custom-made ICs or LSIs are required to build the organ.

SUMMARY OF THE INVENTION

Therefore, it is an object of the present invention to provide a new and improved digital organ which is capable of generating musical tones having an arbitrary waveform which is synthesized whenever tone or voice selection is made by an operator.

Another object of the invention is to provide a digital organ which is capable to generating waveforms in digital form of a desired pitch without any particular memory devices but with conventional devices such as a simple shift register.

A further object of the invention is to provide an organ in which waveforms are generated by digital signal processing, and in which the envelopes are controlled by analog signal processing for producing a moderate feeling as in a conventional musical instrument.

These objects are achieved by providing an electronic organ in which quantized sample point amplitudes of a waveform are computed whenever the tone selecting switches such as tone tablets, draw-bars or preset combination switches are actuated, and then a set of sampled amplitudes through one cycle of the computed waveform is stored in a plurality of memories, from which the stored waveforms are read out individually by at least one note clock pulse at a selected frequency which corresponds to the note of a depressed key but which differs in frequency from each other, and the envelope of the read-out waveform is controlled by analog circuits after converting the sampled waveform to a continuous signal.

BRIEF DESCRIPTION OF THE DRAWINGS

Other objects, features and advantages of the invention will be made clear from the following detailed description of embodiments thereof considered together with the accompanying drawings wherein:

FIGS. 1—1 and 1-2 are circuit diagrams of a key-assigner employed in the embodiment of FIG. 1.

FIGS. 1-3 and 1-4 are timing diagrams illustrating the sequence of the operation of the embodiment of FIG. 1.

FIGS. 2-1 and 2—2 are block diagrams of a generator assigner employed in the embodiment of FIG. 1.

FIG. 2-3 is a circuit diagram of a channel search circuit employed in the embodiment of FIG. 2-1.

FIG. 2-4 is a circuit diagram of a channel assigner employed in the embodiment of FIG. 2-1.

FIGS. 2-5 and 2-6 are circuit diagrams of a decay memory circuit employed in the embodiment of FIG. 2-1.

FIG. 2-7 is a circuit diagram of an empty signal generating circuit employed in the embodiment of FIGS. 2-1 and 2—2.

FIG. 2-8 is a circuit diagram of a note clock signal selecting circuit employed in the embodiment of FIG. 2-1 or FIG. 2—2.

FIGS. 2-9 and 2-10 are circuit diagrams of a phase coincidence circuit employed in the embodiment of FIG. 2-1 or FIG. 2—2.

FIG. 2-11 is a circuit diagram of a note clock signal frequency dividing circuit employed in the embodiment of FIG. 2-10.

FIG. 2-12 is a timing diagram illustrating the sequence of the operation of the circuit of FIG. 2-11.

FIG. 2-13 is a circuit diagram of another embodiment of a phase coincidence circuit which can be employed in the embodiment of FIG. 2-1.

FIG. 2-14 is a circuit diagram of a note clock signal frequency dividing circuit which can be employed in the embodiment of FIG. 2-13.

FIG. 2-15 is a circuit diagram of still another embodiment of a phase coincidence circuit which can be employed in the embodiment of FIG. 2-1.

FIG. 2-16 is a circuit diagram of a note clock frequency dividing circuit employed in the embodiment of FIG. 2-15.

FIG. 3 is a circuit diagram of still another embodiment of a phase coincidence circuit which can be employed in the embodiment of FIG. 2-1.

FIG. 4 is a circuit diagram of a note clock signal frequency dividing circuit which can be employed in the embodiment of FIG. 3.

FIG. 5-1 is a block diagram of a tone selection detector employed in the embodiment of FIG. 1.

FIG. 5-2 is a circuit diagram of a preset controller employed in the embodiment of FIG. 5-1.

FIG. 5-3 is a circuit diagram of a tablet assigner employed in the embodiment of FIG. 5-1.

FIG. 5-4 is a timing diagram illustrating the sequence of the operation of the circuit of FIG. 5-3.

FIG. 5—5 is a circuit diagram of a tablet change detector employed in the embodiment of FIG. 5-1.

FIG. 5-6 is a timing diagram illustrating the sequence of the operation of the circuit of FIG. 5—5.

FIG. 5-7 is a circuit diagram of a draw-bar assigner employed in the embodiment of FIG. 5-1.

FIG. 6-1 is a flow-chart illustrating the sequence of the operation of a waveshape calculator employed in the embodiment of FIG. 1.

FIG. 6-2 are examples of the waveshapes calculated by the waveshape calculator in FIG. 6-1.

FIG. 6-3 is a block diagram of the waveshape calculator employed in the embodiment of FIG. 1.

FIG. 6-4 is a memory-map in the waveshape calculator of FIG. 6-3.

FIGS. 6-5 and 6—6 are detailed flow-charts illustrating the sequence of the operation of the waveshape calculator of FIG. 6-3.

FIG. 6-7 is a timing chart illustrating the sequence of the operation according to FIG. 6—6.

FIGS. 6-8 and 6-9 are detailed flow-charts illustrating the sequence of the operation of the waveshape calculator of FIG. 6-3.

FIG. 6-10 is a sampling appearance of a sine waveshape applied for a calculation in the waveshape calculator.

FIG. 7-1 is a circuit diagram of a tone generator employed in the embodiment of FIG. 1.

FIG. 7-2 is a circuit diagram of a data selector employed in the embodiment of FIG. 7-1.

FIG. 7-3 is a circuit diagram of a counter employed in the embodiment of FIG. 7-1.

FIG. 7-4 is a circuit diagram of a shift register employed in the embodiment of FIG. 7-1.

FIGS. 7-5, 7-6 and 8 are timing diagrams illustrating the sequences of the operation of the tone generator of FIG. 7-1.

FIG. 9-1 is a block diagram of an envelope generator employed in the embodiment of FIG. 1.

FIG. 9-2 shows various waveshapes of outputs of the envelope generator in FIG. 9-1.

FIG. 9-3 is a circuit diagram of an envelope controller employed in the embodiment of FIG. 9-1.

FIGS. 9-4 and 9-5 are timing diagrams illustrating the sequences of the operation of the envelope controller in FIG. 9-3.

FIG. 9-6 is a circuit diagram of a multipling circuit employed in the embodiment of FIG. 9-1.

FIG. 9-7 shows waveshapes at various points of the multipling circuit of FIG. 9-6.

DETAILED DESCRIPTION OF THE PREFERRED EMBODIMENT

Figure 1:
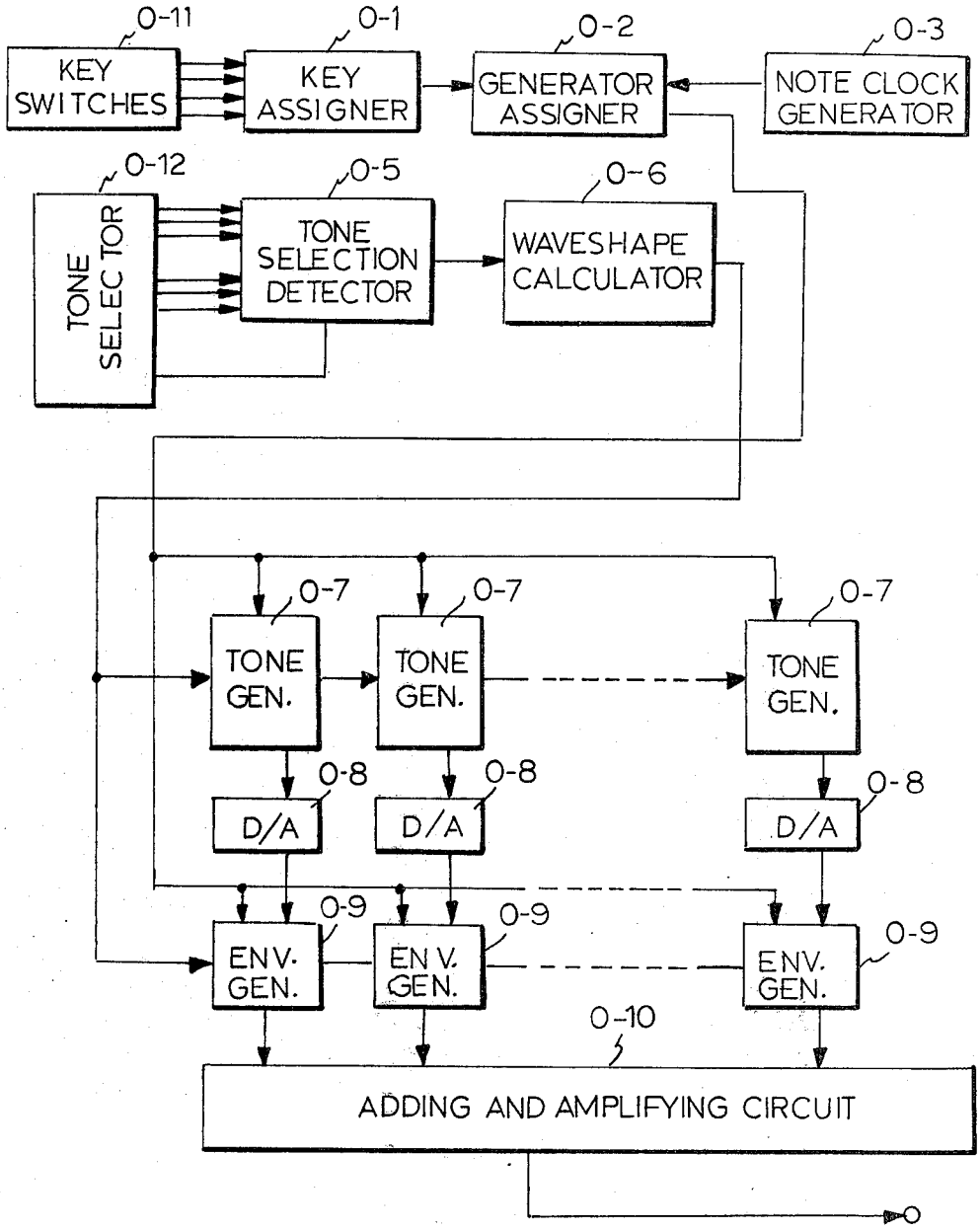
FIG. 1 is a block diagram showing a fundamental embodiment of an electronic organ according to the present invention.
Figure 1:
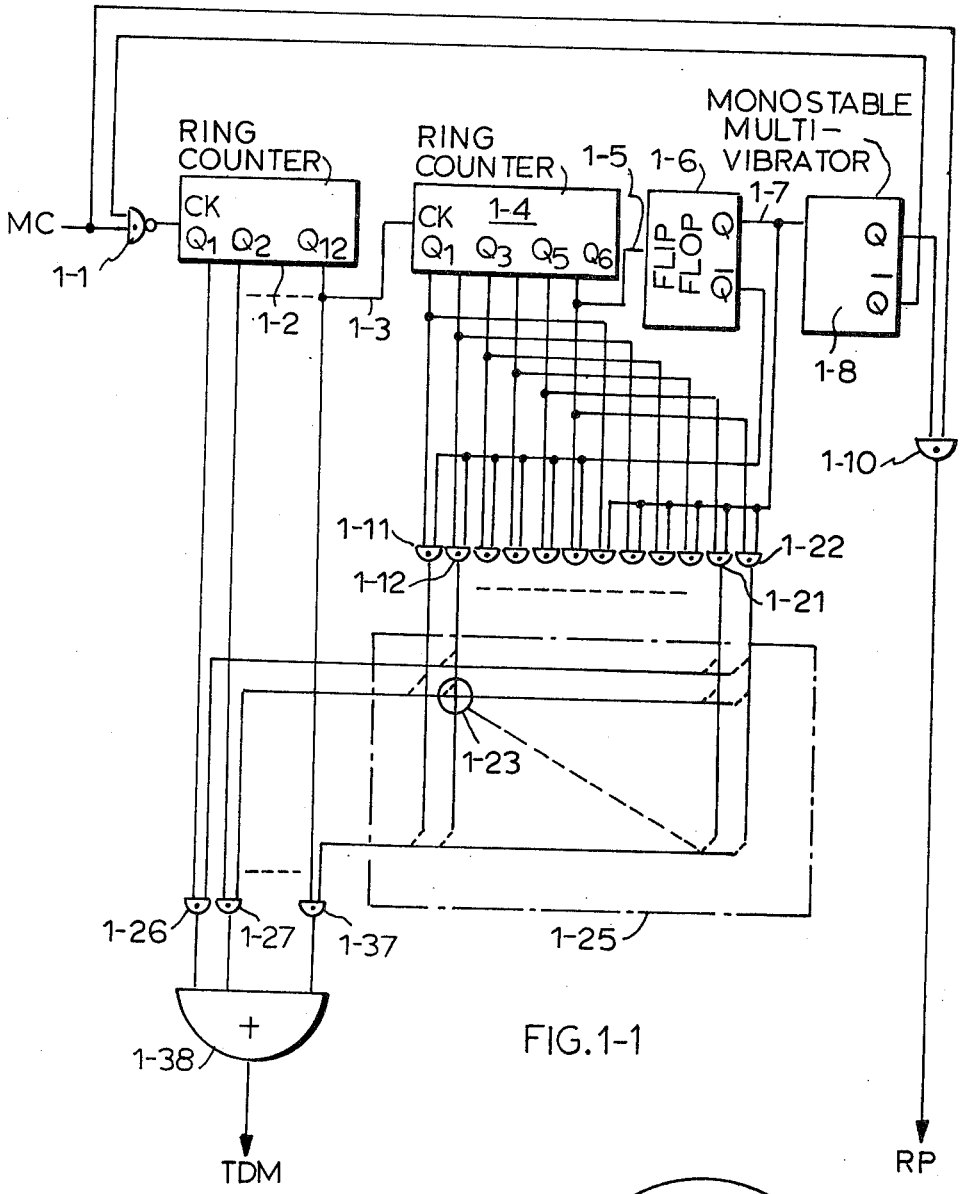

Referring to FIG. 1, a key assigner designated by a reference numeral 0-1 cyclically scans key switches 0-11 in a predetermined order such as in the order of musical tone, and it converts depression of keys, i.e. closing or opening of contacts of the key switches, into time division multiplex (TDM) signals and supplies them to a generator assigner 0-2.

On receiving said TDM signals, the generator assigner 0-2 transfers information about the depressed key to one of the unassigned generators among a plurality of tone generators 0-7.

The generator assigner 0-2 also supplies the assigned tone generator 0-7 note clock signal selected from a note clock generator 0-3 in accordance with the note of the depressed key detected from said TDM signal to the above assigned tone generator 0-7. Moreover, it supplies signals indicating an octave and a stage of keyboards (great, swell or pedal) and a channel select signal which indicates that one of the tone generating channels is selected to the tone generator 0-7.

The note clock generator 0-3 produces repetitive pulse trains with twelve different frequencies which are required to generate musical note from tone C to note B in the highest octave at the tone generators 0-7 and supplies said pulse trains to the generator assigner 0-2 as note clock signals.

A tone selection detector 0-5 produces a demand signal and requires a waveshape calculator 0-6 to restart a calculation of a newly required waveshape whenever tone selectors 0-12 such as tone tablets, draw-bars or preset combination switches are actuated to set up new musical tone color.

The waveshape calculator 0-6 receives said demand signal and calculates a waveshape at every sampled point in accordance with the actuated tone selector 0-12, and then it transfers said calculated waveshape into memory devices in the tone generators 0-7.

Each tone generator 0-7 includes a memory device which stores the waveshape calculated by said waveshape calculator 0-6. Also, it includes a divider for dividing the repetitive frequency of said note clock signal in accordance with octave information supplied from the generator assigner 0-2, and it produces waveshape output by cyclic reading-out of said stored waveshape synchronously with said divided note clock signal.

An envelope generator 0-9 connected to each tone generator controls the envelope shape, such as an attack, a decay or a sustain, of the generated waveshape after a digital to analog conversion of said waveshape output from the tone generator 0-7.

A DA converters 0-8 are provided between each tone generator 0-7 and envelope generator 0-9 so as to convert a digital waveshape output from the tone generator 0-7 into analog form, and any conventional digital to analog converting device can be used for this purpose.

The envelope of each of the signals converted into analog form is controlled by the envelope generator 0-9, and after that the resultant signals are added and produced as an acoustic signal through an adding and amplifying circuit 0-10 which is also a conventional one used widely so that the description thereof is omitted.

A fundamental system of an embodiment of FIG. 1, wherein tone colors are selected by tablet switches, comprises waveshape memory devices for storing amplitudes at two or more sampled points of one cycle of a waveshape corresponding to each tone, i.e. each tablet, and means for taking out, from the memory devices, at least one waveshape required in accordance with the actuated tone selector 0-12. In the waveshape calculator 0-6, a synthesized waveform is obtained by making a summation of the amplitude at each sampled point of the above at least one selected waveshape, and said synthesized waveshape is stored in a plurality of memory devices. The waveshape calculator 0-6 synthesizes a waveshape in accordance with the actuation of said tone selector 0-12 and transfers said synthesized waveshape into said plurality of memory devices. Then, said waveshapes stored in the plurality of memory devices are individually read-out synchronously with different note clock signals of selected high frequencies in accordance with pitches of the respective depressed key switches, and musical tones are generated.

Another fundamental system of an embodiment of FIG. 1, wherein tone colors are set up by draw-bars, comprises means for determining a relative coefficient of each harmonic magnitude of a required musical tone color such as draw-bars and sine value memory devices for memorizing amplitudes at two or more sampled points of one cycle of a sine wave. In the waveshape calculator 0-6, a synthesized waveform is obtained by a calculation of a discrete Fourier representation of a sampled periodic complex wave with predetermined coefficients of each harmonic and the stored values of sampled sine wave. Said synthesized waveshape is stored in a plurality of memory devices. The wave shape calculator 0-6 synthesizes a waveshape in accordance with the actuation of said means which determines the relative coefficient of each harmonic and transfers said synthesized waveshape into said plurality of memory devices. Then, said stored waveshapes are individually read-out synchronously by note clock signals of selected high frequencies in accordance with the pitches of depressed key switches, and musical tones are generated.

In a further fundamental system of an embodiment of FIG. 1, tone color are selected by preset switches, a selection of musical tone colors corresponding to the preset switches is carried out by the touch of tablets or draw-bars, and musical tones are also generated in the aforesaid sequence.

Output waveshapes generated individually from the plurality of memory devices in digital form are then converted into a plurality of analog signals, and envelopes of said analog signals are controlled by the envelope generators 0-9 so as to have the form of an attack, a decay including a sustain for depression or release of key switches by analog multiplication. A detailed description of each component will now be given.

The key assigner

FIG. 1—1 shows an embodiment of a key assigner. A twelve step ring counter 1-2 generates sequential outputs at its output terminals $Q_1$ to $Q_{12}$ synchronously with a master clock signal MC supplied through a gate 1-1. A six step ring counter 1-4 is driven by an output from said output terminal $Q_{12}$ and generates sequential outputs at its output terminals $Q_1$ to $Q_6$ synchronously with repetitive output signals at said output terminal $Q_{12}$.

A keyboard pointing flip flop 1-6 is connected to the output terminal $Q_6$ of the six step ring counter 1-4. A monostable multivibrator 1-8 is connected to an output terminal Q of said flip-flop 1-6 and generates a pulse output whenever the output at said terminal Q changes to "0" from "1". The pulse width of said output of the monostable multivibrator 1-8 is such as to cover the pulse width of the master clock signal MC supplied to the gate 1-1.

Figures 1, 2:
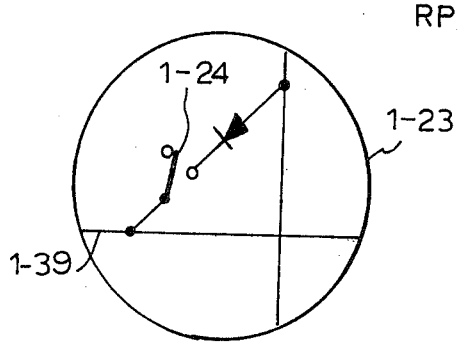
Figures 1, 2, 3:
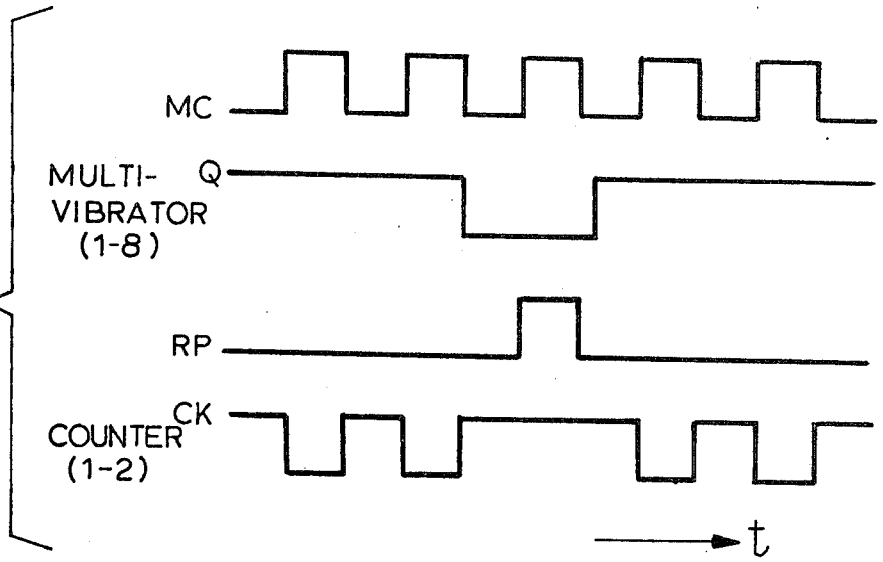

The output Q of said monostable multivibrator 1-8 and the master clock signal MC are supplied to an AND gate 1-10, and the AND gate 1-10 generates an output of a single pulse after the output of said flip-flop 1-6 changes to "0" from "1". This single pulse output is designated RP (reset signal) hereinafter. The outut at $\overline{Q}$ of said monostable multivibrator 1-8 is supplied to the NAND gate 1-1, and therefore, one of the pulses of a master clock signal MC is prohibited from driving said twelve step ring counter 1-2, as shown in FIG. 1-3. A reset signal RP marks the time of the end and at the same time the start of the TDM signal.

Output signals at terminals $Q_1$ to $Q_6$ of said six step ring counter 1-4 represent octave data signal OC, and outputs of said flip-flop 1-6 represent keyboard data signal key. Said data signal OC and KY are supplied to AND gates 1-11 to 1-22, and octave data signal OC for an individual key on a keyboard is obtained at output terminals of said AND gates 1-11 to 1-22. Output signals from AND gates 1-11 to 1-22 sequentially appear without coincidence with each other, and one cycle of a sequence takes place between two successive signals reset.

FIG. 1–2 shows one of the keyswitches of a group 1-25. An output line 1-39 of switch 1-24 is in opened state when the switch is not depressed. When the keyswitch 1-24 is depressed, octave data signal OC for an individual key of a keyboard appears in the output line 1-39.

By supplying said octave data signal OC and outputs $Q_1$ to $Q_{12}$ of said twelve step ring counter 1-2 to AND gates 1-26 to 1-37, note data signal NT for a depressed keyswitch with additional information as to the keyboard and octave appears at output terminals of said AND gates 1-26 to 1-37. Note data signal NT for each keyboard and octave are logically summed up at OR gate 1-38 and appear as the aforesaid TDM signal at its output terminal.

As shown in FIG. 1-4, note information items are carried as corresponding time slots of said TDM signal, each time slot representing a note of an individual octave and keyboard. In FIG. 1-4, pulse trains constituting the TDM signal are shown with the solid lines as an example of when keys $C_3$ and $E_3$ of upper keyboard and keys $C_2$, $E_2$ and $G_2$ of lower keyboard are depressed. Information items for a note, an octave and a keyboard corresponding to a depressed keyswitch are detected by counting the time interval between the TDM pulses and the aforesaid reset signal RP.

Generator assigner including channel assigner

FIG. 2–1 is a block diagram of an embodiment of a generator assigner. A channel search circuit 2-50 selects one channel assigner 2-51 from ones not yet assigned among a plurality of channel assigners 2-51 by detecting information about the assigned state of said one channel assigner 2-51, and prepares the selected one as an assigner which set for setting up a musical tone in accordance with a newly arriving TDM signal. A plurality of groups of blocks 2-51, 2-53 and 2-54 enclosed by the dotted line in FIG. 2–1 are provided, although only one group is shown in the figure. For example, ten groups are provided, one for each of ten channels. The channel search circuit 2-50 sequentially scans a plurality of channels (channel assigners 2-51) by generating a channel search signal CS and captures an empty channel (channel assigner 2-51), and then it stands by until said search signal CS appears again.

When a new TDM signal arrives, indicating that another keyswitch is depressed, said captured channel (channel assigner 2-51) receives the information and generates a channel assigned signal CD. On receiving said signal CD, the channel search circuit 2-50 generates channel search signal CS and restarts scanning of channels to look for and capture another empty channel. The sequence is repeated whenever a new TDM signal arrives when a new keyswitch is depressed.

The channel assigner 2-51 captured by said channel search circuit 2-50 receives the TDM signal and reset signal RP, both transferred from the key assigner 0-1 and decodes the received TDM signal into three kinds of signals, i.e. KY for a keyboard, OC for an octave and NT for a note. The keyboard data signal KY is transferred to the tone generator 0-7 and to the envelope generator 0-9. The octave data signal OC is usually transferred to a phase coincidence circuit 2-53 and to the tone generator 0-7. In some cases, it is not transferred to the phase coincidence circuit, as described later. The note data signal NT is transferred to the phase coincidence circuit 2-53 and a note clock selecting circuit 2-54. The channel assigner 2-51 transfers the keyboard data signal KY to the tone generator 0-7 and an empty signal generator 2-56 synchronously with a phase coincidence signal PM from the phase coincidence circuit 2-53, after confirming the presence of a stop signal STP from the tone generator 0-7, and also it transfers a channel assigned signal CD to the channel search circuit 2-50.

When one of the TDM signals disappears, i.e. when the corresponding keyswitch is released, the channel assigner 2-51 supplies a decay start signal DS to a decay memory circuit 2-55 and to the envelope generator 0-9. The channel assigner 2-51 receives a decay end signal DE or pseudo-decay end signal PDE, and then it supplies a channel not assigned signal NS to the channel search circuit 2-50 and inhibits the keyboard data signal KY which is supplied so far to the tone generator 0-7 and to the empty signal generator 2-56. A repetitive depression of the same keyswitch during the time when one of the channels is in a decay mode, i.e. the corresponding TDM signal disappears, but a decay end signal DE is not yet supplied from the decay memory circuit 2-55, results in generation of a restart signal RST from the channel assigner 2-51 to the decay memory circuit 2-55 and to the envelope generator 0-9 for supplying a signal representing a repetitive demand of an assignment of the same tone.

The phase coincidence circuit 2-53 responds to twelve note clock signals TNC and produces a plurality of phase coincidence signals PM, and according to note data signal NT and octave data signal OC (this is not always used) transferred from the channel assigner 2-51, it selects individual phase coincidence signal PM for said note and octave data signals and transfers it to the channel assigner 2-51.

The note clock selecting circuit 2-54 selects a required note clock signal NC from a group of twelve note clock signals TNC according to note data signal NT appointed by the channel assigner 2-51 and transfers the selected note clock signal NC to assigned tone generator 0-7.

The empty signal generator 2-56 detects the state wherein none of the keyswitches is depressed by confirming that no keyboard data signal KY is appearing, and it generates an empty signal EP, "1" for an empty and "0"for not empty and transfers it to the envelope generator 0-9.

The decay memory circuit 2-55 memorizes the order of occurrence of decay start signals DS generated in a plurality of channel assigners 2-51, and when a number of musical tones greater than the number of the channel assigners, are required, it generates a pseudo-decay end signal PDE for the channel assigner 2-51 which has been assigned earliest for causing decay therein. The pseudo-decay end signal PDE is transferred to the channel assigner 2-51 together with the decay-end signal DE from the envelope generator 0-9. The decay memory circuit 2-55 also receives restart signal RST from the channel assigner 2-51 and decay end signal DE and pseudo-decay end signal PDE from the envelope generator 0-9, and by referring to these signals RST, DE and PDE it memorizes again the order of the channel assigners assigning the musical tones which are still in a decay state, other than those assigned the musical tones the decay of which is ended.

FIG. 2—2 shows another embodiment of a generator assigner, in which the same numerals designate the same components as those in FIG. 2–1, and these components operate similarly to those in FIG. 2–1. The difference from the aforesaid embodiment of FIG. 2–1 is that a phase coincidence circuit 2-63 generates phase coincidence signals PM for each of the musical notes which are already assigned, by reference to waveshape starting signals OU from the tone generators 0-7 and note data signal NT from the channel selectors 2-51 which are assigning musical tones corresponding to depressed keyswitches. The phase coincidence circuit 2-63 also selects a new phase coincidence signal PM by reference to note data signal NT from a channel assigner 2-51 which has been newly assigned a musical tone corresponding to a newly depressed keyswitch. These aforesaid phase coincidence signals PM are transferred to the channel assigners 2-51 which are set up for each corresponding note assigners 2-51.

THE CHANNEL SEARCH CIRCUIT

FIG. 2–3 shows a circuit of an embodiment of a channel search circuit 2-50 used in the embodiment of FIG. 2–1. in FIG. 2–3, a 10 step ring counter of 2-1 selects an arbitrary number of channel assigners from a plurality of channel assigner 2-51, (ten channel assigners in this embodiment). Each of AND gates 2-4 to 2-13 combines one of the ten outputs of said ring counter 2-1 and one of ten channel assigned signals CD from the ten channel assigners, and it supplies an output "1" when a channel assigned signal CD is supplied from an individual channel selector 2-51 which is sequentially selected by said ring counter. An OR gate 2-2 make a logical summation of the outputs of said AND gates 2-4 to 2-13 and supplies said "1" output to an AND gate 2-3, and then the AND gate 2-3 is opened and master clock signal MC is passed to the ring counter 2-1.

The ring counter 2-1 shifts according to the master clock signal MC and its output, i.e. a channel search signal CS, sequentially scans a plurality of channel assigners 2-51 (ten assigners in this embodiment). When the channel search signal CS detects an empty channel, i.e. a channel with "0" as its channel assigned signal CD, the ring counter stops immediately and waits for the next demand for a channel search. The ring counter 2-1 again starts searching when another channel assigner 2-51 generates a channel assigned signal CD and again stops after detecting an channel assigner 2-51 having an empty channel.

THE CHANNEL ASSIGNER

Figures 1, 2, 3, 4:
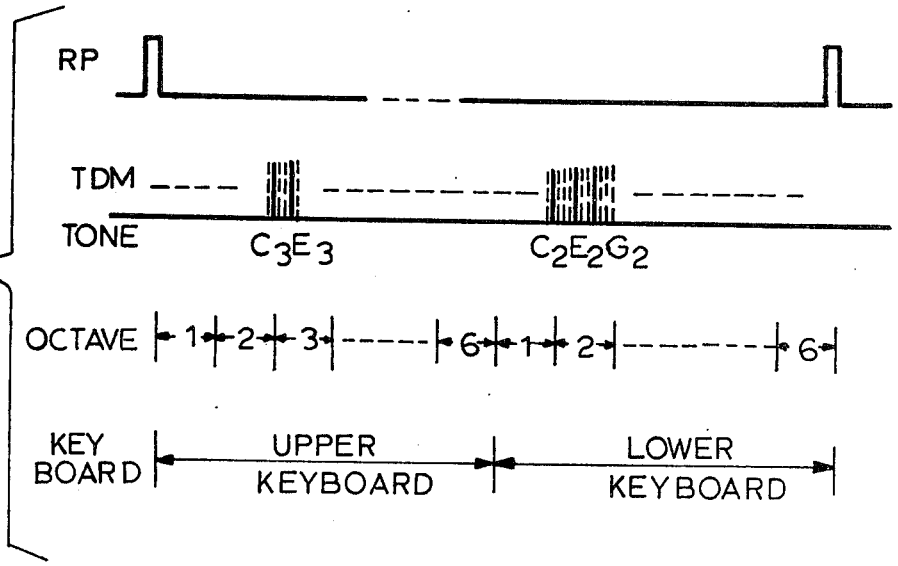

FIG. 2–4 shows a circuit of an embodiment of a channel assigner 2-51 in FIG. 2–1. The portion of the circuit inside the dotted line in the figure are prepared for each channel in a practical embodiment, and for convenience only the parts for the i-th channel are shown in FIG. 2–4. The parts above the dotted line in FIG. 2–4 are prepared commonly for the all channels, i.e. ten channels in this embodiment, and in these parts a logical operation for ten zero-count signals $\overline{ZC_1}$, to $\overline{ZC_{10}}$ is made by an equation $\overline{\Sigma\ ZC_i} = \pi\ \overline{ZC_i}$. A detailed description of the sequence of the circuit for various conditions is provided in the following.

(1) When the channel assigner 2-51 is loaded:

In this case, flip-flop 2-71 is in set state wherein its output Q is "1" and the conjugate $\overline{Q}$ is "0". Therefore, AND gates 2-70 and 2-82 are both closed, and reset signal RP from a key assigner and TDM signals including keyboard data signal KY, octave data signal OC and note data signal NT, are all inhibited at said AND gates 2-70 and 2-82, respectively. Consequently, this i-th channel assigner does not run any more.

(2) When the channel assigner 2-51 is not loaded:

The flip-flop 2-71 is in the reset state and output $\overline{Q}$ is "1," and therefore AND gate 2–70 and 2–82 are both opened. The various sequences in this case in relation to the keyswitches are as follows:

(A) None of the keyswitches are depressed:

No TDM signals are received and the channel search signal is "0," and so flip-flop 2-71 is not set. On the other hand, a reset signal RP from a key assigner 0-1 is supplied to a modulo-145 counter 2-74 at a clear terminal R thereof through an AND gate 2-82 and an OR gate 2-83. Therefore, the modulo-145 counter 2-74 generates zero-count signal $ZC_i$ at the time of the 145th clock signal after receiving a reset signal RP. Consequently, zero-count signal $ZC_i$ is generated at the same time as reset signal RP. Since flip-flop 2-71 is in the reset state and its output $\overline{Q}$ is "1," an AND gate 2-95 is opened and gate flip-flop 2-78 is set by a reset signal RP from a key assigner 0-1. An output Q of gate flip-flop 2-78 is "1," and so AND gates 2-97 and 2-98 are both opened.

Reset signal RP is then supplied, through the AND gate 2-98, to modulo-12 counter 2-79, modulo-6 counter 2-80 and flip-flop 2-81 at their clear terminals R and repeatedly resets these circuits. Master clock signal MC is supplied to modulo-12 counter 2-79 at its clock terminal CK through the AND gate 2-97. A carry signal from said modulo-12 counter 2-79 is supplied to modulo-6 counter 2-80 at its clock terminal CK, and a carry signal from modulo-6 counter 2-80 is supplied to flip-flop 2-81 at its clock terminal CK. These three counters 2-79, 2-80 and 2-81 repeatedly count master clock signal MC after being reset by signal RP until any of the keyswitches are depressed.

(B) One of keyswitches is depressed:

When the i-th channel in the channel search circuit 2-50 is selected and loaded, a TDM signal at a time-slot corresponding to depress keyswitch 1-23 is supplied to flip-flop 2-71 at its set terminal S through AND gate 2-70. By this TDM pulse, modulo-145 counter 2-74 is reset through an OR gate 2-83 and starts counting of master clock signal MC and generates zero-count signal $ZC_i$ at its 145th clock signal. Also flip-flop 2-71 is set and its output Q turns to "1," and the output is transferred to the channel search circuit 2-50 as channel assigned signal CD. This channel assigned signal CD drives ten step ring counter 2-1 in channel search circuit 2-50 which seeks an adjacent empty channel assigner 2-51 and stays for the next demand for a channel assignment.

An output $\overline{Q}$ of flip-flop 2-71 turns to "0" and both the AND gates 2-70 and 2-82 are closed. After that, neither TDM signal nor a reset signal RP are supplied to a clear terminal R of modulo-145 counter 2-74. Consequently, modulo-145 counter 2-74 generates a zero-count signal ZCi, a repetitive pulse output of with a duration of 145 clock intervals and with a constant delay from said reset signal RP. This delay indicates the location of a depressed keyswitch 1-23, note i.e. keyboard data signal KY, octave data signal OC and note data signal NT. A zero-count signal ZCi is of course generated at the same time as the occurrence of TDM signal representing said depressed keyswitch, i.e., the musical note assigned by channel assigner 2-51.

When flip-flop 2-71 is set and its output Q turns to "1", the output "1" open AND gate 2-96 at the reset terminal R of gate flip-flop 2-78 and said gate flip-flop 2-78 is reset by master clock signal MC. An output Q of the gate flip-flop 2-78 turns to "0" and closes AND gates 2-97 and 2-98. Master clock signal MC and reset signal RP are then not supplied to modulo-12 counter 2-79, and modulo-12 counter 2-79, modulo-6 counter 2-80 and flip-flop 2-81 all immediately stop to run. Consequently, the output pattern of the above three counters, 2-79, 2-80 and 2-81 indicate note data signal NT, octave data signal OC and keyboard data signal KY respectively, i.e. the information of a depressed key. This information is held on each counter until flip-flop 2-71 is reset and then gate flip-flop 2-78 is set, and they are transferred to tone generator 0-7.

(C) When another keyswitch is depressed under the case of (B);

Another TDM signal appears at a different time slot from that of the aforesaid keyswitch 1-23. This pulse signal is applied to a channel assigner 2-15 of another channel different from that which is previously loaded, and the newly loaded channel assigner 2-51 undergoes the same sequence as that mentioned before.

A zero-count signal ZCi ($i = 1, 2 \ldots 10$) prevents any of channel assigners 2-51 from assigning the same musical note again which is already assigned by another channel assigner 2-51. Zero-count signals ZCi from a plurality of channel assigners 2-51 (for example 10 as in the embodiment) logically are summed and passed through OR gate 2-250 and inverter 2-251, and the the output of inverter 2-251 is $\overline{\Sigma\ ZCi}$ which is equal to $\pi\ \overline{ZCi}$. The above zero-count signals appear synchronously with TDM signals corresponding to the musical notes under assignment, and therefore an output of said inverter 2-251 turns to "0" synchronously with the corresponding TDM signal. The above output is supplied to AND gates 2-70 of every channel assigner 2-51, and the AND gate 2-70 inhibits the supply of a setting pulse, which is synchronized with a time slot of TDM signal which is already under an assignment, to flip-flop 2-71. That is, an output of $\overline{\Sigma ZCi} = 0$ inhibits a musical note which is already under an assignment from being assigned by another channel assigner of an empty channel.

The outputs of flip-flop 2-71 are shifted to stop flip-flop 2-72 through AND gates 2-88 and 2-89 when stop signal STP is "1" indicating that shift register 7-12 (FIG. 7–1) of tone generator 0-7, which will be mentioned later, is stopped. An AND gate 2-88 is opened by said stop signal STP and a AND gate 2-89 is closed by a stop signal STP inverted by an inverter 2-87. Channel assigned signal CD passing through stop flip-flop 2-72 sets flip-flop 2-73 synchronously with phase coincidence signal PM from a phase coincidence circuit 2-53 pr 2-63, because phase coincidence signal PM opens AND gate 2-91 and closes AND gate 2-92 through inverter 2-90.

When phase coincidence flip-flop 2-73 is set, keyboard data signal KY1 or KY2 appears through AND gates 2-99 and 2-100. These keyboard data signals KY1 and KY2 are transferred synchronously with the time when the channel is just assigned, differing in this respect from other data signals. That is, this data signal indicates the keyboard of the depressed keyswitch and also indicates that the channel is just assigned. The keyboard data signal KY1 or KY2 supplies a note clock signal to shift register 7-12 (FIG. 7-1) of tone generator 0-7 so that a waveshape signal output of the musical tone is generated from said shift register 7-12.

(D) When a keyswitch which was depressed is released:

In view of the signal patterns, this case means that a zero-count signal ZCi from modulo-145 2-74 counter still appears but TDM signal corresponding to the released keyswitch does not appear. Therefore, the output of inverter 2-84 turns to "1" and AND gate 2-85 is opened. Consequently, the output of AND gate 2-85 turns "1" due to zero-count signal $ZC_i$ of modulo-145 counter 2-74 and decay start flip-flop 2-75 is set. Then, monostable multivibrator 2-76 generates decay start signal DS which directs the start of decaying of the muscial tone. By this decay start signal DS, envelope controller 0-9, which is mentioned later, is set into decay mode and also a decay memory flip-flop 9-25, which is mentioned later, is set and stores the a start of decay.

When the same keyswitch, which corresponds to the musical tone just under decay mode, is again depressed, AND gayte 2-86 is opened synchronously with zero-count signal $ZC_i$ and a TDM signal generates a restart signal RST. This restart signal RST clears decay memory flip-flop 9-25 (FIG. 9-3), described later, of envelope controller 0-9 and releases envelope controller 0-9 from the decay mode. At the end of the decay mode wherein the signal level decays less to than a predetermined level, envelope controller 0-9 generates Decay end signal DE. A decay end flip-flop 2-77 is set by said decay end signal DE, and an output of decay end flip-flop 2-77 opens AND gate 2-94. The first reset signal RP from key assigner 0-1 is then supplied to aforesaid flip-flop 2-71 at its resets terminal and reset it. Channel assigner 2-51 is, therefore, released, wherein channel assigned signal CD turns to "0", and it waits for the next assignment. Decay end flip-flop 2-77 is reset by the first reset signal RP through inverter 2-93, and waits for the next operation.

When demand flip-flop 2-71 is reset, AND gate 2-82 is opened, and reset signal RP is supplied to a modulo-145 counter 2-74 at clear terminal R through said gate 2-82 and an OR gate 2-83. Then, modulo-145 counter 2-74 generates its output synchronously with said reset signal RP, that is, information of a musical tone is cleared. Furthermore, when demand flip-flop 2-71 is reset, said reset signal RP sets an gate flip-flop 2-78 through an AND gate 2-95. Then, AND gates 2-97 and 2-98 are both opened, and said reset signal RP is supplied again to modulo-12 counter 2-79, modulo-6 counter 2-80 and flop-flop 2-81 for resetting them and then any information of a musical tone, note data signal NT, octave data signal OC and keyboard data signal KY which are stored therein is cleared. Stop flip-flop 2-72 is also reset when demand flip-flop 2-71 is reset, and then phase coincidence flip-flop 2-73 is also reset. Consequently, AND gates 2-99 and 2-100 are both closed and flip-flop 7-4 of tone generator 0-7 is reset, wherein the clock signal for shift register 7-12 is inhibited.

THE DECAY MEMORY CIRCUIT

In this embodiment, in generator assigner 0-2 when more musical tones are selectively generated than the number of prepared tone generators 0-7, there is provided a decay memory circuit 2-55 which memorizes the order of the musical tones going into decay mode and a pseudo decay end signal generator which generates pseudo decay end signal PDE when musical tones more than the number of prepared tone generators 0-7 are assigned. Said pseudo decay end signal generator supplies pseudo decay end signal PDE to the tone generator 0-7 which first entered decay mode as indicated by said decay memory circuit 2-55, so as to cut off the output of said tone generator 0-7, and subsequently a decay memory circuit 2-55 memorizes a revised order of tone generators 0-7 which are in decay mode.

FIG. 2-5 and FIG. 2-6 are an embodiment of decay memory circuit 2-55 in FIG. 2-1. Decay memory circuit 2-55 releases the channel which first entered the decay mode when a newly requested musical tone causes the number of musical tones requested to exceed the number of prepared tone generators (ten in this embodiment). Encoder 2-130 encodes decay start signal $DS_1$ to $DS_{10}$ into a four bit binary code designating the channel assigners 2-51 which enter decay mode. This decay start signal DS is memorized in a four bit decay memory flip-flop 2-131 synchronously with master clock signal MC through AND gates 2-140 to 2-143 and OR gates 2-145 to 2-148. Master clock signal MC is supplied to decay memory flip-flop 2-131 at its clock terminal CK through AND gate 2-139 and OR gate 2-144.

When decay start signal DS is stored in decay memory flip-flop 2-131, a signal which inhibits data and clock signals is supplied to AND gate 2-139 to 2-143 through OR gate 2-149 and inverter 2-150, so that supply of the next occurring decay start signal DS to said decay memory flip-flop 2-131 is prevented. Also, output of an OR gate 2-149 opens AND gates 2-155 to 2-158 and transfers this next occurring decay start signal DS to AND gates 2-160 to 2-163. This next occurring decay start signal DS is supplied to the second decay memory flip-flop 2-132 through AND gates 2-160 to 2-163 and OR gates 2-165 to 2-168 and memorized in said second decay memory flip-flop 2-132. Similarly, when a decay start signal DS is memorized in said second decay memory flip-flop 2-132, the next occurring decay start signal DS is transferred to the third decay memory flip-flop.

Circuit-blocks 2-177 to 2-183 each comprise the same circuits as those in 2-176. That is, when the 9th decay memory flip-flop is loaded, the next occurring decay start signal Ds is memorized in 10th decay memory flip-flop 2-133. The 10th decay memory flip-flop 2-133 stores said decay start signal DS, and the output of OR gate 2-186 closes AND gate 2-184 through invertor 2-187. When said AND gate 2-184 is closed, master clock signal MC is inhibited and the data stored in said decay start flip-flop 2-133 is protected.

Over-request gate 2-134 is a gate for passing the TDM signal corresponding to another musical note than that already assigned by channel assigners 2-51, when every flip-flop 2-71 (FIG. 2-4) of the prepared channel assigners is loaded. A monostable multivibrator 2-135 is triggered by said TDM signal through said over-request gate 2-134 and cleared by an input at its clear terminal C. The output of monostable multivibrator 2-135 which opens AND gates 2-151 to 2-154 enables decoder 2-136 to receive said decay start signal DS in binary code stored in decay memory flip-flop 2-131 and to decode it into decimal code.

The decoded decay start signal DS from decoder 2-136 is generated as pseudo decay end signal PDE from OR gates 2-190 to 2-199 in FIG. 2-6. This pseudo decay end signal PDE operates the same as aforesaid decay end signal DE indicating the end of the decay mode generated by tone generator 0-7. The group including circuits of gate 2-134, monostable multivibrator 2-135, AND gate 2-151 to 2-154 and decoder 2-136 is designated as a whole as a pseudo decay end signal generator.

The above pseudo decay end signal PDE is generated at the outputs of OR gates 2-190 to 2-199 (ref. FIG. 2-6) and transferred to decay end flip-flop 2-77 of (ref. FIG. 2-4) channel assigner 2-51 so as to release it for the assignment a newly requested musical note. Pseudo decay end signals PDE1 to PDE10 are supplied to AND gates 2-213 to 2-222 through OR gates 2-200 to 2-209 in combination with restart signals RST coming through AND gates 2-86 of tone generators 2-51 (ref. FIG. 2-4).

A 20 step ring counter 2-212 in combination with AND gates 2-213 to 2-222 transfers the outputs of Or gates 2-200 to 2-2:9 successively in synchronism with master clock signal MC to an encoder 2-223 even if said outputs appear simultaneously. Encoder 2-223 encodes the signal coming through said AND gates 2-213 to 2-222 into binary code. Outputs from said encoder 2-223 trigger monostable multivibrators 2-224 to 2-227, and the outputs of said monostable multivibrators are generated as pseudo-decay end clear signal PDER through OR gate 2-228 which clears monostable multivibrator 2-135 in FIG. 2-5. Accordingly, decay start signal DS newly memorized in the first decay memory flip-flop by shift operation thereof, described in the following, is prevented from being generated as pseudo decay end signal PDE through a decoder 2-136.

Outputs from monostable multivibrators 2-224 to 2-227 are supplid to a comparator 2-137, which compares outputs of monostable multivibrators 2-224 to 2-227 and stored data in the first decay memory flip-flop and generates an equality signal when they are equal. This equality signal is supplied to the first decay memory flip-flop 2-131 at its clock terminal CK through OR gate 2-114. At this time, since AND gates 2-140 to 2-143 are closed by an inhibiting signal from flip-flop 2-131 through OR gate 2-149 and invertor 2-150, the data stored in the second decay memory flip-flop 2-132 is shifted to the first flip-flop 2-131 through OR gates 2-145 to 2-148.

In the circuit block 2-176, an equality signal generated by either comparator 2-137 is supplied to the second decay memory flip-flop 2-132 at its clock input through OR gates 2-170 and 2-164, and in a manner like the first stage, stored data in the third decay memory flip-flop is shifted to the second decay memory flip-flop 2-132. Subsequently in the same manner, stored data in every of the other decay memory flip-flops up to the 9th which stores data equal to the output of encoder 2-223 is shifted one step higher. At the 10th decay memory flip-flop, an equality signal from one of the nine other comparators or the output of OR gate 2-228 in FIG. 2-6 is supplied to said 10th flip-flop at its clock input through OR gates 2-188 and 2-185 and erases its stored data. Since the clock signal for twenty (20) step ring counter 2-212 should count up 20 steps while decay end signal DE, pseudo decay end signal PDE and restart signal RST are at the "1" level the frequency of the clock of said twenty (20) step ring counter 2-212 should be more than a multiple of twenty times the frequency of said three kind of signals.

THE EMPTY SIGNAL GENERATOR

FIG. 2-7 shows embodiment of an empty signal generator 2-56 in FIG. 2-1 and FIG. 2-2. Empty signal generator 2-56 receives keyboard data signals KY1 and KY2 from a channel assigner 2-51 and searches whether one or more musical notes is required in each of the keybords or not.

In FIG. 2-7, OR gates 2-230 and 2-231 both make a logical summation of keyboard data signals KY1 and KY2 for the whole channel. Inverters 2-232 and 2-233 connected to each output of OR gate 2-230 and 2-231 invert the output of the above OR gates and produce empty signals EP1 and EP2, respectively. These empty signals EP1 and EP2 are used, for example, as triggering signals for a percussive effect, an automatic rhythm sound, a delay vibrator or an automatic mute.

THE NOTE SELECTING CIRCUIT

FIG. 2-8 shows an embodiment of the note selecting circuit in FIG. 2-1 and FIG 2-2. Selecting circuits 2-111 to 2-120 pass and transfer note clock signals selected from a group of note clocks TNC (C, C#, D, D#. . . B) by aforesaid note information NT ($NT_1$, $NT_2$. . . $NT_{10}$). These selecting circuits are composed of conventional IC data selectors such as SN74150 of Texas Instrument Co. in U.S.A.

THE PHASE COINCIDENCE CIRCUIT

In this embodiment, the phase coincidence circuit comprises a waveshape starting signal generates which generate a waveshape start signal indicating the start of a waveshape, a plurality of waveshape start signal selectors which select the waveshape start signal corresponding to the note of a generated musical tone color, and a channel assigning signal transfer circuit which transfers a channel assigning signal commanding the generation of a musical tone color to a tone generator synchronously with the waveshape start signal selected by one of said waveshape start signal selectors. The tone generator starts its sequence synchronously with said waveshape starting signal, and when two or more tone generators 2-51 are assigned to generate two or more of the same note but of a different octave, these assigned tone generators 2-51 generate musical tones having a predetermined phase relation therebetween. Furthermore, said waveshape starting signal generator comprises a circuit which detects a reference level of the waveshape and a note filing circuit which collects waveshape starting signals from said detecting circuit and by logical multiplication generates the waveshape starting signal for each note.

FIG. 2-9 shows an embodiment of the phase coincidence circuit 2-63 in FIG. 2-2. Each of decoders 2-270 to 2-279 decodes a binary coded number into a modulo twelve number. Modulo twelve number signals from decoder 2-270 are transferred to twelve AND gates 2-316 to 2-327 each having ten input terminals through NAND gates 2-280 to 2-315 of two input terminals each. Data selecting circuits 2-328 to 2-339 select a data which is designated by note data signal NT, from the group of twelve outputs data from AND gates 2-316 to 2-327.

Since an output waveshape starting signal OU produced by modulo-128 counter 7-11 (FIG. 7-1) of tone generator 0-7 is, generated at a reference level of the waveshape, said modulo-128 counter can be used as a reference level detecting circuit. Waveshape starting signal OU is transferred to an appointed signal line in combination with note data signal NT decoded into a modulo-12 number by decoders 2-270 to 2-279, through NAND gates 2-280 to 2-315. For example, when a channel one designates a note "C," waveshape starting signal $Ou_1$ appear on line "a" through NAND gate 2-280, and the signal "1" is generated through NAND gates 2-281 to 2-315 on lines which are not so designated.

AND gates 2-316 to 2-317 file the input signals of different octanes for the same note, and waveshape starting signal OU for the same note is supplied to the corresponding AND gate in the group of gates 2-316 to 2-327. Therefore, the outputs of AND gates 2-316 to 2-327 appear at overlapping of waveshape starting signals OU for the same note of the assigned tone signal and filed for each note. Outputs of said AND gates 2-316 to 2-327 to which a waveshape starting signal OU is not supplied are always "1" and meaning that waveshape starting signals are always prepared for the notes treated by AND gates as mentioned above. Data selecting circuits 2-328 to 2-339 are waveshape starting signal selectors which select a waveshape starting signal OU for the note designted by note data signals NT from channel assigners 2-51 and supply said waveshape starting signals to channel assigners 2-51 as phase coincidence signals PM.

The note clock signal has a frequency $F_1$ such that $F_1 = f \times 6 \times 128$ wherein $f$ equals the frequency of the note in the highest octave. This embodiment is constructed to generate six octaves for note C and five octaves for the other notes, and therefore a phase coincidence signal with a frequency $F_2$ such as $F_2 = F_1/6 \times 128 > 2^6 = F_1/49152$, i.e. the note clock signal divided by 49152, must be produced to generate every musical tone of the same note coincidentally in phase.

FIG. 2-10 shows another embodiment of the phase coincidence circuit 2-53, wherein aforesaid waveshape starting signal generator comprises a note clock signal divider generating a divided note signal as said waveshape starting signal. A detail of note signal dividers 2-350 to 2-361 is shown in FIG. 2-11, and a time diagram of note signal dividers 2-350 to 2-361 is shown in FIG. 2-12.

In FIG. 2-11, three of divide by sixteen (16) counters 2-490 to 2-492 are connected in cascade, and a divide by 12 counter 2-493 is driven by the carry signal from the third divide by sixteen (16) counter 2-492 and divides the carry by twelve (12). AND gate 2-494 generates an output when counter 2-493 reaches its full count. A monostable multivibrator 2-495 generates a pulse output, with a pulse width selected to be equal to that of the note clock signal, when it is triggered by a signal from gate 2-494. The output of monostable multivibrator 2-495 is the output of note clock signal dividers 2-350 to 2-361 and is used as the clear signal of divide by 12 counter 2-493.

Waveshape starting signal selectors 2-362 to 2-371 select particular signals appointed by note data signal NT from the outputs of note clock signal dividers 2-350 to 2-361. They are composed of conventional data encoders and gate circuits. The outputs of note clock signal dividers 2-350 to 2-361 are supplied to waveshape starting signal selectors 2-362 to 2-371 wherein particular signals are selected by note data signal as mentioned before and they are transferred to tone generators 2-51 as phase coincidence signals PM.

FIG. 2-13 shows a further different embodiment of the phase concidence circuit 2-53 in FIG. 2-1, wherein said waveshape starting signals OU are prepared for each octave and the waveshape starting signal selectors comprise a circuit which selects waveshape starting signals by octave data signals OC in addition to note data signals N.T. A detail of note clock signal dividers 2-380 to 2-391 is shown in FIG. 2-14.

In FIG. 2-14, a divide by twelve(12) counter 2-500 divides its input note clock signal NC by 12, and its output is supplied to following three further stages of divide by sixteen 16 counters. Monostable multivibrator 2-504 to 2-509 are triggered by the negative edge of their inputs have a pulse width equal to that of the note clock signal NC. Therefore, monostable multivibrator 2-504 generates a pulse output once for every $12 \times 16 \times 8 = 1535$ inputs of the note clock signal NC. In a similar manner, each of the monostable multivibrators 2-505 to 2-509 generates a single pulse output for every 3072, 6144, 12288, 24576 and 49152 of the note clock signal NC, respectively. Consequently, a predetermined and constant timing interval occurs among these outputs, and the interval can be used as a phase coincident signal PM.

In FIG. 2-13, each of data selectors 2-392 to 2-397 selects an input signal appointed by binary note data signal $NT_1$ from a group of 12 inputs. A data selector 2-398 selects an input signal appointed by binary octave information OC from a group of six inputs, i.e. the above outputs from data selectors 2-392 to 2-397.

The note clock signals supplied to note clock signal dividers 2-380 to 2-391 are divided, and provided as a waveshape starting signal for each note of each octave as mentioned before. By data selectors 2-392 to 2-397, a signal which is assigned by channel assigner 2-51, i.e. a waveshape starting signal for an assigned note appointed by note data signal NT, is selected from said generated outputs, and then by data selector 2-398 a signal which is assigned by channel assigner 2-51, i.e. a waveshape starting signal OU for the octave designated by octave data signal OC, is selected from said outputs of data selectors 2-392 to 2-397 and transferred as phase coincidence signal $PM_1$. Waveshape starting signal selector 2-399 includes the group of data selectors 2-329 to 2-398, and waveshape starting signal selectors 2-400 to 2-408 are prepared for the other channels and generate phase coincidence signals $PM_2$ to $PM_{10}$.

FIG. 2-15 shows still another embodiment of the phase coincidence circuit in FIG. 2-1, wherein for the same note in different octaves particular octaves with frequencies higher than a predetermined value (200 Hz to 300 Hz for example), the same waveshape starting signal is used. A detail of note clock signal dividers 2-420 to 2-431 is shown in FIG. 2-16.

In FIG. 2-16, a divide by twelve (12) counter 2-520 divides note clock signal NC by 12, and each of divide by sixteen (16) counters 2-521 to 2-523 successively divides the output of the preceding counter. Monostable multivibrators 2-524 to 2-527 generate outputs upon receiving a "1" to "0" transition with a pulse width equal to that of note clock signal NC. Therefore, monostable multivibrator 2-524 generates a pulse output once for every $12 \times 16 \times 16 \times 2 = 6144$ inputs of note clock signal NC. In a similar manner, each of monostable multivibrators 2-525 to 2-527 generates single pulse output for every 12288, 24576 and 49152 inputs of note clock signal NC, respectively. Consequently, a predetermined and constant timing interval occurs among these outputs, and the interval can be used as a phase coincidence signal PM.

In FIG. 2-15, each of data selectors 2-432 to 2-435 selects an input signal designated by binary note data signal $NT_1$ from a group of (12) inputs supplied from note clock dividers 2-421 to 2-432. Data selector 2-436 selects an input signal designated by binary octave data signal OC, from a group of six inputs which are supplied from said data selectors 2-432 to 2-435.

Twelve note clock signals TNC supplied to note clock signal dividers 2-420 to 2-431 are divided and provided as a waveshape starting signal for each note as mentioned before. These waveshape starting signals are prepared only up to the 4th octaves from the lowest and are not generated for the two upper octaves. Because the time difference at phase coincidence for the two upper octaves is very short and not perceived by human hearing it is advantageous to omit the circuits for phase coincidence at the high frequencies. Therefore, for the two upper octaves, the waveshape starting signal for the highest of the four lower octaves is used. Each of data selectors 2-432 to 2-435 selects a waveshape starting signal designated by note data siganl NT from a group of outputs of said note clock signal dividers. Data selector 2-436 selects the waveshape starting signal OU designated by octave data signal OC from a group of said selected waveshape starting signals and transfers it as phase coincidence signal $PM_1$. Waveshape starting signal selector 2-437 comprises the group of data selectors 2-432 to 2-436. Waveshape starting signal selectors 2-438 to 2-446 are prepared for the other nine channels and generate phase coincidence signals $PM_2$ to $PM_{10}$ which are transferred to channel assigner 2-51 of each channel.

FIG. 3 shows further another embodiment of the phase coincidence circuit in FIG. 2-1, wherein for two or more adjacent octaves, the same waveshape starting signal is used. A detail of note clock signal dividers 2-460 to 2-471 is shown in FIG. 4.

In FIG. 4, a divide by twelve (12) counter 2-530 divides note clock signal NC by 12, and each of the divide by sixteen (16) counters 2-531 to 2-533 divides successively an output of the preceding counter. Monostable multivibrators 2-534 to 2-536 generate outputs upon receiving a "1" to "0" transition with a pulse width equal to that of note clock signal NC. Therefore, monostable multivibrator 2-534 generates a pulse output once for every $12 \times 16 \times 16 = 3072$ inputs of note clock signal NC. In a similar manner, each of the monostable multivibrators 2-535 to 2-536 generates a single pulse output for every 12288 and 49152 inputs of note clock signal NC, respectively. Consequently, a predetermined and constant timing interval occurs among these outputs, and the interval can be used as a phase coincidence signal PM.

In FIG. 3, each of data selectors 2-472 to 2-474 selects an input signal designated by binary note data signal $NT_1$ from a group of (12) inputs corresponding to the twelve notes. A data selector 2-475 selects an input signal designated by binary octave data signal $OC_1$ from group of six inputs. Tweleve note clock signals TNC supplied to note clock signal dividers 2-460 to 2-471 are divided and provided as a waveshape starting signal for each note as mentioned before. Only one waveshape starting signal is prepared for each pair of adjacent octaves. Because human perception of the time interval for a musical tone to rise after the depression of a keyswitch is not very sensitive in the lower octaves but is sensitive for such a time interval in the higher octaves, only one starting signal is prepared for the two adjacent lower octaves so as to decrease the number of circuits. Data selectors 2-472 to 2-474 select the waveshape starting signal designated by note signal $NT_1$ from the group of outputs of said note clock signal dividers. Data selector 2-475 selects a waveshape starting signal designated by octave data signal $OC_1$ from the group of said selected waveshape starting signals and transfers it as a phase coincidence signal $PM_1$. Waveshape starting signal selector 2-476 comprises the group of data selectors 2-472 to 2-475. Waveshape starting signal selectors 2-477 to 2-485 are prepared for the other nine channels and generate phase coincidence signals $PM_2$ to $PM_{10}$ which are transferred to the channel assigner 2-51 for each channel.

In the above embodiments, monostable multivibrators are included in dividers 2-350 to 2-361, 2-380 to 2-391, 2-420 to 2-431 or 2-460 to 2-471, but the same performance can be obtained when said monostable multivibrators are connected after data selectors 2-362 to 2-371, 2-399 to 2-408, 2-437 to 2-466 or 2-476 to 2-485 and triggered by a "1" to "0" transition the above data selectors and generate phase coincidence signals PM. In this case, the phase coincidence circuit can be constructed with less monostable multivibrators than the aforesaid embodiments, but there is a disadvantage in that a useless phase coincidence signal PM may appear when note data signal NT or octave data signal OC is changed. Therefore, channel assigner 2-51 must shut out the phase coincidence signal during an interval whose length equals the pulse width of said monostable multivibrator after a change of note data signal NT or octave data signal OC. This can be performed by connecting a delay circuit, composed of a resistor and a capacitor for, at example the output circuit of stop flip-flop 2-72 in FIG. 2-4.

While the principle of phase coincidence is described hereinbefore for an embodiments processing time division multiplex signal, it is apparent that the above principle is available for a frequency division multiplex system or the conventional electronic organ system wherein an individual tone generator is prepared for each of keyswitch.

THE TONE SELECTION DETECTOR: A TABLET ASSIGNER AND A DRAW-BAR ASSIGNER

Tone selection detector 0-5 in FIG. 1 requires the waveshape calculator 0-6 to calculate the waveshape of a newly selected musical tone color when the player newly selects one of a group of tablet switches or draw-bars by a preset switch or actuates any of the tablet switches or draw-bars in a selected group.

Figures 1, 2:
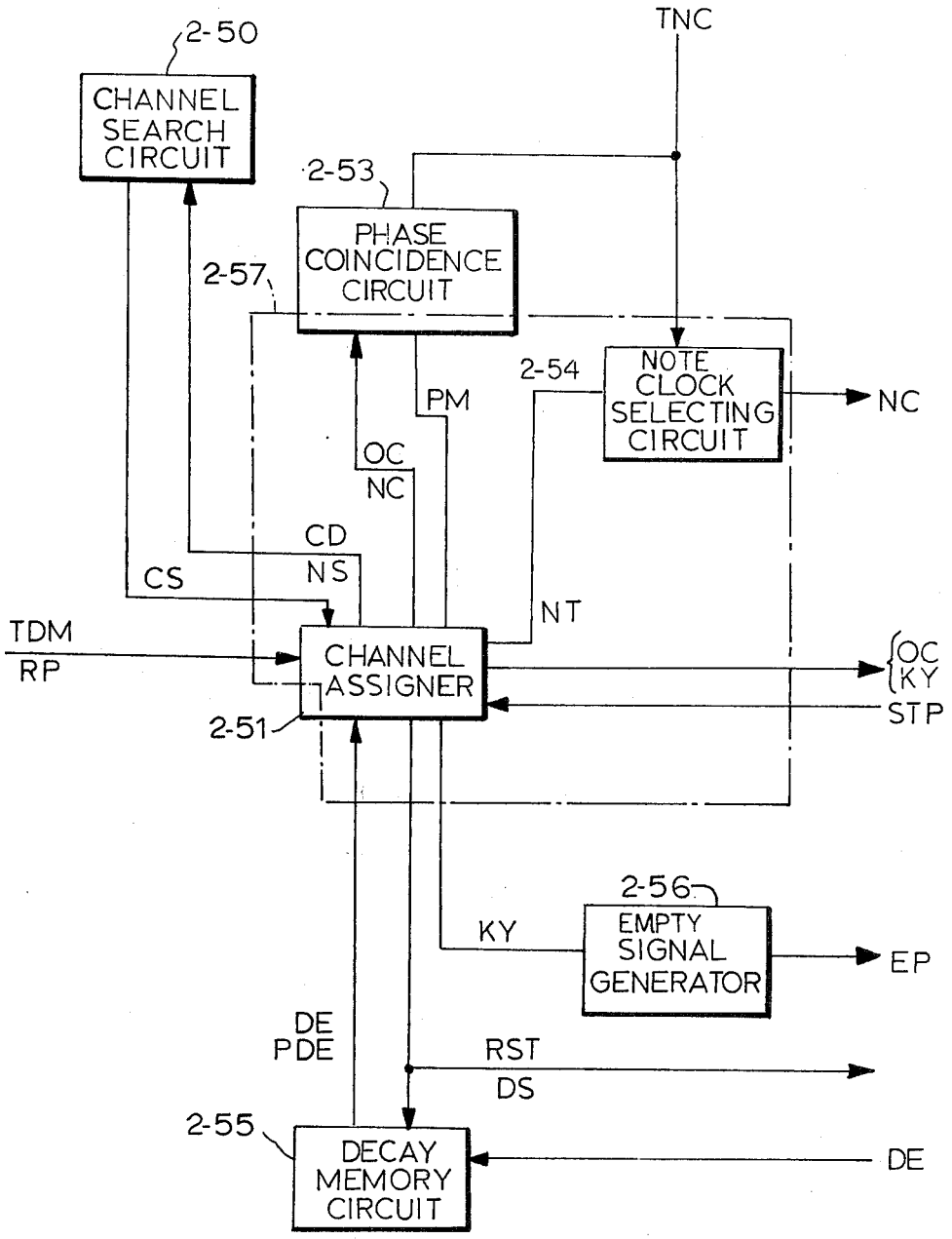
Figure 2:
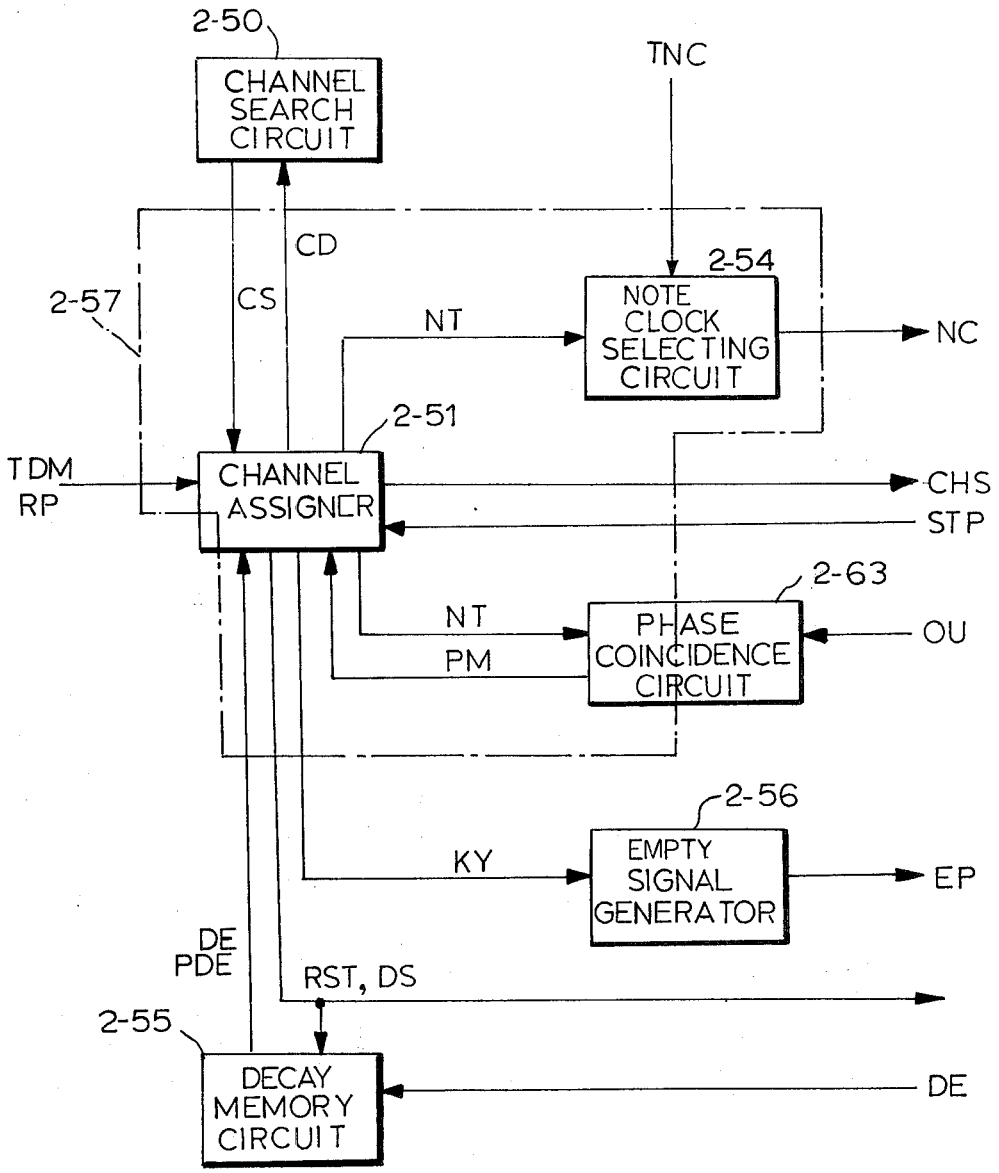
Figures 2, 3:
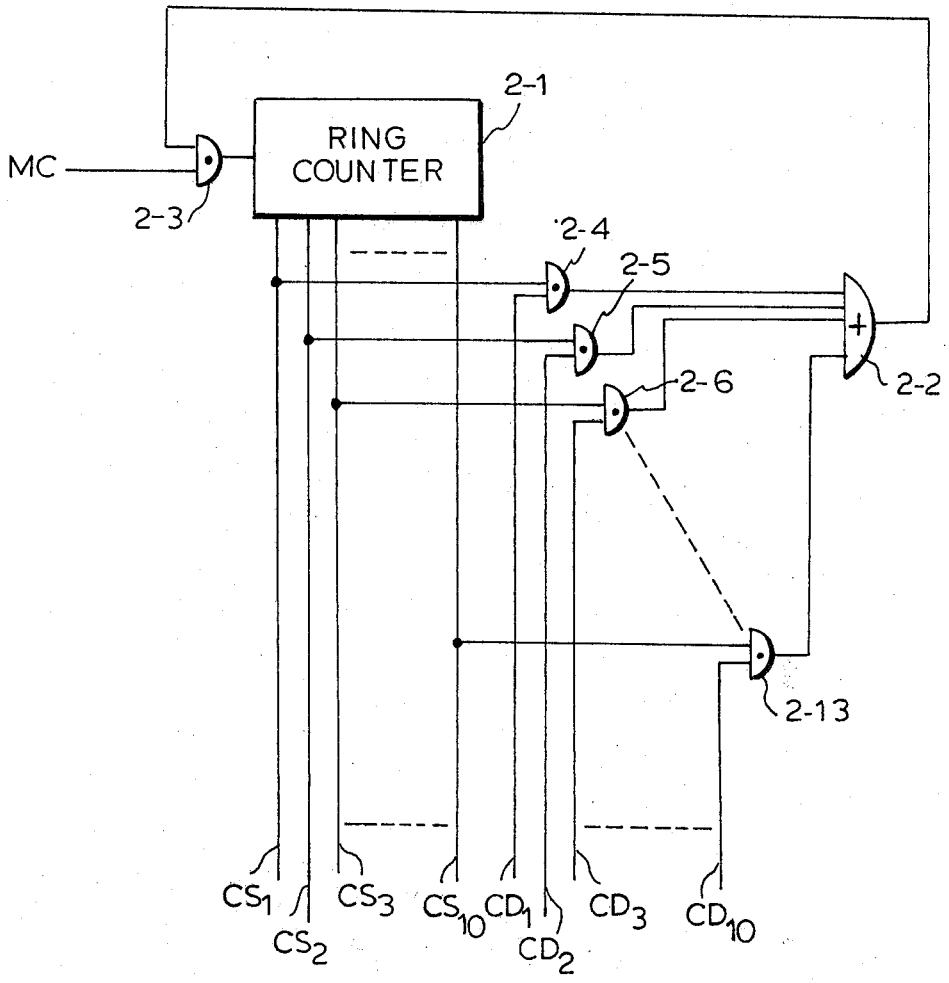
Figures 2, 3, 4:
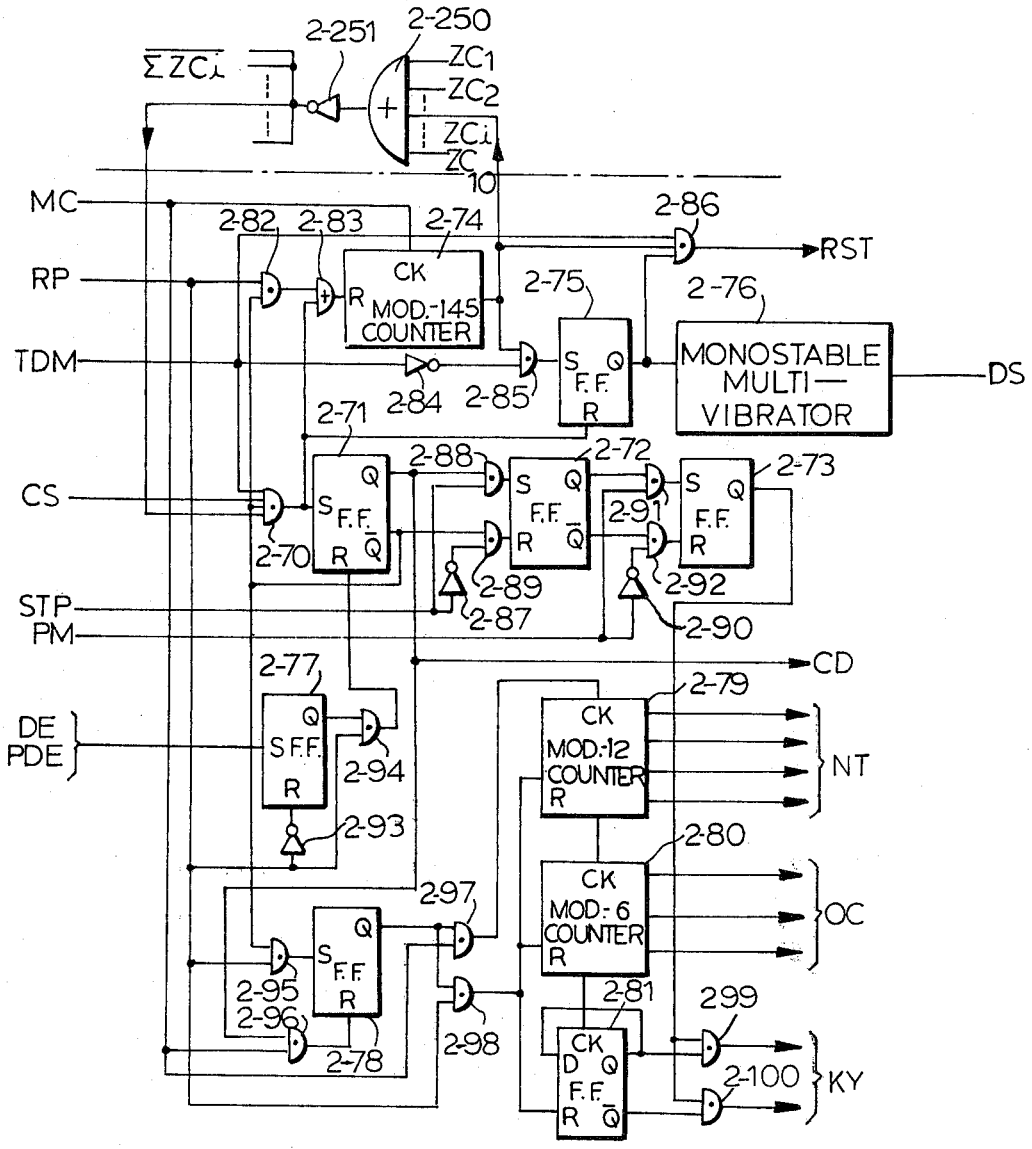
Figures 2, 3, 4, 5:
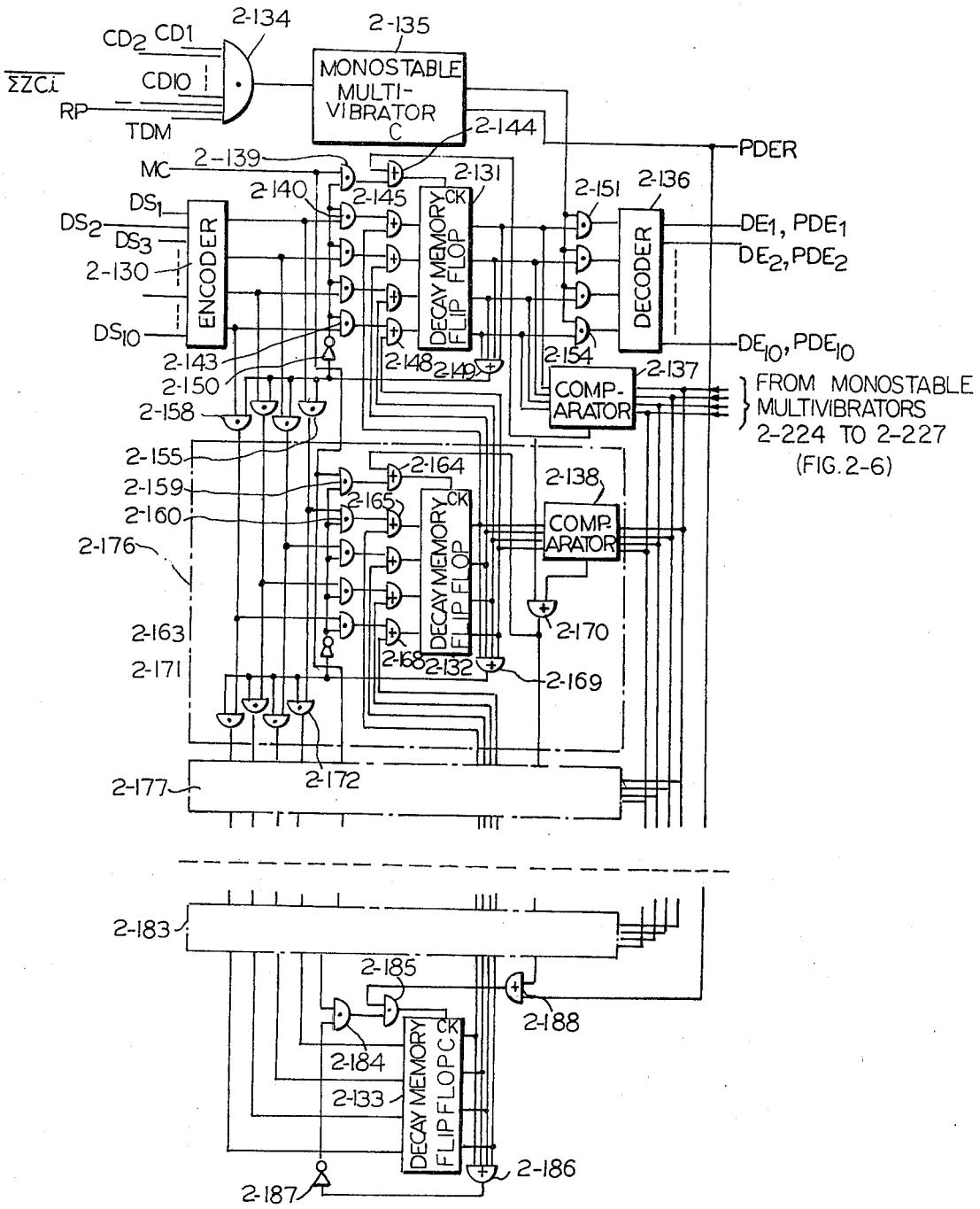

FIG. 5-1 shows an embodiment of the tone selection detector 0-5 in FIG. 1, wherein three groups of tablet switches, a group of draw-bars and four preset switches are used. In FIG. 5-1, preset control circuit 5-1 enables the player to select a desired group of tablet switches or draw-bars fromm a plurality of groups of tablet switches or draw-bars by a single switching action. Preset control circuit 5-1 is controlled by preset switches which are usually arranged under the keyboard where the player can quickly reach the switches.

Tablet assigner 5-2 scans the a group of tablet switches selected by the above preset control circuit and encodes the ON and OFF information of tablet switches in the selected group into a time division multiplex signal which is transferred to tablet selection detector 5-4. Draw-bar assigner 5-3 is controlled by preset control circuit 5-1. When a group of draw-bars is selected, draw-bar assigner 5-3 scans the a group of draw-bars selected by preset control circuit 5-1 and encodes the information of the contacts of the draw-bar switches into time time division multiplex signal, of four (4) bits for example, which is transferred to draw-bar selection detector 5-5. Tablet selection detector 5-4 watches the ON and OFF state of the tablet switches upon receiving said time division multiplex signal from tablet assigner 5-2. When said state is changed, i.e. when player actuates any of the tablet switches and sets up another state of tablet switches, tablet selection detector 5-4 supplies tablet waveshape calculating signal ($SEN_1$) 5-6 to waveshape calculator 0-6. Draw bar selection detector 5-5 watches the state of the draw-bar switches in a similar manner as said tablet selection detector 5-4 and supplies draw-bar waveshape calculating signal ($SEN_2$) 5-7 to waveshape calculator 0-6 when state of draw-bars is changed.

FIG. 5-2 shows an embodiment of said preset control circuit 5-1. In FIG. 5-2, flip-flops 5-10, 5-11, 5-12 and 5-13 are prepared for storing the selected preset switch states, and each of flip-flops is triggered by signals PA, PB, PC and PD from preset switches which select groups A, B and C of the tablets and a group D of draw-bars, respectively. The above preset switches are arranged such that the latest actuated switch is always accepted, and therefore said flip-flops 5-10 to 5-13 store a signal corresponding to said latest actuated switch. Signals SA, SB, SC and SD are the outputs of said flip-flops 5-10, 5-11, 5-12 and 5-13, and they indicate that groups A, B or C of the tablets, or group D of the draw-bars are selected, respectively. An OR gate 5-20 makes a logical sum of said signals SA, SB and SC and its output turns to "1" when one of said three groups of tablets, A, B and C is selected.

The outputs of OR gates 5-15, 5-16, 5-17 and 5-18 clear every flip-flop 5-10, 5-11, 5-12 and 5-13 except the one selected by said preset switch so that the above OR gates prevent two or more flip-flops from being selected simultaneously. When flip-flop 5-10 is set, signal SA is "1," while signal SB, SC and SD are all "0" which indicates that tablet group A is selected. When the preset switch for draw-bar selection is later actuated and signal PD turns to "1," it triggers SD to "1" and outputs of OR gates 5-15, 5-16 and 5-17 clear flip-flops 5-10, 5-11 and 5-12 with making their outputs, i.e. signals SA, SB and SC, turn to "0". Flip-flop 5-13 keeps its state of "1" until a signal "1" is supplied to PA, PB or PC even when PD returns to "0" and indicating that the group of draw-bars is still selected.

FIG. 5-3 shows an embodiment of tablet assigner 5-2 in FIG. 5-1, wherein An ($n = 1, 2, \ldots 16$) represents a signal from nth tablet switch in group A, and also Bn and Cn represent signals from nth tablet switch in group B and C, respectively. In this embodiment, the group of tablets comprises (16) tablet switches corresponding to sixteen different musical tone colors (waveshapes), and the same musical tone color (waveshape) is prepared for the same index of *n*. SA, SB and SC are signals coming from preset control circuit 5-1 and represent that the tablet group A, B or C is selected, respectively.

When tablet group A is selected, SA turns to "1" while SB and SC are both "0", and AND gate 5-30 is opened through which signal $A_1$ can be passed. Signal $SEL_1$ appears as output of an OR gate 5-33. In a similar manner, output signals $SEL_2$ to $SEL_{16}$ corresponding to $A_2$ to $A_{16}$ of tablet group A are generated. Also, when SB or SC is "1," p178 there are generated output signals $SEL_1$ to $SEL_{16}$ corresponding to $B_1$ to $B_{16}$ or $C_1$ to $C_{16}$ of tablet group B or C, respectively, in a similar manner. A group of AND gates 5-34 and OR gate 5-35 encode the parallel generated signals $SEL_1$ to $SEL_{16}$ into a time division multiplex signal TD by serially scanning in combination with address decoder 5-36 which decodes address signals of 4 bits $AD_1$ to $AD_4$ transferred from tablet selection detector 5-4 into sixteen (16) output lines $D_1$ to $D_{16}$. A truth table of inputs and outputs of address decoder 5-36 is shown in Table 1.

Therefore, by converting the address signals $AD_1$ to $AD_4$ into timing signals, time division multiplex signal TD of $SEL_1$ to $SEL_{16}$ is generated at the output terminal of OR gate 5-35, as shown in FIG. 5-4 which is for the case when $SEL_1$, $SEL_9$ and $SEL_{10}$ are "1." A conventional decoder can be used as the address decoder 5-36 described above.

FIG. 5-5 shows an embodiment of a tablet selection detector 5-4 in FIG. 5-1 wherein time division multiplex signal TD from tablet assigner 5-2 representing the state of selected tablet switches is applied to a 16 bit shift register 5-40. This shift register is driven by clock signal $CT_1$ and generates output signals $D_1$ to $D_{16}$, representing the input signal TD each delayed by an additional time interval of the clock $CT_1$. Exclusive OR gate 5-51 checks whether a signal delayed by 16 clock intervals is equal to the input signal TD, and it sets flip-flop 5-43 when these two signals are not equal to each other.

Table 1.

| AD1 | AD2 | AD3 | AD4 | D1 | D2 | D3 | D4 | D5 | D6 | D7 | D8 | D9 | D10 | D11 | D12 | D13 | D14 | D15 | D16 |
|---|---|---|---|---|---|---|---|---|---|---|---|---|---|---|---|---|---|---|---|
| 0 | 0 | 0 | 0 | 1 | 0 | 0 | 0 | 0 | 0 | 0 | 0 | 0 | 0 | 0 | 0 | 0 | 0 | 0 | 0 |
| 1 | 0 | 0 | 0 | 0 | 1 | 0 | 0 | 0 | 0 | 0 | 0 | 0 | 0 | 0 | 0 | 0 | 0 | 0 | 0 |
| 0 | 1 | 0 | 0 | 0 | 0 | 1 | 0 | 0 | 0 | 0 | 0 | 0 | 0 | 0 | 0 | 0 | 0 | 0 | 0 |
| 1 | 1 | 0 | 0 | 0 | 0 | 0 | 1 | 0 | 0 | 0 | 0 | 0 | 0 | 0 | 0 | 0 | 0 | 0 | 0 |
| 0 | 0 | 1 | 0 | 0 | 0 | 0 | 0 | 1 | 0 | 0 | 0 | 0 | 0 | 0 | 0 | 0 | 0 | 0 | 0 |
| 1 | 0 | 1 | 0 | 0 | 0 | 0 | 0 | 0 | 1 | 0 | 0 | 0 | 0 | 0 | 0 | 0 | 0 | 0 | 0 |
| 0 | 1 | 1 | 0 | 0 | 0 | 0 | 0 | 0 | 0 | 1 | 0 | 0 | 0 | 0 | 0 | 0 | 0 | 0 | 0 |
| 1 | 1 | 1 | 0 | 0 | 0 | 0 | 0 | 0 | 0 | 0 | 1 | 0 | 0 | 0 | 0 | 0 | 0 | 0 | 0 |
| 0 | 0 | 0 | 1 | 0 | 0 | 0 | 0 | 0 | 0 | 0 | 0 | 1 | 0 | 0 | 0 | 0 | 0 | 0 | 0 |
| 1 | 0 | 0 | 1 | 0 | 0 | 0 | 0 | 0 | 0 | 0 | 0 | 0 | 1 | 0 | 0 | 0 | 0 | 0 | 0 |
| 0 | 1 | 0 | 1 | 0 | 0 | 0 | 0 | 0 | 0 | 0 | 0 | 0 | 0 | 1 | 0 | 0 | 0 | 0 | 0 |
| 1 | 1 | 0 | 1 | 0 | 0 | 0 | 0 | 0 | 0 | 0 | 0 | 0 | 0 | 0 | 1 | 0 | 0 | 0 | 0 |
| 0 | 0 | 1 | 1 | 0 | 0 | 0 | 0 | 0 | 0 | 0 | 0 | 0 | 0 | 0 | 0 | 1 | 0 | 0 | 0 |
| 1 | 0 | 1 | 1 | 0 | 0 | 0 | 0 | 0 | 0 | 0 | 0 | 0 | 0 | 0 | 0 | 0 | 1 | 0 | 0 |
| 0 | 1 | 1 | 1 | 0 | 0 | 0 | 0 | 0 | 0 | 0 | 0 | 0 | 0 | 0 | 0 | 0 | 0 | 1 | 0 |

Table 1.—continued

| AD1 | AD2 | AD3 | AD4 | D1 | D2 | D3 | D4 | D5 | D6 | D7 | D8 | D9 | D10 | D11 | D12 | D13 | D14 | D15 | D16 |
|---|---|---|---|---|---|---|---|---|---|---|---|---|---|---|---|---|---|---|---|
| 1 | 1 | 1 | 1 | 0 | 0 | 0 | 0 | 0 | 0 | 0 | 0 | 0 | 0 | 0 | 0 | 0 | 0 | 0 | 1 |

Figures 2, 3, 4, 5, 6:
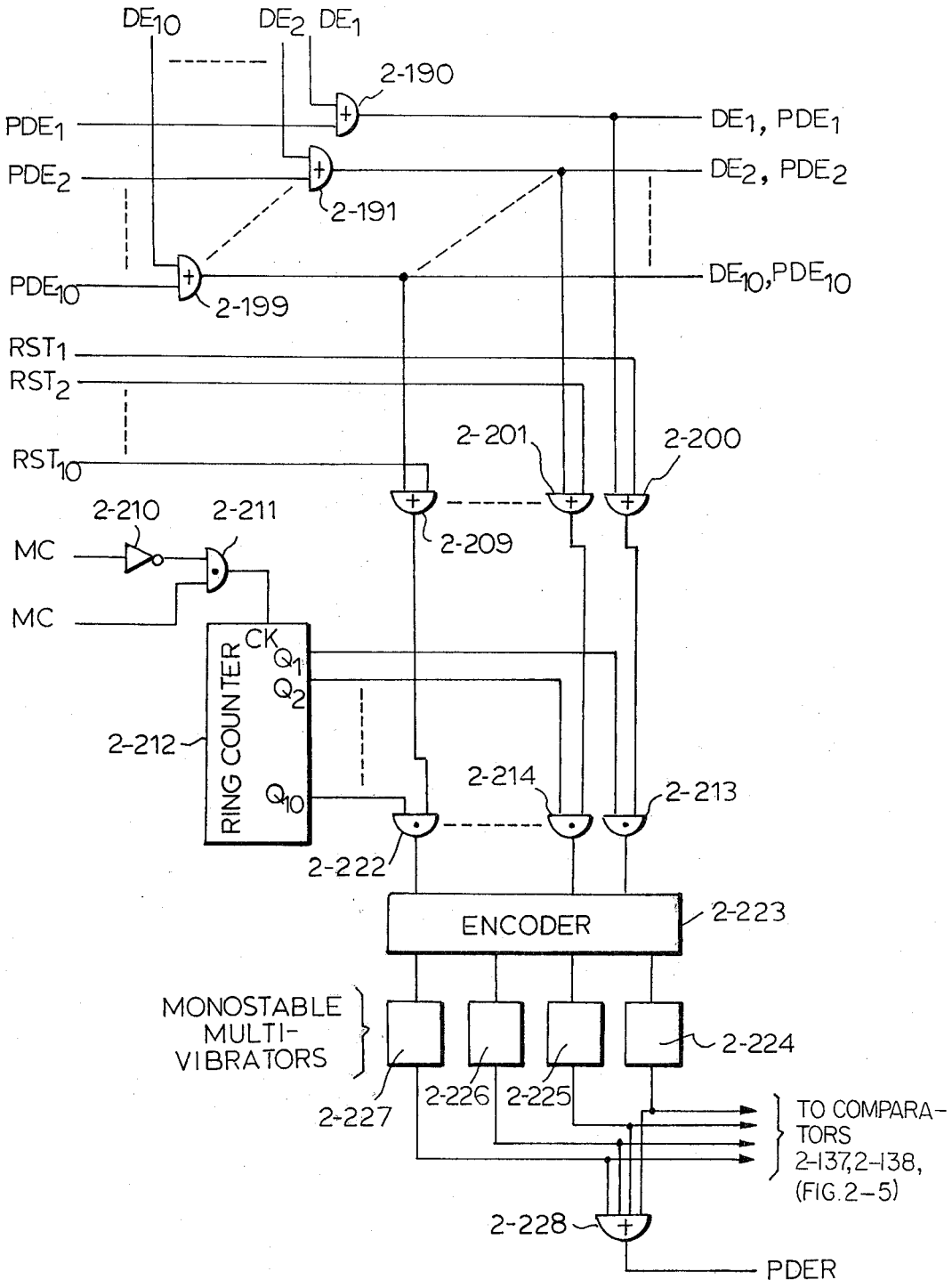

If any one of the tablet switches is different from the information about that tablet switch put into shift register 5-40, flip-flop 5-43 is set. When all the data on newly selected tablet switches is put into the shift register, AND gate 5-50 is opened and flip-flop 5-44 is set. Then, AND gates 5-54 and 5-55 are closed so as to inhibit clock signals $CT_1$ and $CT_2$ to shift register 5-40 and counter 5-42. Consequently, the circuit makes signal $SEN_1$ requiring the waveshape calculator 0-6 to calculate a new waveshape and then cease operation.

the 16 step counter 5-42 generates address signals $AD_1$ to $AD_4$ for deciding the address of the tablet. It is driven by a clock signal $CT_2$. Clock signals $CT_1$, $CT_2$ and $CT_3$ have the same repetitive frequency at a different phase, as shown in FIG. 5-6. When 16 step counter 5-42 reaches the output "0000," i.e. when all the data on the 16 tablet switches are put into shift register 5-40 and are checked, the contents of flip-flop 5-43 is transferred to flip-flop 5-44 by AND gates 5-52 and 5-50 synchronously with clock signal $CT_3$. Then, output $SEN_1$ of flip-flop 5-44 becomes "1," and waveshape calculator 0-6 is required to calculate a new waveshape.

At this time, since the data on the tablet switches stays in shift register 5-40, by assigning data addresses $TDAD_1$ to $TDAD_4$ to data selector 5-41, one of the tablet switch informations in the shift registers 5-40 is produced from the data selector 5-41 as tablet switch signal TDA. When all of the new tablet selection data is read by the waveshape calculator 0-6, 16 step counter 5-42 and flip-flop 5-43 are cleared by restart signal $RRST_1$ therefrom. Thereafter, flip-flop 5-44 is cleared by the next clock signal $CT_3$, and gates 5-54 and 5-55 are opened so as to operate the tablet selection detector 5-4 again, which continues check the state of tablet selection until the next change detected.

When none of the tablet is assigned, output signal TD of the tablet assigner 5-2 becomes "0," and 16 step counter 5-42, 16 bits shift register 5-40, and flip-flops circuits 5-43 and 5-44 stay cleared, and in this state the tablet selection detector 5-4 ceases operation.

Figures 2, 3, 4, 5, 6, 7:
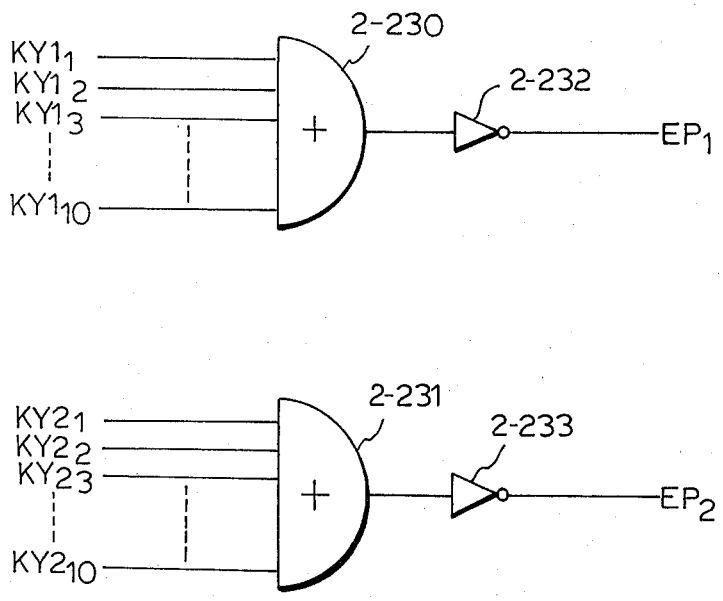

FIG. 5-7 shows an embodiment of draw-bar assigner 5-3. The figure is for the case of 9 steps for one draw-bar and 16 draw-bars for one line, wherein 16 draw-bars are used for assigning the amplitude of the first to the 15th harmonic and the 1/2 sub-octave signal and 9 steps of amplitudes can be assigned for each. Draw-bar address signals $DAD_1$ to $DAD_4$, 4-bits signals for selecting one of the draw-bars, are decoded to 16 draw-bar select signals $DDS_1$ to $DDS_{16}$ by a decoder 5-60. Therefore, by changing the draw-bar address signals in time order, the draw-bars are sequentially scanned and a time division multiplex signal of draw-bar contact information is generated. Contact information of a selected draw-bar in produced by signals $DBD_1$ to $DBD_9$ which show the contact position of each draw-bar when the draw-bars are scanned in time division multiplex. Encoder 5-61 converts the signals $DBD_1$ to $DBD_9$ into 4-bit codes $DD_1$ to $DD_4$. A truth table of input and output of encoder 5-6 is shown in Table 2. The circuit configuration of encoder 5-61 and decoder 5-60 are well known as conventional digital circuits, so a detailed description thereof is omitted.

Further, draw-bar selection detector 5-5 in FIG. 5-1 is the same as tablet selection detector 5-4 except that while the data to be watched is only the signal TS in the tablet selection detector 5-4, the data is the four signals $DD_1$ to $DD_4$ for the draw-bar selection detector 5-5.

THE WAVESHAPE COUNTER: TONE CONTROLLER

A calculator 0-6 calculates a tone color waveshape for the selected tablet or draw-bar and puts it into a memory means (a shift register in this embodiment) in tone generator 0-7. A flow chart of its operation is shown in FIG. 6-1. When there is no requirement for waveshape calculation for tablet or draw-bar, the waveshape calculator 0-6 repeats its judging operations 6-1 and 6-2. When a new requirement for waveshape calculation for tablets is received, the waveshape calculator 0-6 goes to an operation 6-3, after judging operation 6-1, in which the waveshape of the newly selected tablet is calculated for certain sample points of the waveshape. At the end of the calculation the whole set of sample points, the next operation 6-5 puts the calculated and synthesized waveshape information into shift register 7-12 in tone generator 0-7.

Table 2.

| DBD1 | DBD2 | DBD3 | DBD4 | DBD5 | DBD6 | DBD7 | DBD8 | DBD9 | DD1 | DD2 | DD3 | DD4 |
|---|---|---|---|---|---|---|---|---|---|---|---|---|
| 1 | 0 | 0 | 0 | 0 | 0 | 0 | 0 | 0 | 0 | 0 | 0 | 0 |
| 0 | 1 | 0 | 0 | 0 | 0 | 0 | 0 | 0 | 1 | 0 | 0 | 0 |
| 0 | 0 | 1 | 0 | 0 | 0 | 0 | 0 | 0 | 1 | 0 | 0 | 1 |
| 0 | 0 | 0 | 1 | 0 | 0 | 0 | 0 | 0 | 1 | 0 | 1 | 0 |
| 0 | 0 | 0 | 0 | 1 | 0 | 0 | 0 | 0 | 1 | 0 | 1 | 1 |
| 0 | 0 | 0 | 0 | 0 | 1 | 0 | 0 | 0 | 1 | 1 | 0 | 0 |
| 0 | 0 | 0 | 0 | 0 | 0 | 1 | 0 | 0 | 1 | 1 | 0 | 1 |
| 0 | 0 | 0 | 0 | 0 | 0 | 0 | 1 | 0 | 1 | 1 | 1 | 0 |
| 0 | 0 | 0 | 0 | 0 | 0 | 0 | 0 | 1 | 1 | 1 | 1 | 1 |

After that, when waveshape calculation of a tablet is newly required, the above operations are repeated. When waveshape calculation of a draw-bar is required, the operations of 6-2, 6-4 and 6-5 are carried out in turn quiet similarly. After that, when waveshape calculation of a draw-bar is newly required, the above operations are repeated.

In this embodiment, the waveshape calculator 0-6 divides one period of tone waveshape of (16 feet) rank into 128 sample points and calculates the amplitude at each point. For (8 feet) rank tone waveshape, it calculates the points for two periods, and therefore the sample number for one period is N = 64. This is because a waveshape of mixed tone of 16 feet and 8 feet ranks is frequently required. When a tone of any rank is selected, tone generator 0-7 stores the waveshape which is read out by a clock frequency corresponding to the selected keyboard.

FIG. 6-2 shows sine waves of 16 feet and 8 feet and a waveshape synthesized using these two waves which could be stored in shift register 7-12 of tone generator 0-7.

FIG. 6-3 is a block diagram of an embodiment of a waveshape calculator 0-6, in which a central processing unit (CPU) 6-10 generates various timing pulses necessary for performing the operations of FIG. 6-1 in accordance with a program stored in memory 6-11. Memory 6-11 stores the programs necessary for the operations of FIG. 6-1 to be performed by CPU 6-10, waveshape information of each tablet and sine wave data necessary for waveshape synthesizing of the of draw-bars. These programs and waveshape data are formed with 8-bit units, and FIG. 6-4 shows a memory map of them. In FIG. 6-4, program data, sine wave data, and waveshape data for 16 tablets are stored, respectively, at address 0 to 1023 in 1024 bits, address 1024 to 1151 in 128 bits, and address 1152 to 3199 in 2048 bits with 128 bits for each tablet. Address 3200 to 3711 (512 bits) is buffer memory 6-15 for storing the data of tablet or draw-bar and the calculated waveshape synthesization.

The input and output control circuit 6-12 controls a tone selection detector 0-5, and provides an output to CPU 6-10 upon receiving tablet waveshape calculating signal $SEN_1$ and draw-bar waveshape calculating signal $SEN_2$. It also transfers address signals $TDAD_1$ to $TDAD_4$ of the tablet or the draw-bar to the tone selection detector 0-5 according to instructions of the CPU 6-10, and provides the tablet switch information TDA or draw-bar switch information DDA to CPU 6-10.

Write control circuit 6-13 puts in the calculated results into shift register 7-12 of tone generator 0-7. This is also controlled by CPU 6-10 and generates out write requiring signal R/W, write clock signal WC and write data signal WDA to tone generator 0-7.

FIG. 6-5 shows the flow chart of the calculating operation of the waveshape of a tablet. The waveshape calculator 0-6 performs the operations of FIG. 6-5 after receiving an input of tablet waveshape calculating signal $SEN_1$. That is, at first, tablet address signal TDAD is applied to tablet selection detector 5-4 so as to read the information of the tablet switch corresponding to that address, and the information of all tablet switches is read out by changing TDAD from 1 to 16 in turn and stored in the buffer memory 6-15. Then, according to this information, a new calculation of the waveshape is performed.

First, sample point address register S and tablet address register TB are set to "1" and accumulator ACC is cleared. Next, it is determined whether the tablet assigned address number 1 by TB register is ON or not. When it is ON, the amplitude of sample point address 1 designated by the sample point address register S in the tablet of address number 1 is taken out from the memory and added to the accumulator ACC. When it is not ON, waveshape of the tablet of address number 1 is not added to the accumulator, and the operation of the next step is performed.

Next, tablet address register TB is set to 2 by adding 1 thereto, and the similar operation is repeated for tablet of address number 2. In this embodiment using 16 tablets, the operation is then repeated until the tablet address becomes 16. Therefore, when only the tablets of address 1 and 3 are ON and the other tablet are OFF, ACC contains the sum of the amplitude of tablet waveshape of address number 1 at sample point 1 and an amplitude of tablet waveshape of addresss number 3 at sample point 1. This data is entered into the buffer memory 6-15, and TB is set to 1 and ACC is cleared. Then, S is set to 2 by adding 1 thereto, and similar to the above described tablets which are ON (in this example, tablets of address number 1 and 3 are ON) are detected from among the tablets of address numbers 1 to 16, and the amplitudes thereof are sumoned. Thus, the amplitude of sample point address 2 is calculated. In the same manner, by repeating similar calculations up to the sample point address N = 128, the calculated waveshape of the tablets of address numbers 1 and 3 for all the sample points is put into the buffer memory 6-15.

FIG. 6-6 shows a flow chart of the operation for transferring the waveshape stored in buffer memory 6-15 to shift register 7-12 in tone generator 0-7. When putting a new waveshape into shift register 7-12, first the sample point address register S is set to 1, and then write requiring signal R/W is set to "1". When write requiring signal R/W is "1," the shift register 7-12 of tone generator 0-7 changes the inputs for receiving clock signals and data signal so as to receive the data to be entered, whether or not tone generator 0-7 is selected to provide a tone waveshape. Then, amplitude of the calculated waveshape of a sample point designated by the sample point register S is put into a write-in register WDA, and data to be entered is transferred to shift register 7-12. Simultaneously, write clock WC is transferred to shift register 7-12 so as to enter the above data therein. Next, the sample point address is advanced by 1 by adding 1 to the content of sample point address register S, and the above operation is repeated. This process is repeated until the sample point address becomes N = 128. After all the data has been entered, write requiring signal R/W is set to "0" so as to return tone generator 0-7 to a normal state and to resume the judging operation 6-1. FIG. 6-7 is a timing chart of the above operation.

Figures 2, 3, 4, 5, 6, 7, 8:
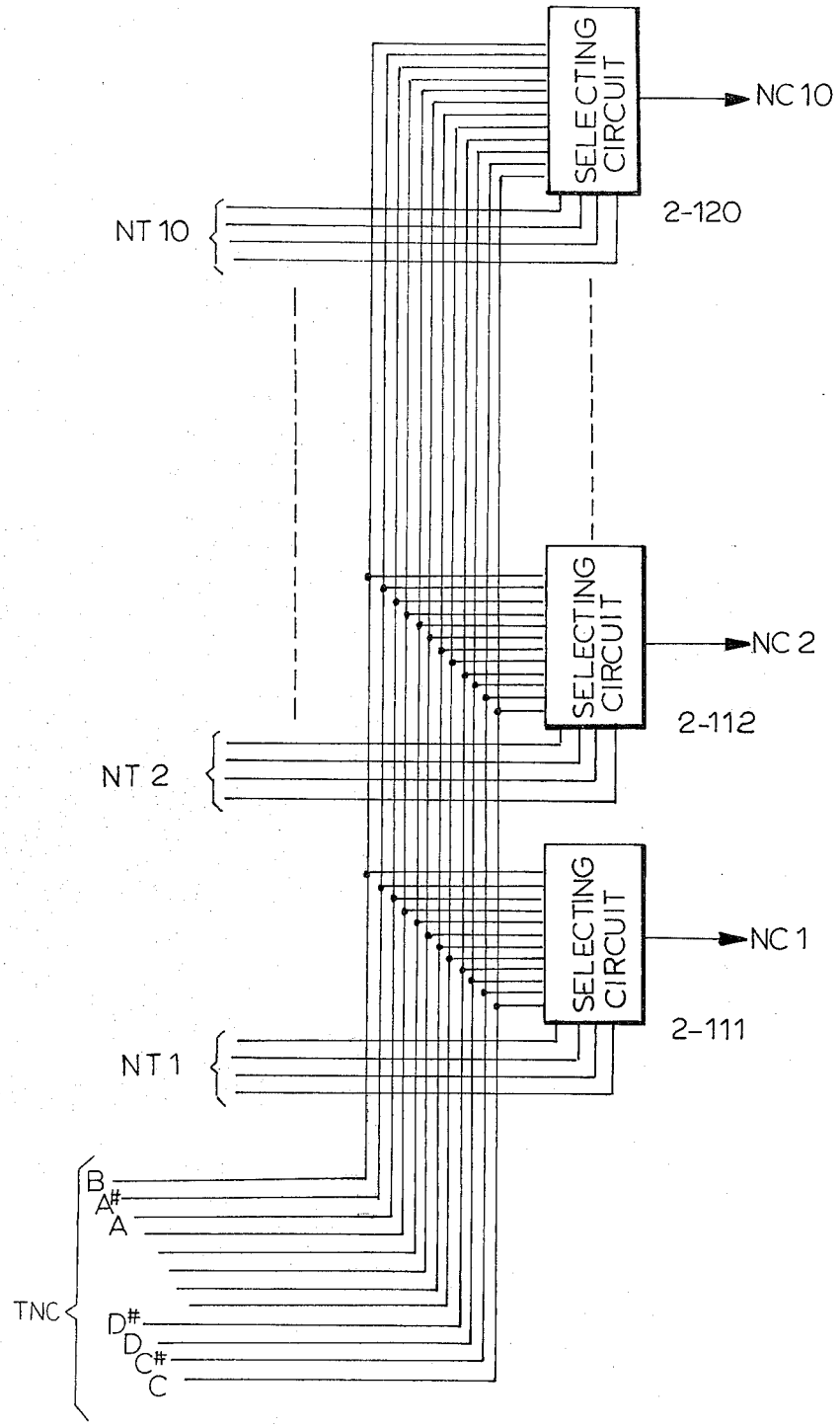

FIG. 6-8 shows a flow chart of the operation of calculating a draw-bar waveshape. In this case, only sine wave data is required. Since only sine a wave of 16 feet rank is stored in memory 6-11, in order to form a sine wave of 8 feet rank, the reading is repeated two times skipping every other address. That is, for a waveshape of 16 feet, by advancing the sample point address register S from N = 1 to N = 128 by 1 point, a waveshape of one period with N = 128 sample points, i.e. a sine wave of 16 feet, is read out. Then, by reading out the sample point addresss register from 2 by every two points, i.e. 4, 6, 8, 10, . . . , a waveshape of one period is read out with N = 64 sample points. By repeating this reading operation two times, a sine wave of two periods, i.e. sine wave of 8 feet, is read out with N = 128 sample points.

In the following fashion, by reading the sample point address register with similar skipping, sine waves of 4 feet, 8 feet, 3 feet, 2 feet, 8/5 feet, 8/15 feet, etc. are read out. Table 3 shows the relation between the advancing number (K) of the sample point address register and the feet number of the draw-bar for the draw-bar address number in this embodiment.

Table 3.

| draw-bar address i | feet No. of draw-bar | Ki | draw-bar address i | feet No. of draw-bar | Ki |
|---|---|---|---|---|---|
| 1 | 16 | 1 | 9 | 1 | 16 |
| 2 | 8 | 2 | 10 | 8/9 | 18 |
| 3 | 4 | 4 | 11 | 8/10 | 20 |
| 4 | 8/3 | 6 | 12 | 8/11 | 22 |
| 5 | 2 | 8 | 13 | 8/12 | 24 |
| 6 | 10 | 14 | 8/13 | 26 | |
| 7 | 8/6 | 12 | is | 8/14 | 28 |

Table 3.—continued

| draw-bar address i | feet No. of draw-bar | Ki | draw-bar address i | feet No. of draw-bar | Ki |
|---|---|---|---|---|---|
| 8 | 8/7 | 14 | 16 | 8/15 | 30 |

The draw-bar is usually arranged in several steps of amplitude levels so that the level of the sine wave with the feet number designated thereto by that step can be changed. In this embodiment, the changeable level for each draw-bar is set to 8 steps designated by numbers 0 to 9. Table 4 shows the step of a draw-bar, the level of the sine wave designated by the draw-bar and a coefficient $a_i$ to be multiplied to the amplitude so as to get that level.

Table 4.

| step of a draw-bar | level of sine wave (dB) | coefficient $a_i$ |
|---|---|---|
| 0 | $-\infty$ | 0 |
| 1 | − 21 | 0.089 |
| 2 | − 18 | 0.1259 |
| 3 | − 15 | 0.1778 |
| 4 | − 12 | 0.2512 |
| 5 | − 9 | 0.3548 |
| 6 | − 6 | 0.5012 |
| 7 | − 3 | 0.7079 |
| 8 | 0 | 1.0 |

Draw-bar waveshape calculation is performed when the signal $SEN_2$ is generated by the draw-bar selection detector 5-5. Like to the case of tablet waveshape calculation, TDAD is provided at first, the draw-bar information is read out and stored, and then the waveshape is calculated according to that information. In the case of draw-bar waveshape calculation, it is a little different in that by repeating alternately sample point address calculating and waveshape calculation, the amplitude of the calculated waveshape is obtained for all the sample points. In the following, the calculating procedure is described referring to FIG. 6-8.

At first, a number Kj for advancing each time is put into sample point address register Sj (j = 1, 2, . . . , 16) to determine the sample point address of each feet rank. Then draw-bar address register i is set to 1, and accumulator ACC is cleared. Next, the sine wave amplitude at sample point $S_1$ is read out of memory 6-11 and multiplied by the coefficient $a_{11}$ corresponding to the step of the draw-bar of address 1 and the result is added to the accumulator ACC. Then, draw-bar address register i is set to $i = 2$ by adding 1 thereto, and the sine wave amplitude at sample Point $S_2$ read out of memory 6-11 is multiplied by the coefficient $a_2$ corresponding to the step of the draw-bar of address 2 and the result is added to ACC. Similar calculation is performed for all 16 draw-bars, and the result is put into the buffer memory as a calculation result of the sample point address $S_1$, i.e. the sample point address 1. The result is in the $S_1$ sample point address because it is in a form based on 16 feet rank.

Then, sample point address $S_l$ ($l = 1, 2, \ldots, 16$) for reading out waveshape of each feet is calculated according to the sub-routine shown in FIG. 6-9, in which $K_l$ is added to the content $S_l$ ($l = 1, 2, \ldots, 16$) of the sample point address register, and for the added values beyond N = 128, there is provided a new sample point address by subtracting 128 therefrom. This is because the of sine wave is stored for one period with N = 128 sample points, the amplitude of a sine wave at a sample point beyond 128 points is the same as that provided by reading repeatedly from the first group of sample points.

FIG. 6-10 shows this relation, wherein it is understood that in sample point addresses 129 to 256, the sine wave of sample point addresses 1 to 128 repeats. Therefore, the amplitude of a sine wave at a sample point address beyond N = 128 is obtained by subtracting 128 from that address and converting into that of sample point address from N = 1 to N = 128. After obtaining the new sample point address for each feet, the above waveshape calculation is repeated so as to get the amplitude of the calculated waveshape of the next sample point address. By repeating alternately sample point address calculation and waveshape calculation as above, the amplitude of the calculated waveshape is provided for all the sample points. After waveshape calculation, like to the case of tablet waveshape calculation, the newly synthesized waveshape is then entered into shift register 7-12 of tone generator 0-7.

By performing the above operation, the waveshape calculator 0-6 synthesizes a tone which the operator desires and enters it into tone generator 0-7. As the waveshape calculating operations described above contain many judgements of conditions and separated operations, it is more convenient to perform them using a device with a program run structure rather than a wired logic structure. In this embodiment, a micro computer 8080 of Intel Co. is used for central processing unit 6-10 in waveshape calculator 0-6, but of course it is possible to use other structures, and it can be realized by a hard wired logic design or by another digital computer.

TONE GENERATOR

Tone generator 0-7 has a memory means (shift register 7-12) for storing the calculated and synthesized waveshape from the waveshape calculator 0-6, and by shifting rotating the shift register cyclicly by a selected clock it generates a tone waveshape in digital form. FIG. 7-1 shows a circuit configuration for one channel of tone generator 0-7, wherein note clock signal NC of the selected keyswitch is adjusted to a frequency for generating the highest (e.g. $C_6$ for C tone) octave note tone signal, and is divided in turn by divide by 2 counters 7-1 so as to generate note clock signals coresponding to the notes for each octave ($C_1$ to $C_5$ for C tone).

The signal clock corresponding to a note of each octave provided as above is put to data selector 7-10, which generating output clock signal QC for the octave selected by the keyboard. The selection of the octave is controlled by octave data signals $OC_1$ to $OC_3$ supplied by generator assignor 0-2. FIG. 7-2 shows an embodiment of the data selector 7-10, and Table 5 is a truth table thereof.

Table 5.

| $OC_1$ | $OC_2$ | $OC_3$ | O |
|---|---|---|---|
| 0 | 0 | 0 | $D_1$ |
| 1 | 0 | 0 | $D_2$ |
| 0 | 1 | 0 | $D_3$ |
| 1 | 1 | 0 | $D_4$ |
| 0 | 0 | 1 | $D_5$ |
| 1 | 0 | 1 | $D_6$ |

Clock signal QC selected by the data selector 7-10 is divided by 3 by divide by 3 counter 7-2, and then further divided by 2 by divide by 2 counter 7-3 to generate clock signal LC. Therefore, QC and LC have the following relationship:

$$LC = QC/6 \quad (1)$$

Clock signal LC is provided to the clock terminal of flip-flop 7-4, which is for synchronizing channel selection signal ChS from the generator assigner 0-2 with the clock signal LC. This is set by the next clock signal LC pulse when ChS becomes "1," and therefore output Q becomes "0", so that NAND gate 7-21 is opened and clock signal LC generates clock signal CLK. Clock signal CLK is supplied to modulo-128 counter 7-11 and NAND gate 7-24. Since the signal R/W from the waveshape calculator 0-6 is usually "0," NAND gate 7-24 is opened, and so clock signal CLK is applied to shift register 7-12 through NAND gates 7-24 and 7-25 and rotates it cyclicly.

FIG. 7-3 shows an embodiment of modulo-128 counter 7-11, in which clock signal CLK is applied to clock terminal C of the first stage of the counter consisting of seven stages of flip-flops connected in cascade. When all of the flip-flop circuits are "0", signal "1" is generated at OU output through AND gate 7-31. Therefore, a signal "1" appears each time when 128 clock pulses are received. This signal shows the state of the shift register and is used for detecting the first part of waveshape memorized in shift register 7-12.

FIG. 7-4 shows an embodiment of 12 × 128 bit shift register 7-12, in which the amplitude of one sample point of the waveshape to be put into the shift register is formed with 12 bits. Since write requiring signal R/W from write control circuit 6-13 is usually "0," AND gate 7-40 is usually closed and AND gate 7-41 is usually opened. Therefore, the output of shift register 7-43 is returned back to the input terminal thereof through AND gate 7-41 and OR gate 7-42, and so in shift register 7-43 the data is usually rotated by clock signal CK and it is provided out in turn as the 12 signals $OD_1$ to $OD_{12}$ in parallel in synchronized with clock signal CK.

On the other hand, again referring to FIG. 7-1, clock signal QC from the data selector 7-10 is applied to four stages of divide by 2 counters 7-5 and divided by 16 to generate clock signal AFC. Therefore, QC and AFC have the following relation:

$$AFC = QC/16 \quad (2)$$

The amplitude of a waveshape of 8 feet from shift register 7-43 is represented by 64 sample points, clock signal LC from divide by 2 counter 7-3 is expressed by the following equation:

$$LC = 64 \times H \quad (3)$$

where H is the frequency of the waveshape of 18. From the equations (2) and (3), QC is expressed as follows:

$$QC = 384 \times H \quad (4)$$

Clock signal AFC from four stages of divide by 2 counter 7-5 is divided by 3 by divide by 3 counter 7-6 and further divided by 8 by three states of divide by 2 counters 7-2 to produce output F. Therefore, F can be expressed as follows:

$$F = AFC/(3 \times 8) \quad (5)$$

From the equations (5) and (2), F can be expressed as follows:

$$F = QC/384 \quad (6)$$

From the equations (4) and (6), F is expressed as follows:

$$F = H \quad (7)$$

That is, $F$ is a rectangular wave having the same frequency as that of tone waveshape of 8 feet. Similarly, the following equations are provided:

| | | | |
|---|---|---|---|
| 0.5 F | = | 0.5 H | (8) |
| 1.5 F | = | 1.5 H | (9) |
| 2 F | = | 2H | (10) |
| 3 F | = | 3 H | (11) |
| 4 F | = | 4 H | (12) |
| 6 F | = | 6 H | (13) |

Each of these outputs are rectangular waves of 16 feet, 5⅓feet, 4 feet, 2⅔feet, 2 feet and 1⅓feet, and they are used for generating percussive tone enhancing an attack or preset tone (piano tone). Also, they can be used for tone generation the of formant system with use of a conventional tone filter of the analog type. Clock signal QC from the data selector 7-10 becomes equal to note clock signal NC when the highest octave is selected, and so note clock signal NC is expressed as follows:

$$NC = 384\ H\ (max) \quad (14)$$

in which H (max) means frequency of 8 feet of the highest octave for each note. Therefore, note clock signal NC for an organ having 61 keys ($C_1$ to $C_6$) has frequencies as shown in Table 6.

Output signal ACR from AND gate 7-22 is used to match the phases of reactangular waveshape output 0.5F, F, 1.5F, 2F, 3F, 4F and 6F for each feet with the tone waveshape of the shift register 7-12, and it becomes "0" when R/W becoms "1" or "0" STP becomes 0 to clear all of flip-flops circuits 7-7 generating the rectangular waves. That is, they are cleared whenever shift register 7-12 stops or when a new waveshape is entered into the shift register 7-12. Thus, the phase of the rectangular waves 0.5F, F, 1.5F, 2F, 3F, 4F and 6F always coincides with the phase of the waveshape in shift register 7-12.

Table 6.

| note | H (max) [HZ] | NC [KHZ] |
|---|---|---|
| C | 2093 | 803.7 |
| C # | 2217 | 851.8 |
| D | 2349 | 902.0 |
| D # | 2489 | 955.8 |
| E | 2637 | 1013.0 |
| F | 2794 | 1073.0 |
| F # | 2960 | 1137.0 |
| G | 3136 | 1204.0 |
| G # | 3322 | 1276.0 |
| A | 3520 | 1352.0 |
| A # | 3729 | 1432.0 |
| B | 3951 | 1517.0 |

FIG. 7-5 shows corresponding waveshapes when channel selecting signal ChS is generated by generator assigner 0-2, and FIG. 7-6 shows comparable waveshapes, when shift register 7-12 contains the waveshape of Flute 16 feet and the signal ChS is "1". When the key is released, shift register 7-12 ceases stops operation after the waveshape becomes the same phase as the initial phase, and waits for the next channel selecting signal. This operation is as follows.

Release of the key starts the decay mode. After the decay mode is completed, the channel is released and channel selecting signal ChS becomes "0". At this time, flip-flop 7-4 is reset and its Q output becomes "1". On the other hand, the output of NAND gate 7-20 continues as "1" until the OU output of modulo-128 counter 7-11 becomes "1", i.e. the waveshape in shift register 7-12 returns to its initial position. Therefore NAND gate 7-21 is still open, and clock signal CL is supplied to modulo 12800 counter 7-11 and shift register 7-12. When the waveshape in shift register 7-12, returns to its initial position, the OU output of modulo-128 counter 7-11 synchronized with shift register 7-12 becomes "1". Then, the output of NAND gate 7-20 becomes "0" so as to close NAND gate 7-21 which inhibits the clock signal to modulo-128 counter 7-11 and shift register 7-12. Consequently, when modulo-128 counter 7-11 generates an OU output of "1," i.e. when all the flip-flops therein are in the "0" state, shift register 7-12 ceases generation of the waveshape after the stored waveshape returns to its initial position. At this time, stop signal STP becomes "0" showing that shift register 7-12 has stopped. The signal ACR becomes"0" for clearing the state of dividers 7-6 and 7-7 which generate square waves, and the outputs 0.5F, F, 1.5F, 2F, 3F, 4F and 6F are also stopped.

FIG. 8 shows several waveshapes during the period from the "1" to "0" transition of signal ChS until the "1" to "0" transition of signal STP and the stop of the shift register 7-12. Thus, when the channel selecting signal ChS becomes "0" shift register 7-12 always stops with the stored waveshape in its initial position. Therefore, when the signal ChS becomes "1" at the selection of a channel, all the tones related to the same note by octaves can be generated in phase coincidence by synchronization with timing determined by the tone.

The following describe the operation of writing a waveshape into shift register 7-12. When the waveshape calculator 0-6 enters a new waveshape into the shift register, first the write requiring signal R/W becomes "1". Then, NAND gate 7-24 is closed so as to inhibit clock signal CLK applied to shift register 7-12 when a channel is selected. Next, modulo-128 counter 7-11 and dividers 7-2, 7-3 and 7-5 are cleared. Also, the signal ACR becomes "0", flip-flops 7-6 and 7-7 which generate square waves, are cleared. On the other hand, NAND gate 7-23 opens and write clock signal WC is applied to the shift register 7-12. Further, AND gate 7-41 in FIG. 7-4 closes and shift register 7-43 (a part of shift register 7-12) ceases rotation. At this time, AND gate 7-40 opens, and the 12-bit parallel data $WD_1$ to $WD_{12}$ of the new waveshape generated by the waveshape calculator 0-6 are quickly entered into shift register 7-43. (a part of shift register 7-12) at address 1 to 128 in turn by parallel clock WC.

After entering the waveshape, writing requiring signal R/W returns to "0" so as to release all of the above clear signals, and to open NAND gate 7-24 and close 7-23. Then, the signal on the clock input of shift register 7-12 (7-43) is changed to clock signal CLK. In FIG. 7-4, AND AND gate 7-40 closes and 7-41 opens, and the data in shift register 7-43 (7-12) is rotated by clock signal CLK. Also, the modulo-128 counter 7-11 is again operated by clock signal CLK. Since modulo-128 counter 7-11 is reset by the writing requiring signal R/W during the writing period, the signal OU also becomes "1" synchronously the first portion of the wavewhape in shift register 7-12 when it operates again. Similarly, dividers 7-6 and 7-7 which generate square waves are reset by write requiring signal R/W, they generate square waves in phase coincidence with the phase of the waveshape in shift register 7-12. When the channel is not selected, there is no clock signal CLK and STP signal is "0," so that the shift register 7-12 ceases generation of the first portion of waveshape, and modulo-128 counter 7-11 ceases to generate OU signals. Since the signal ACR is still "0," a square wave is not generated.

THE ENVELOPE GENERATOR

Envelope generator 0-9 controls the envelope such as attack and sustain of the tone signal. In an electronic musical instrument, the envelope of the tone such as the rising or falling of the tone is important as well as the ratio of harmonics (i.e. waveshape of tone). There are two methods for generating envelopes in electronic musical instruments using digital techniques. One is a digitally coded process of a digital tone signal to provide an envelope, and the other is analog process after converting the digital signal into an analog form. The digital envelope control process has the advantages of voluntary envelope production and ease of control, but because of rough quantization of the tone signal at small amplitudes such as the start of the attack or the end of the sustain, it is difficult to produce a tone waveshape with high fidelity. Also, since digital envelope control is performed essentially stepwise, there is no smoothness of attach or sustain. Analog envelope control does not cause any change of tone waveshape owing to stepwise change of amplitude of the tone signal and provides a smooth attack or sustain since the envelope can be controlled continuously.

Figures 2, 3, 4, 5, 6, 7, 8, 9:
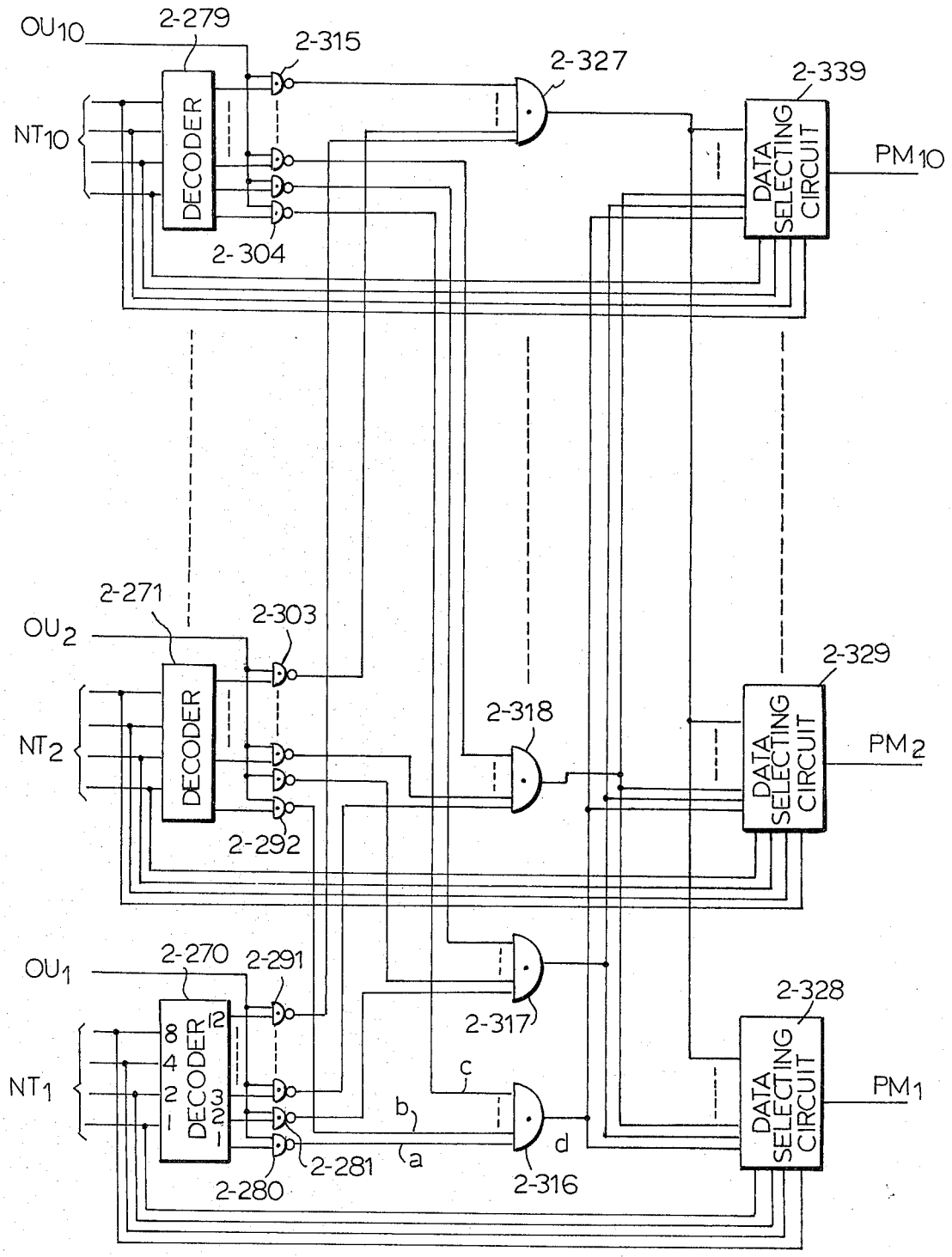
Figures 2, 3, 4, 5, 6, 7, 8, 9, 10:
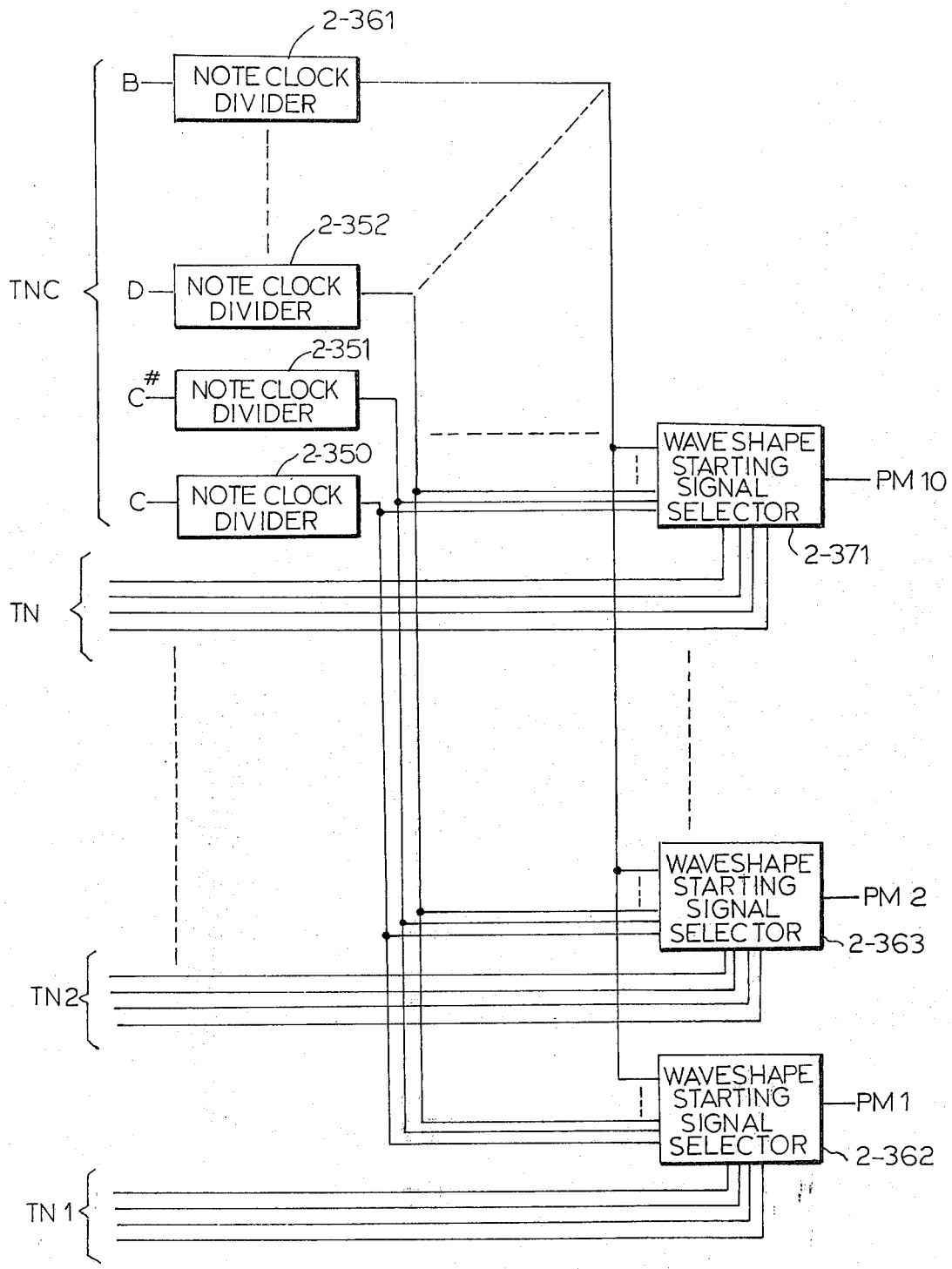
Figures 2, 3, 4, 5, 6, 7, 8, 9, 10, 11:
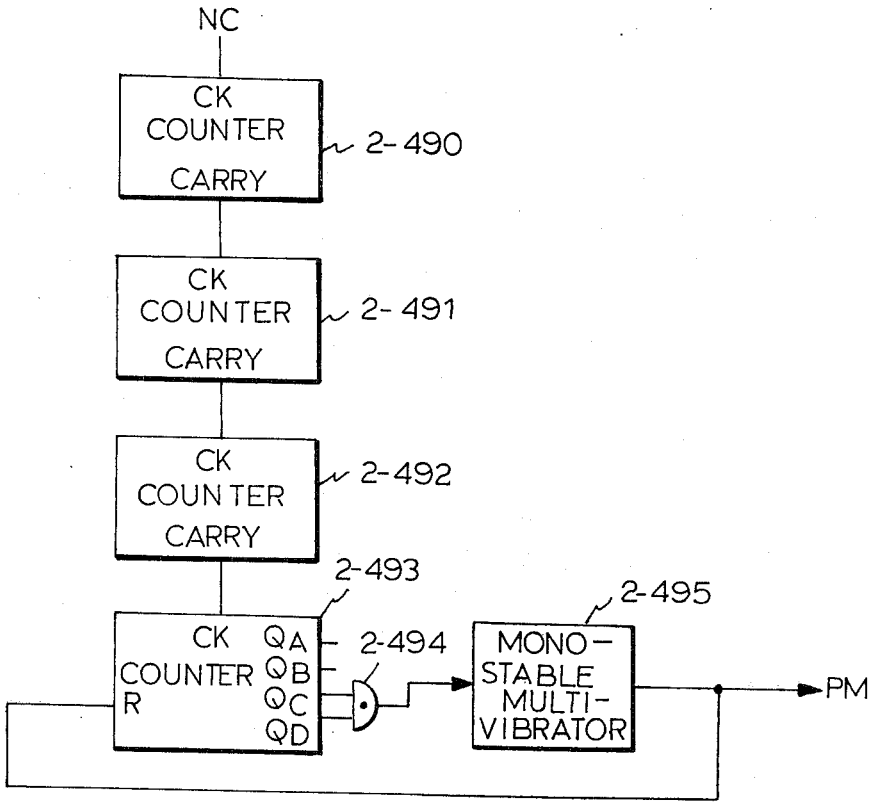
Figures 2, 3, 4, 5, 6, 7, 8, 9, 10, 11, 12:
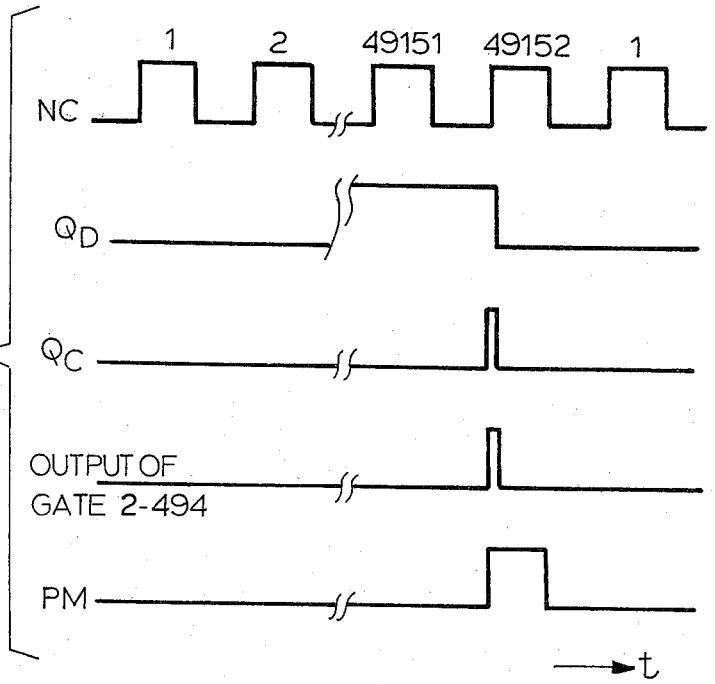
Figures 2, 3, 4, 5, 6, 7, 8, 9, 10, 11, 12, 13:
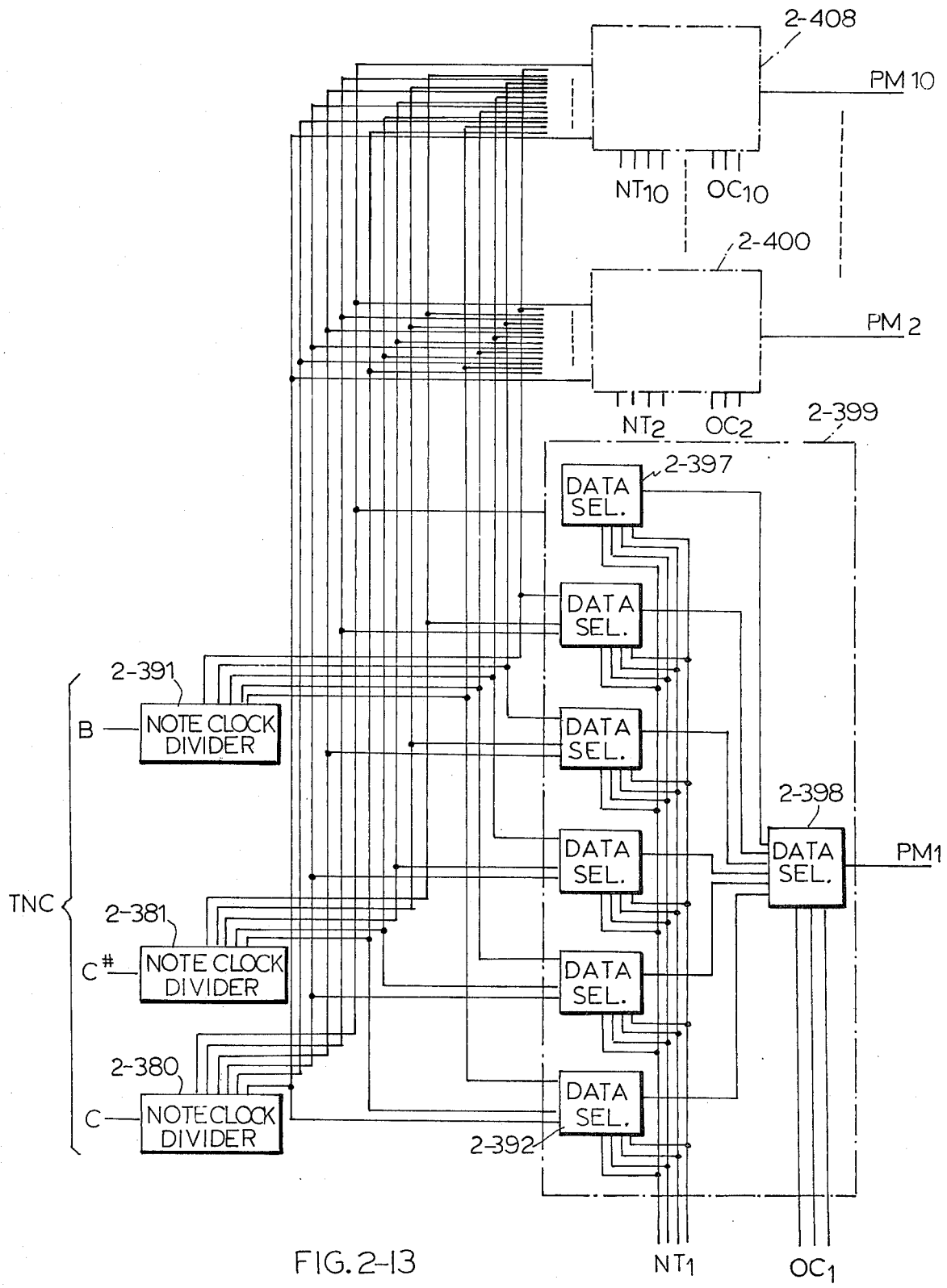
Figures 2, 3, 4, 5, 6, 7, 8, 9, 10, 11, 12, 13, 14:
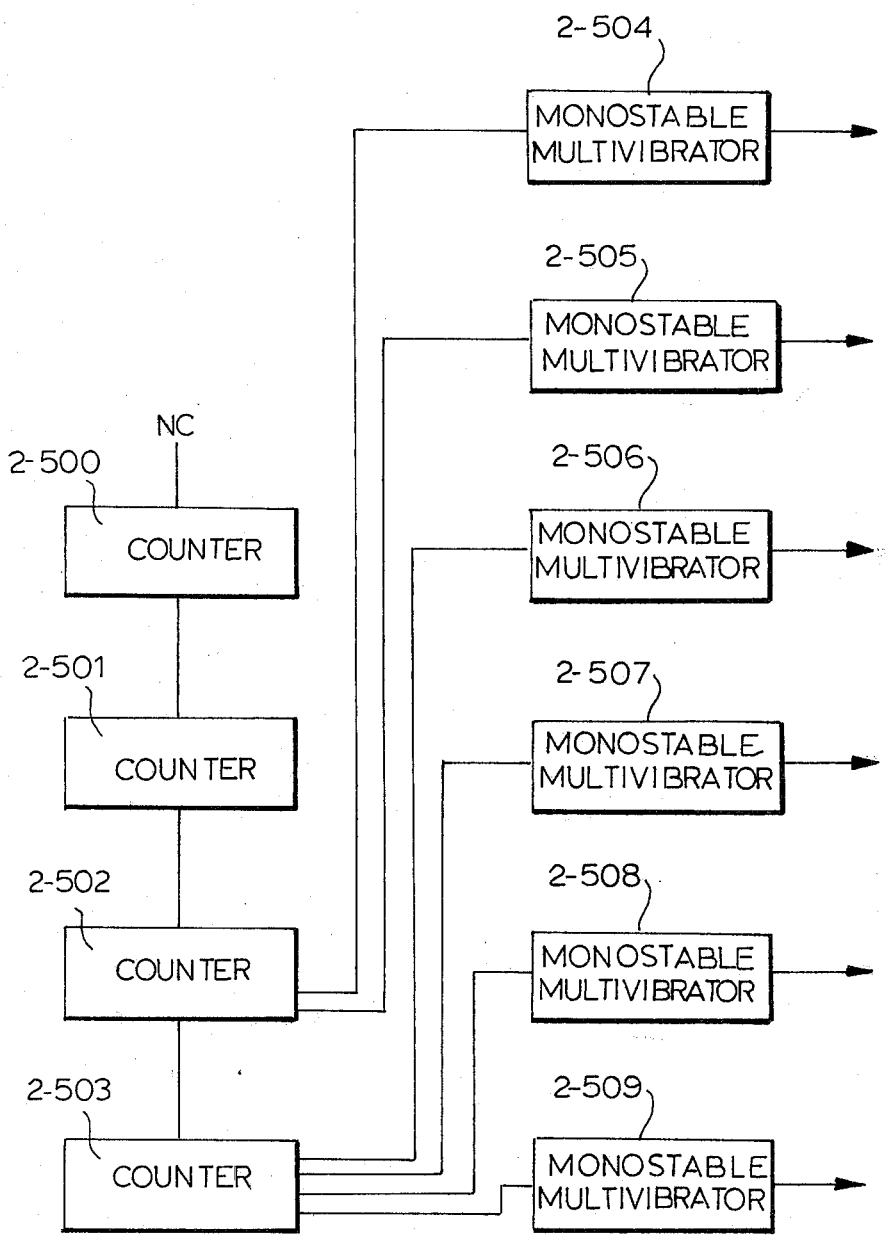
Figures 2, 3, 4, 5, 6, 7, 8, 9, 10, 11, 12, 13, 14, 15:
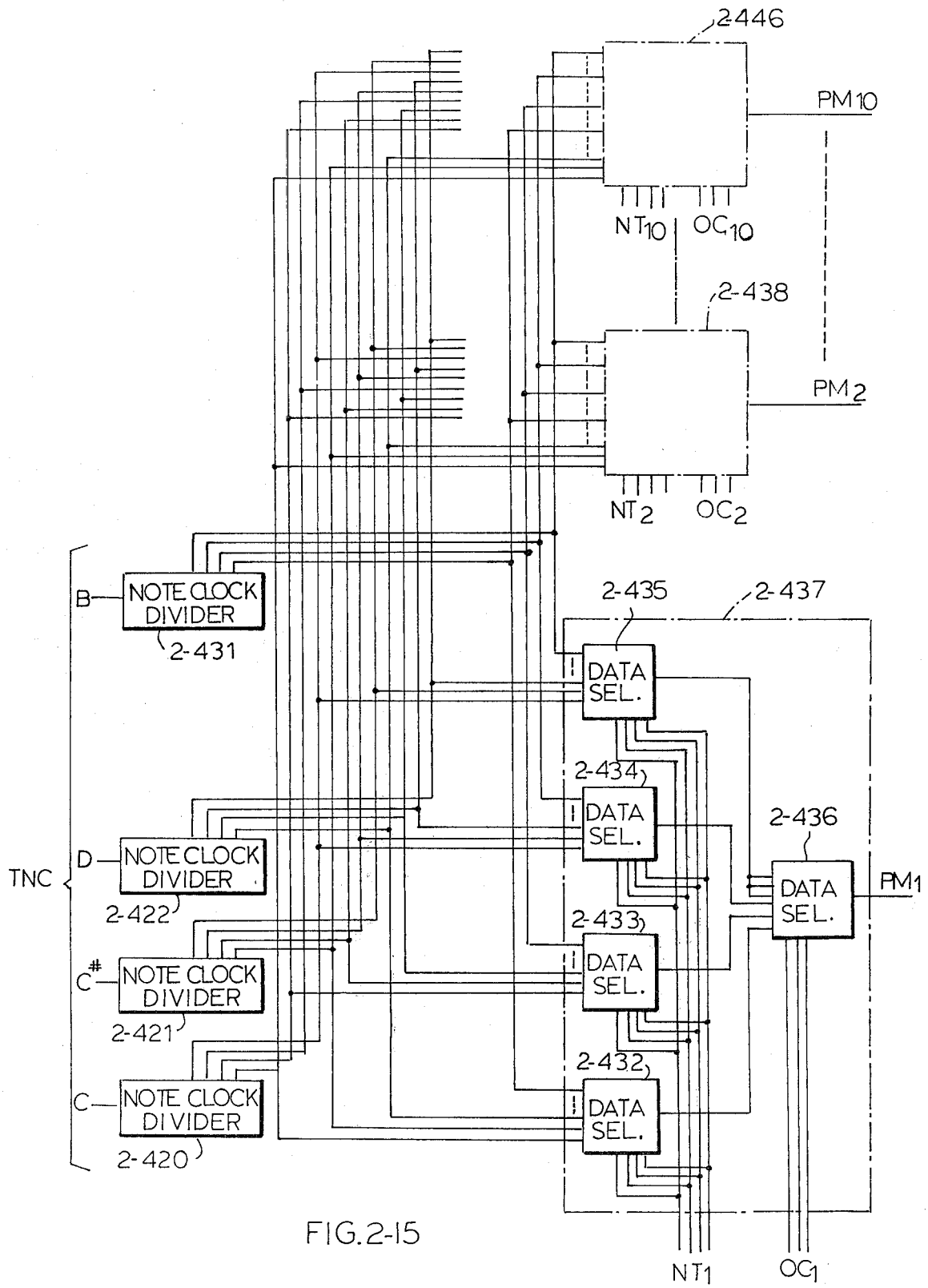
Figures 2, 3, 4, 5, 6, 7, 8, 9, 10, 11, 12, 13, 14, 15, 16:
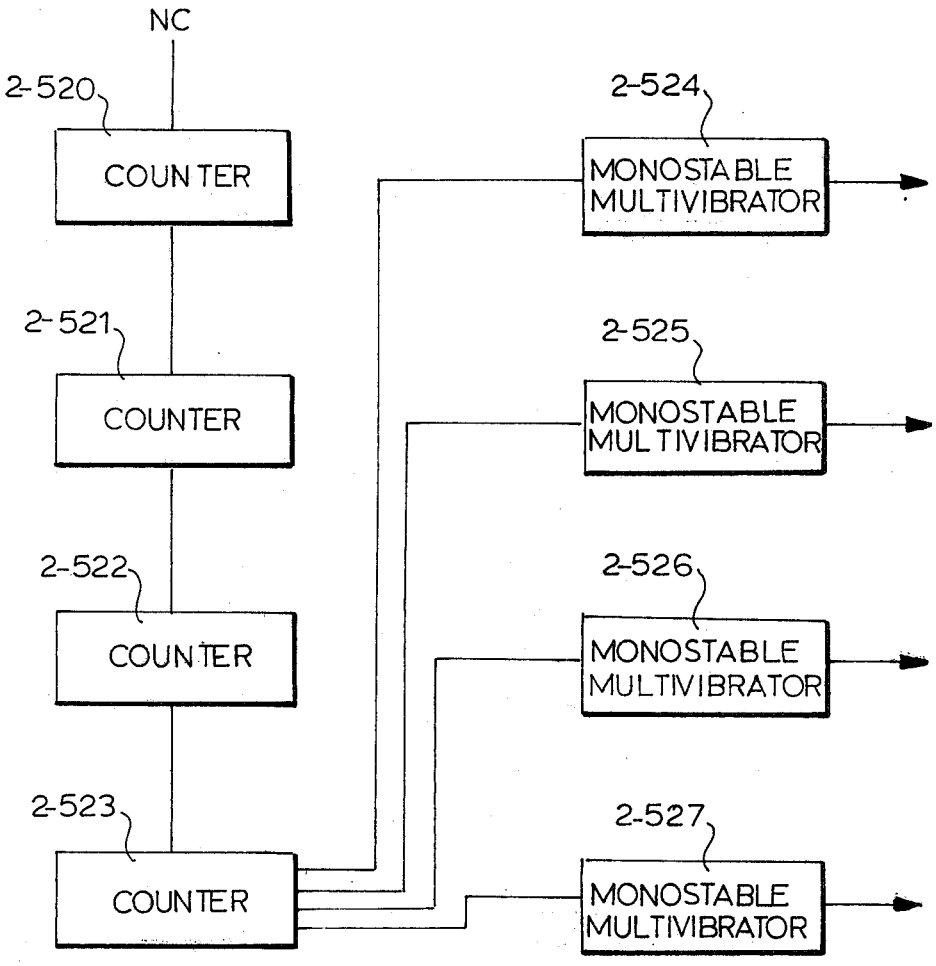
Figure 3:
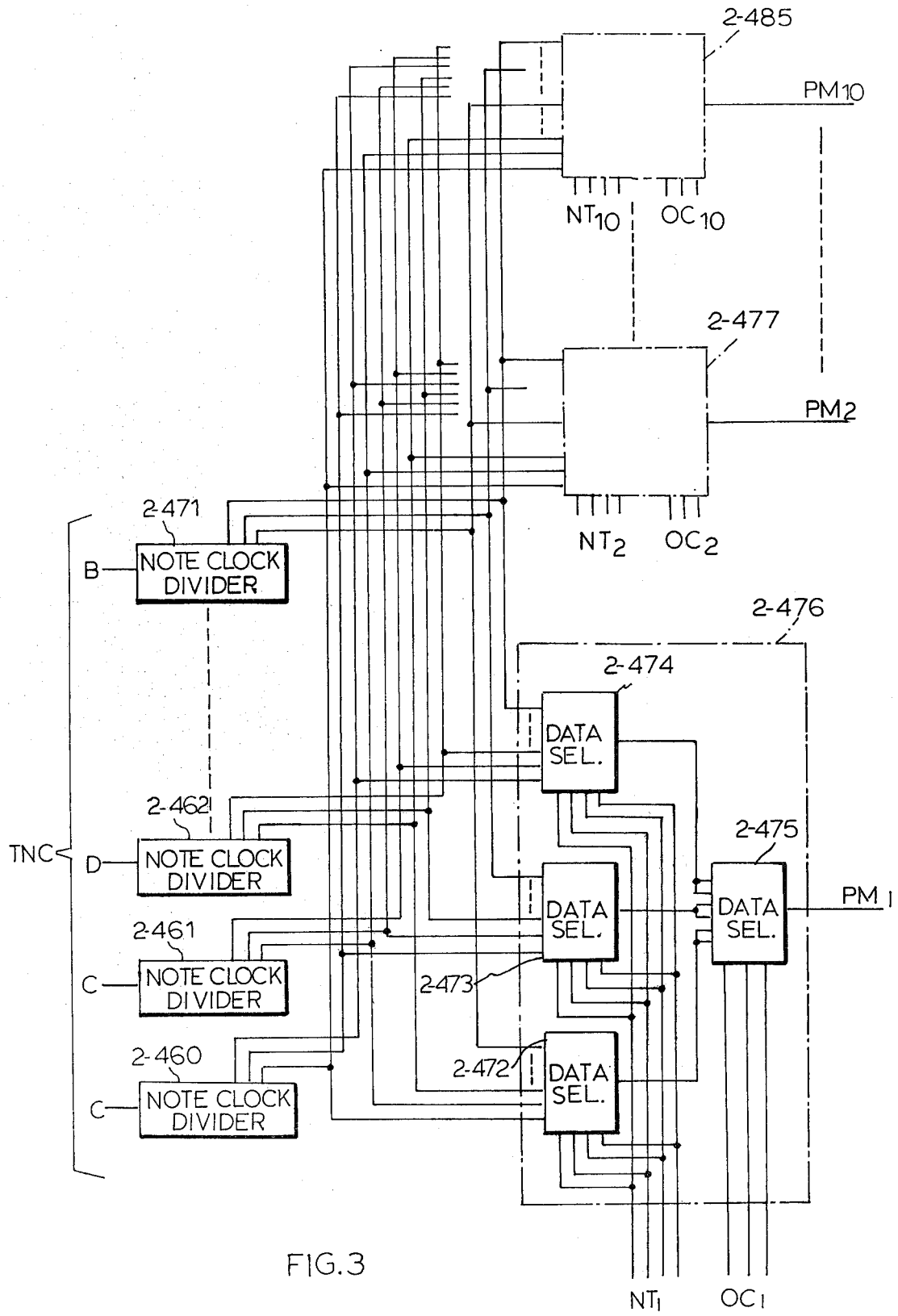
Figure 4:
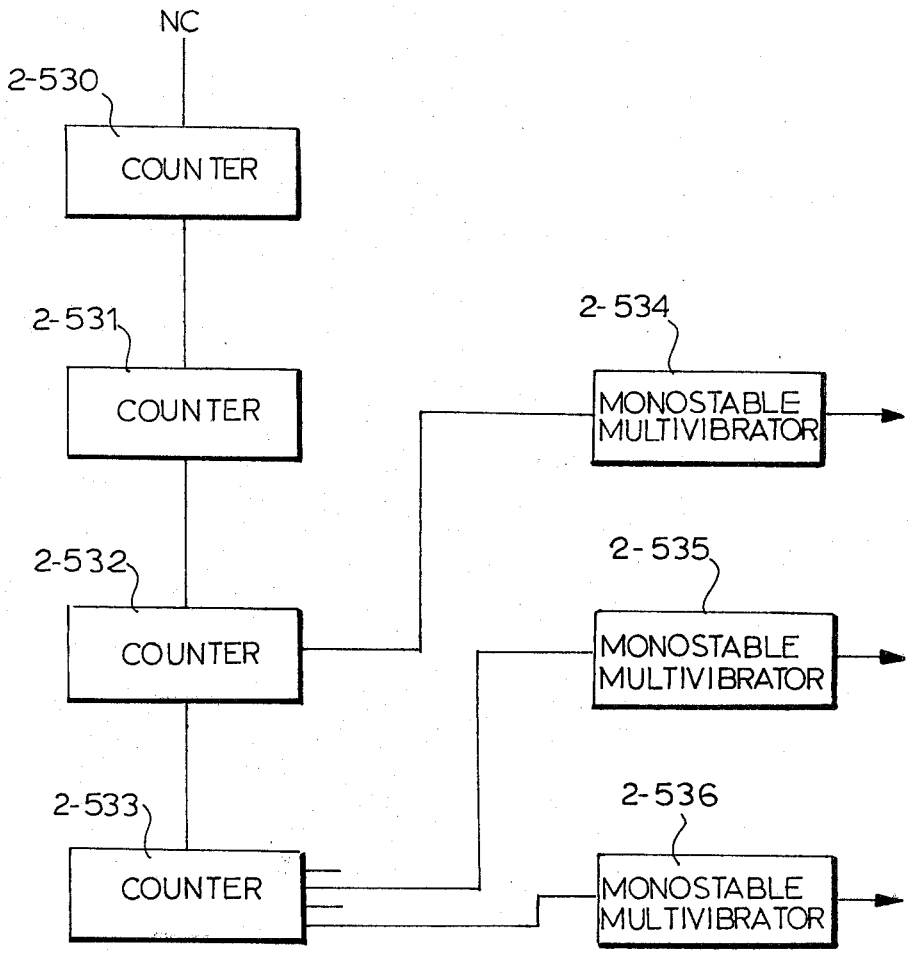
Figures 1, 5:
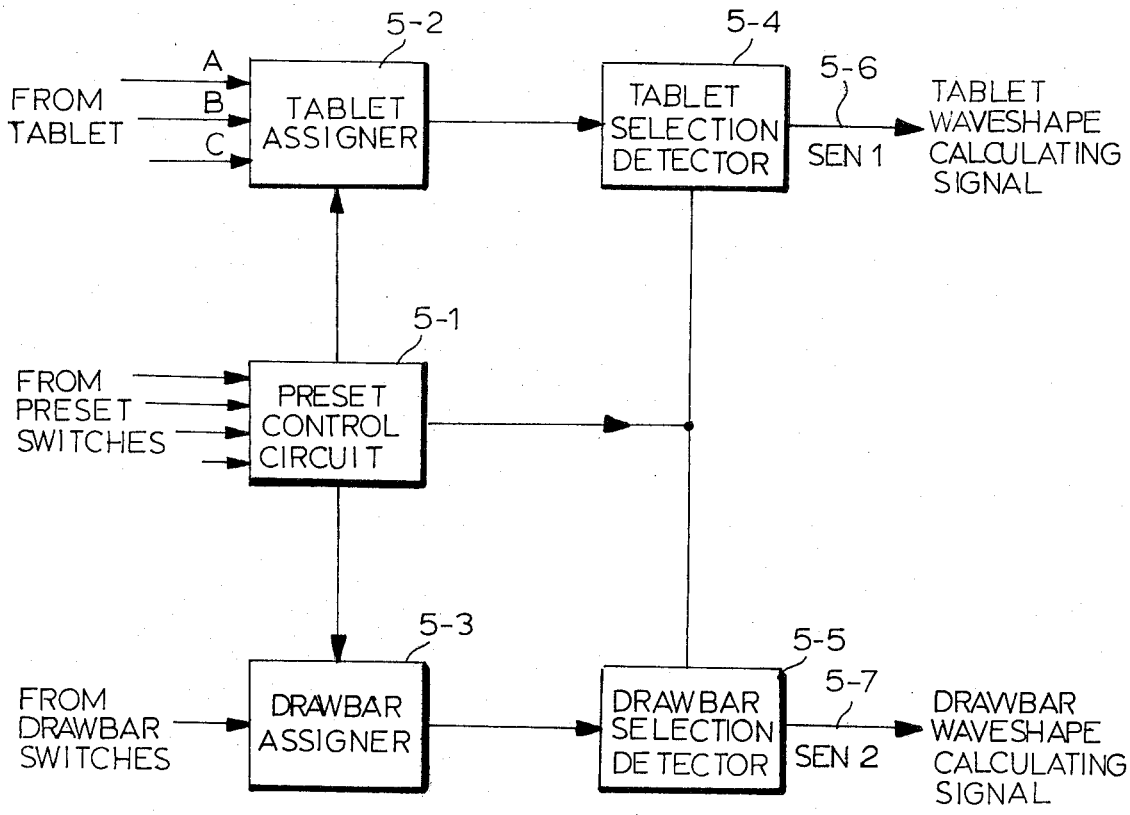
Figures 2, 5:
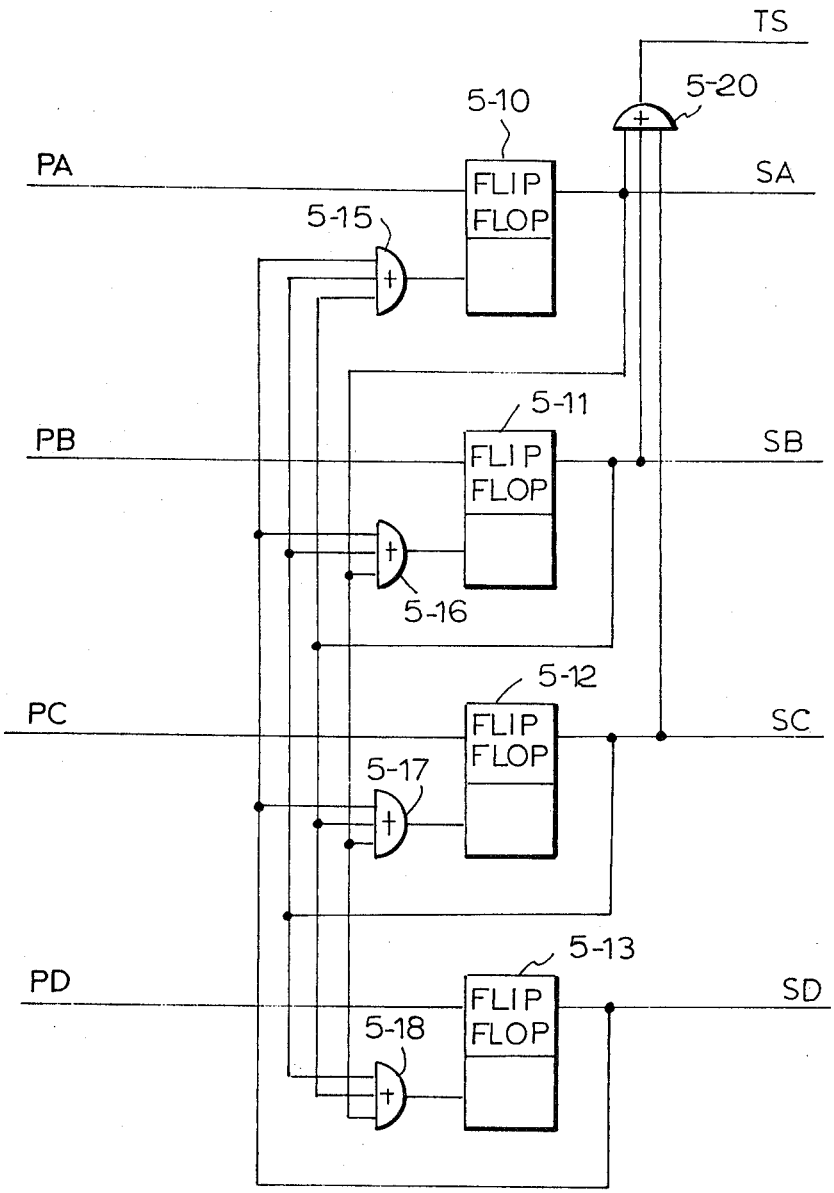
Figures 3, 5:
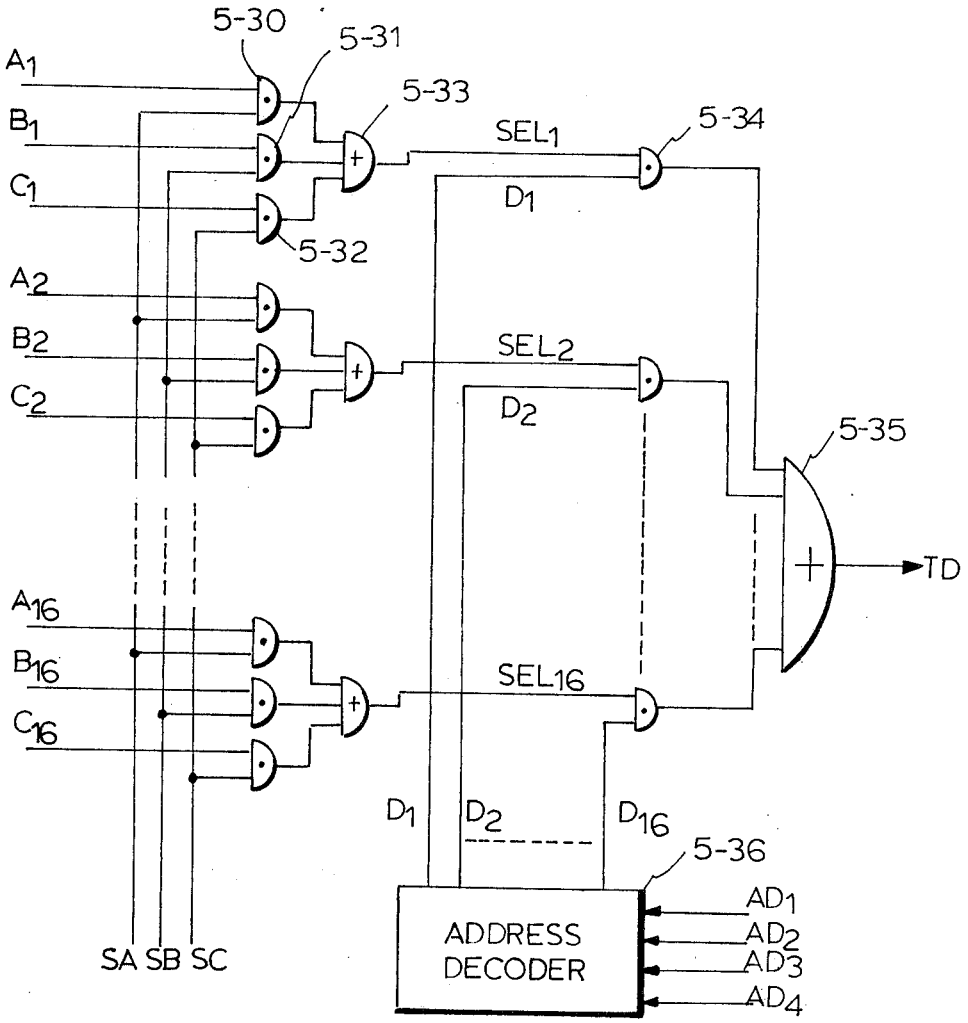
Figures 4, 5:
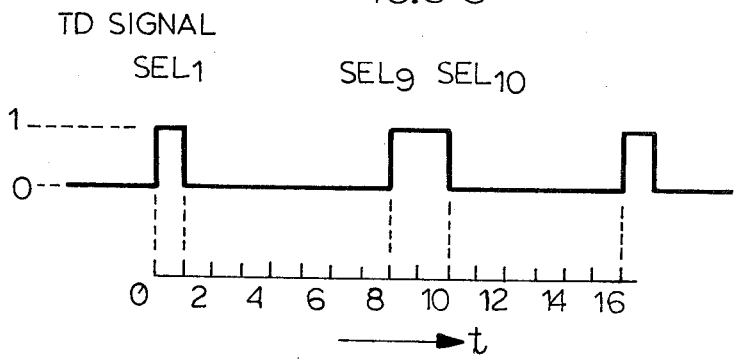
Figures 5, 6, 7:
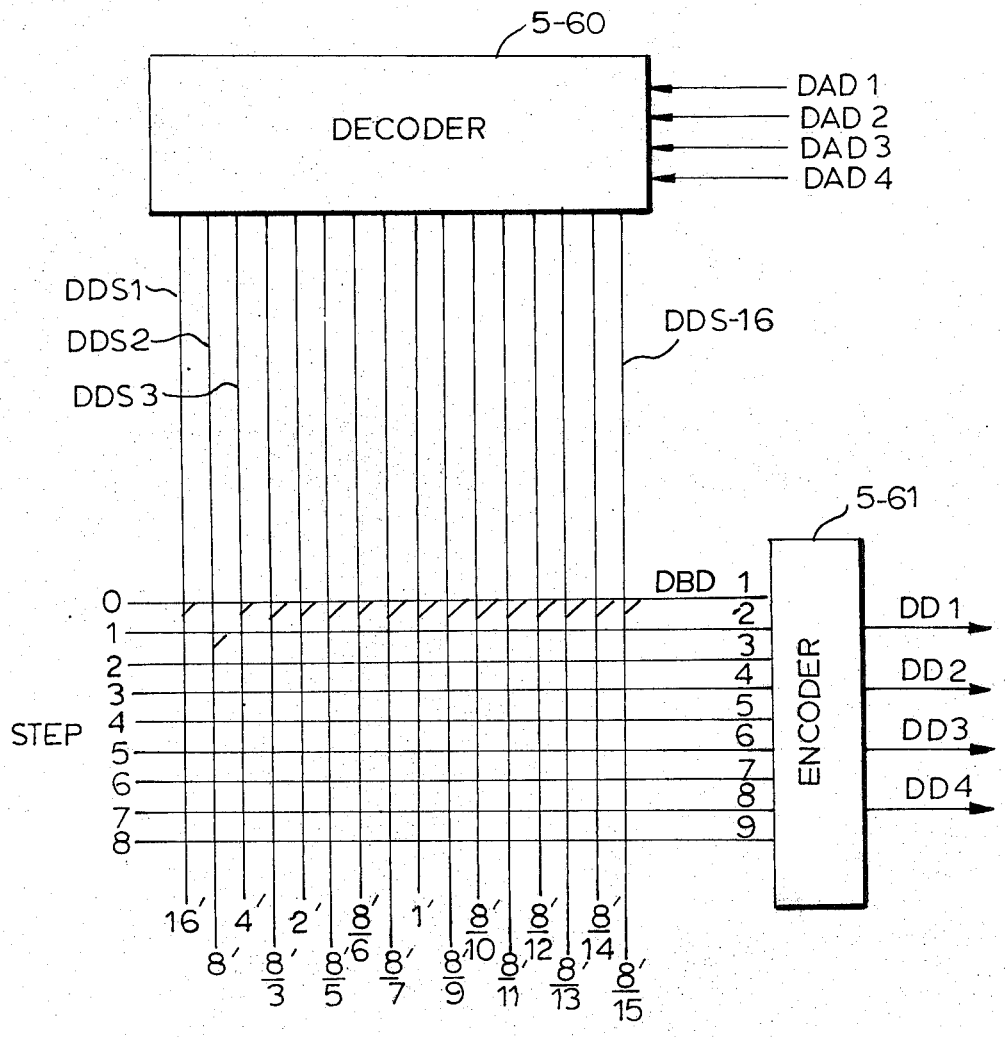
Figures 1, 6:
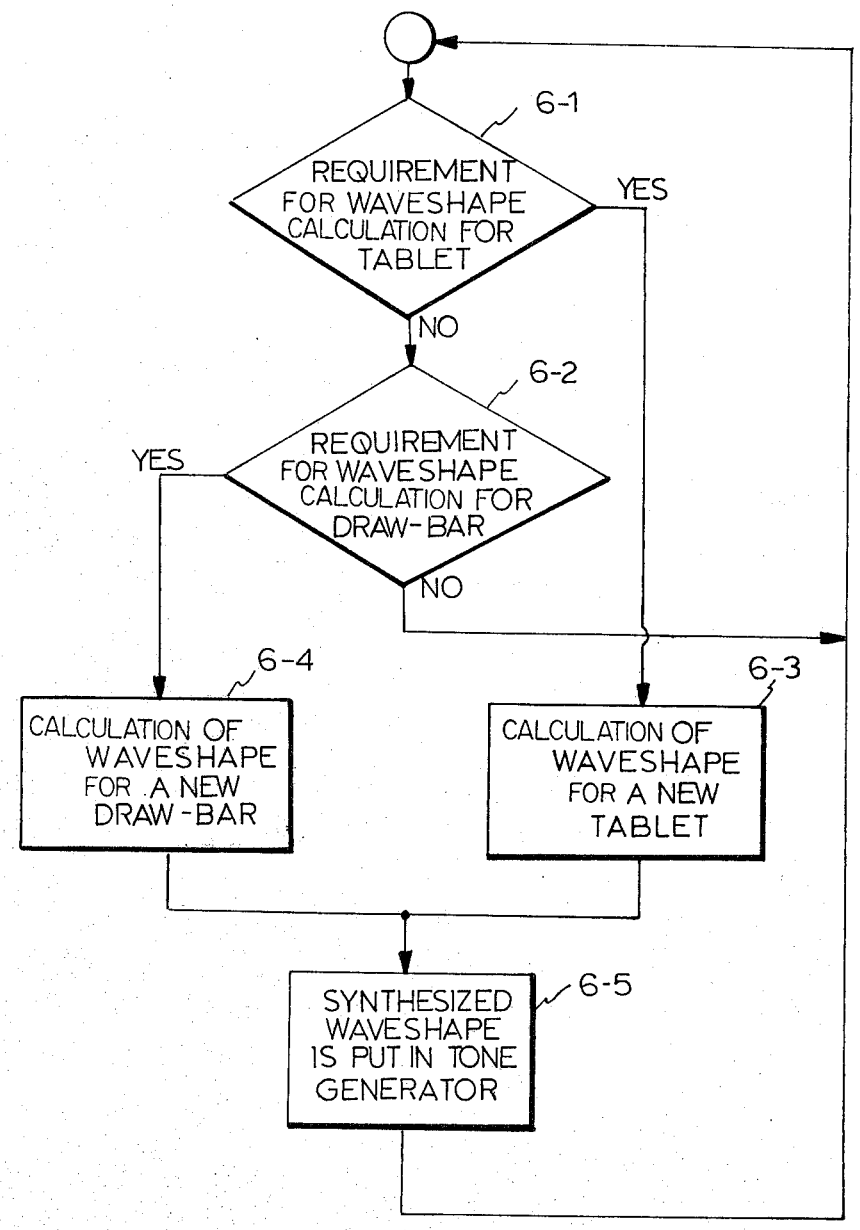
Figures 2, 6:
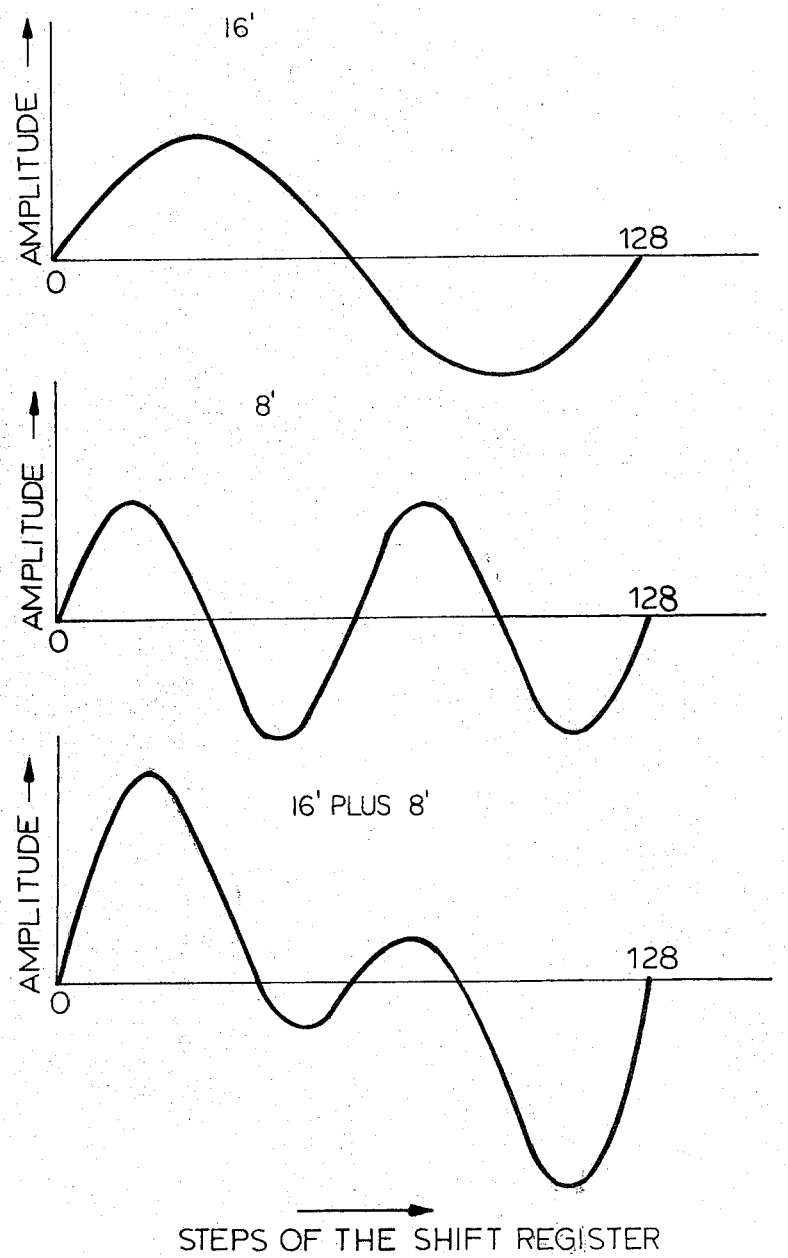
Figures 3, 6:
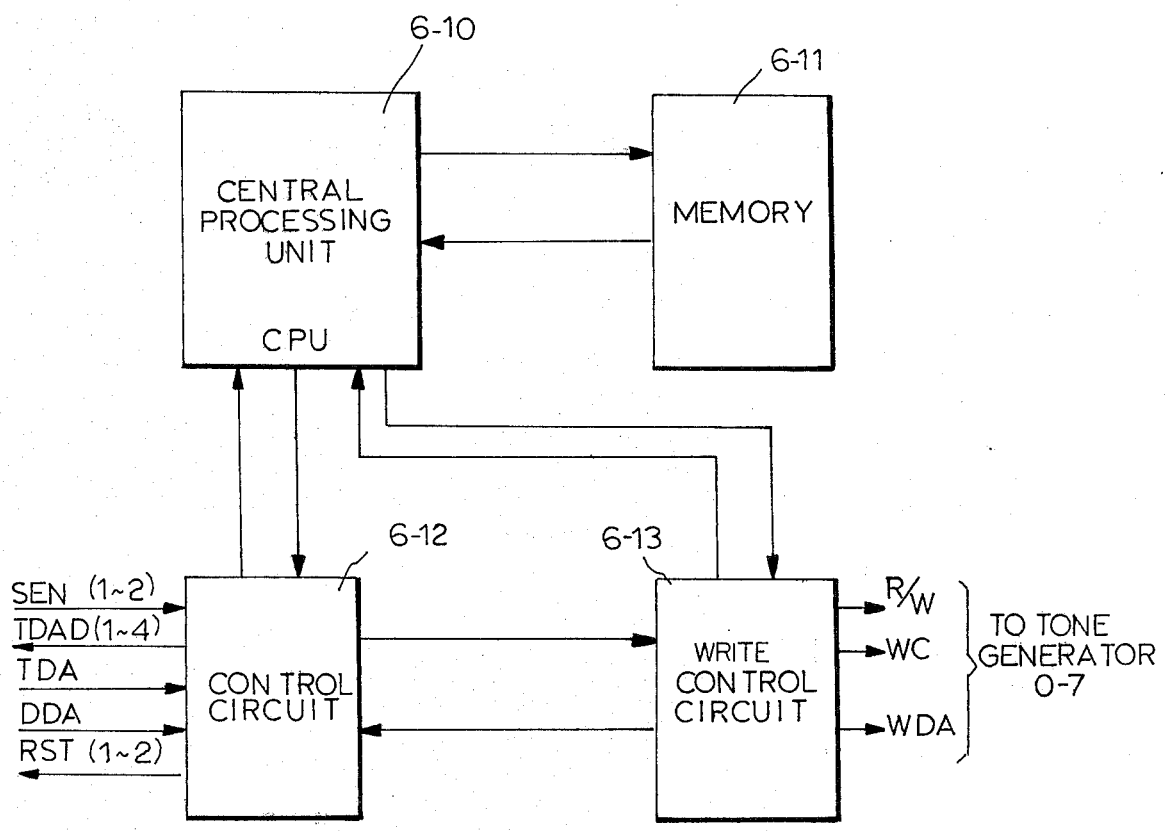
Figures 4, 6:
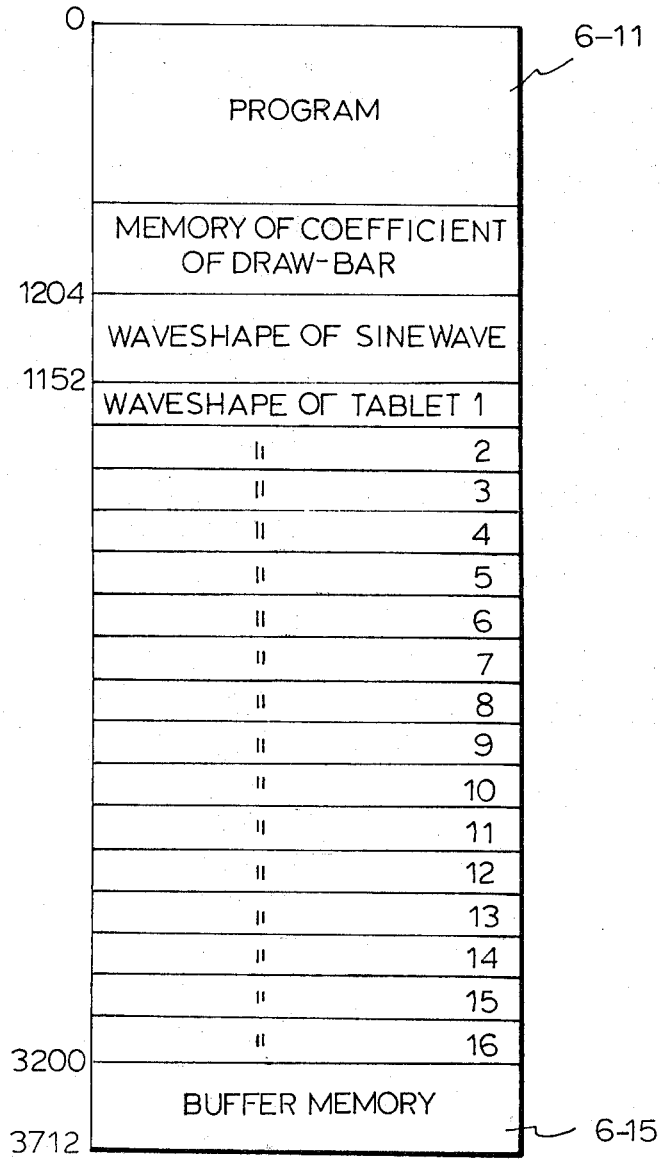
Figures 5, 6:
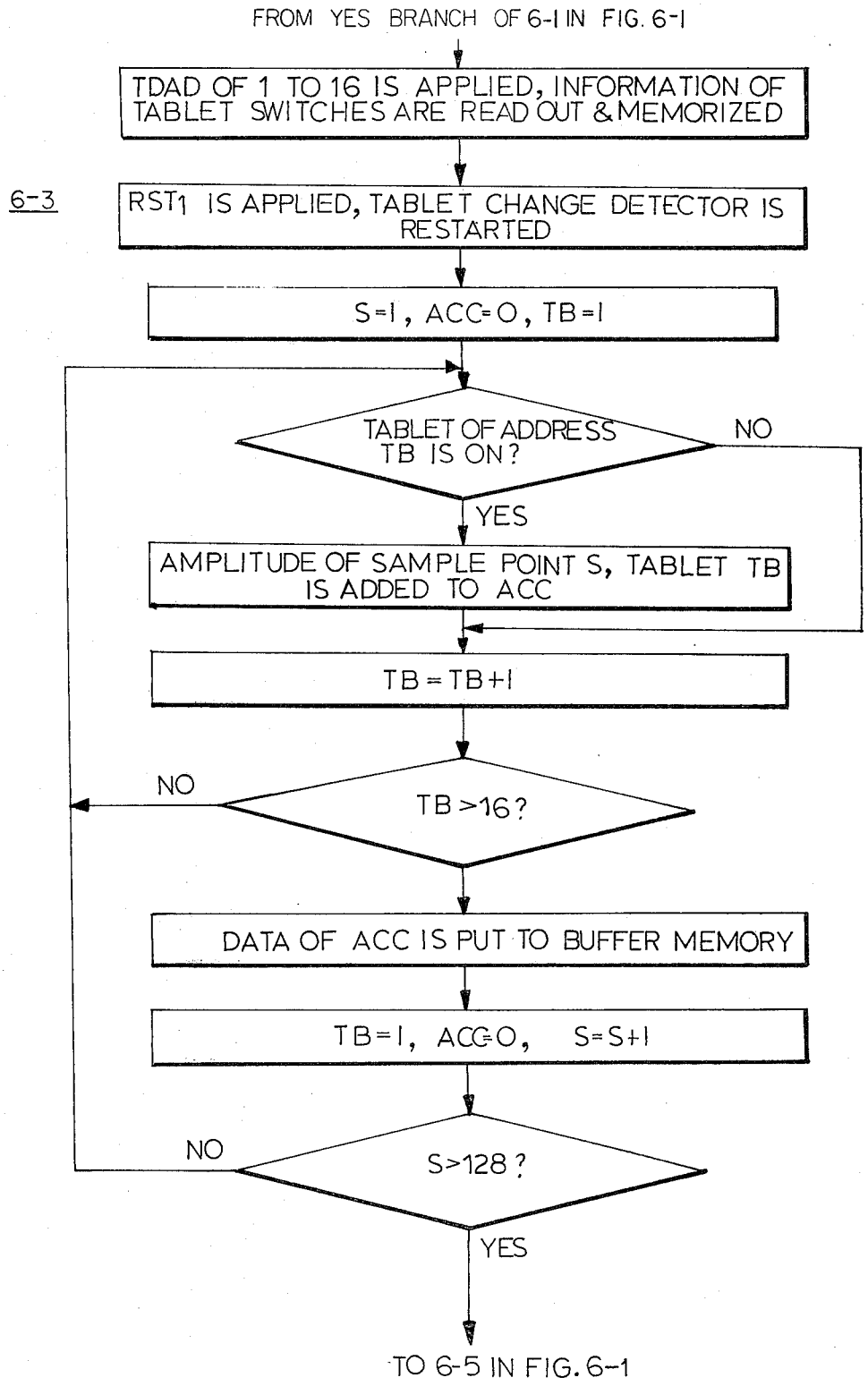
Figure 6:
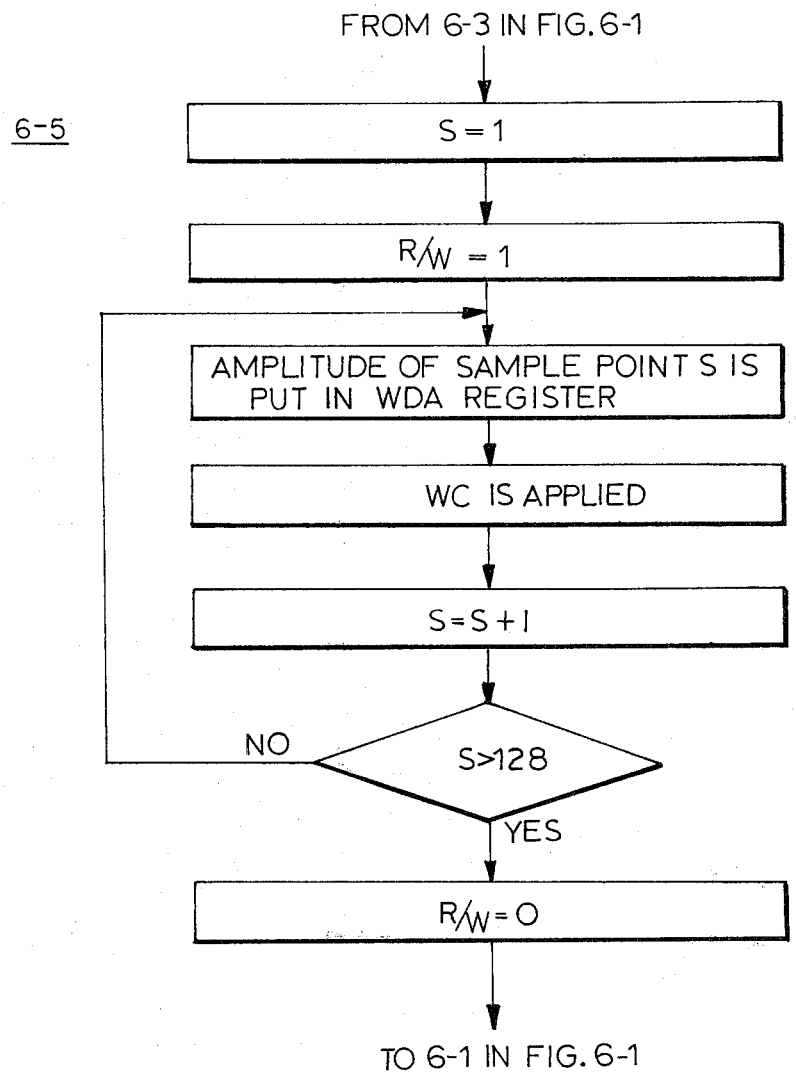
Figures 6, 7:
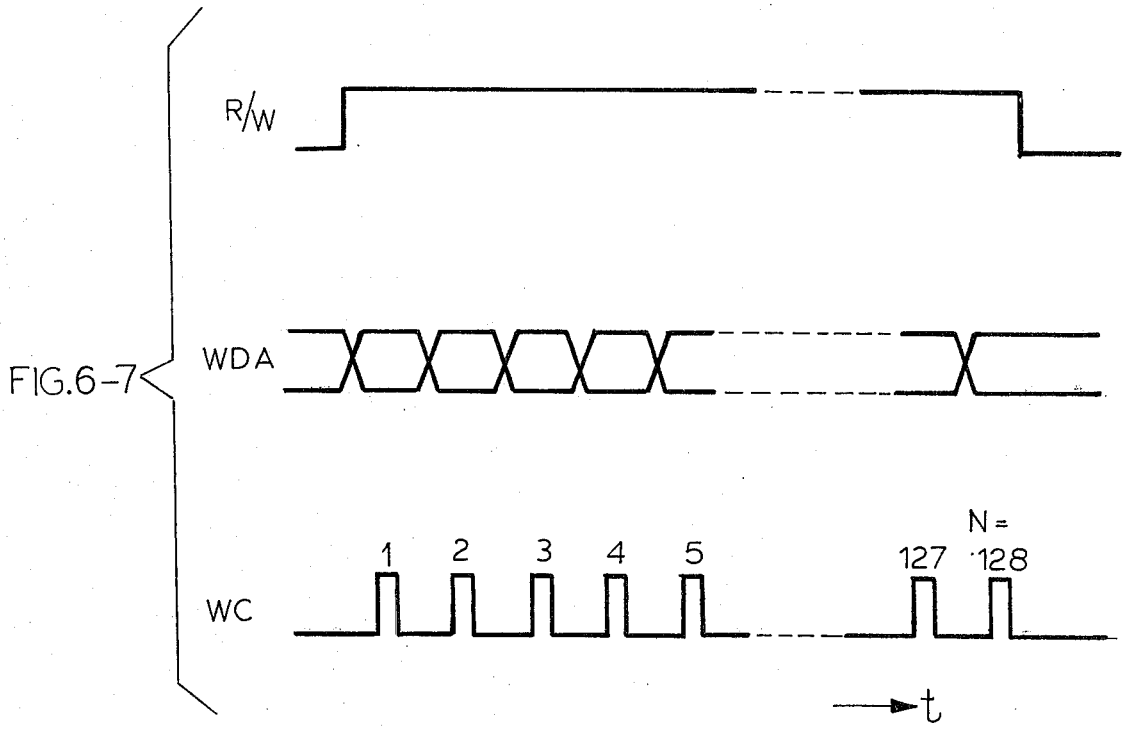
Figures 6, 7, 8:
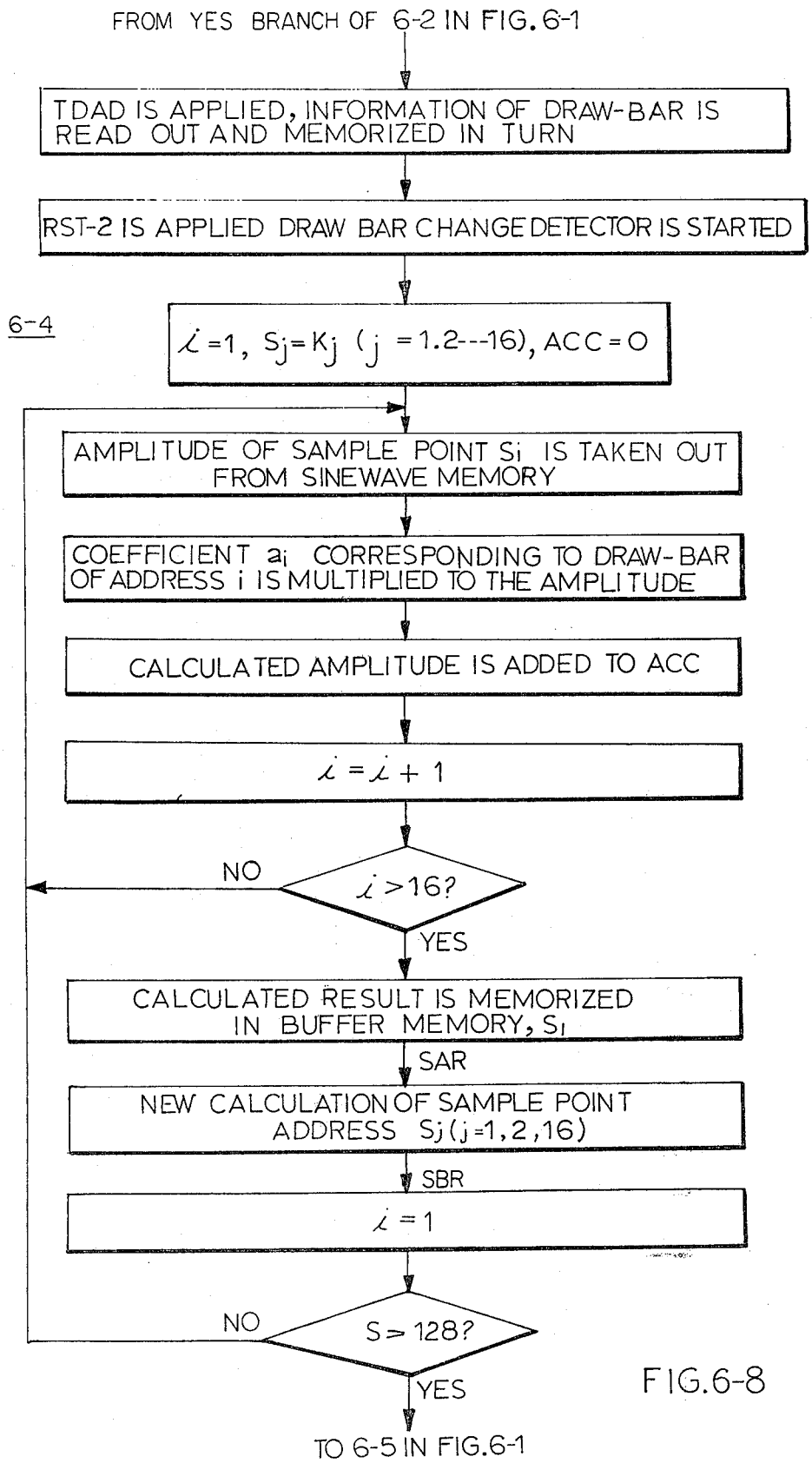
Figures 6, 7, 8, 9:
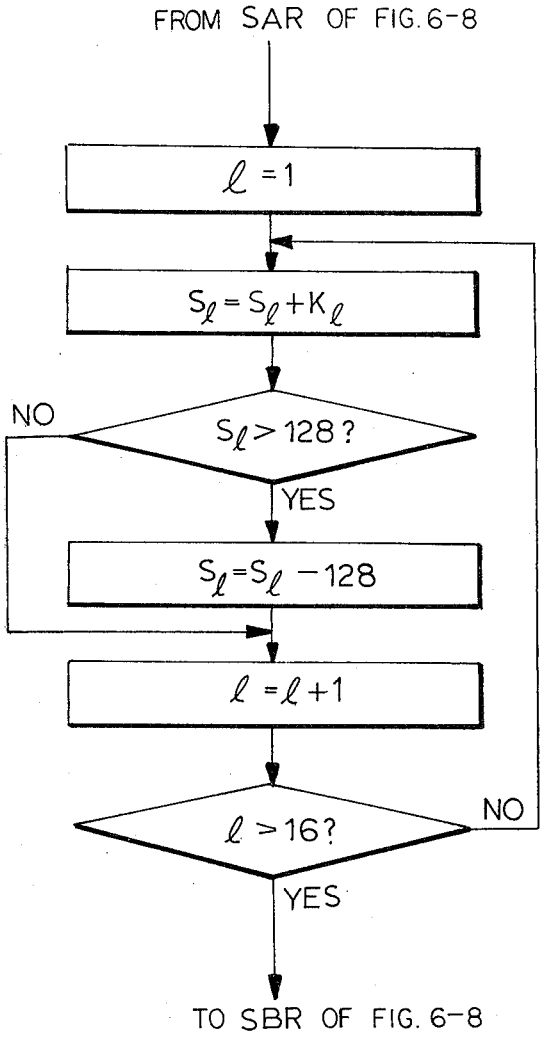
Figures 6, 7, 8, 9, 10:
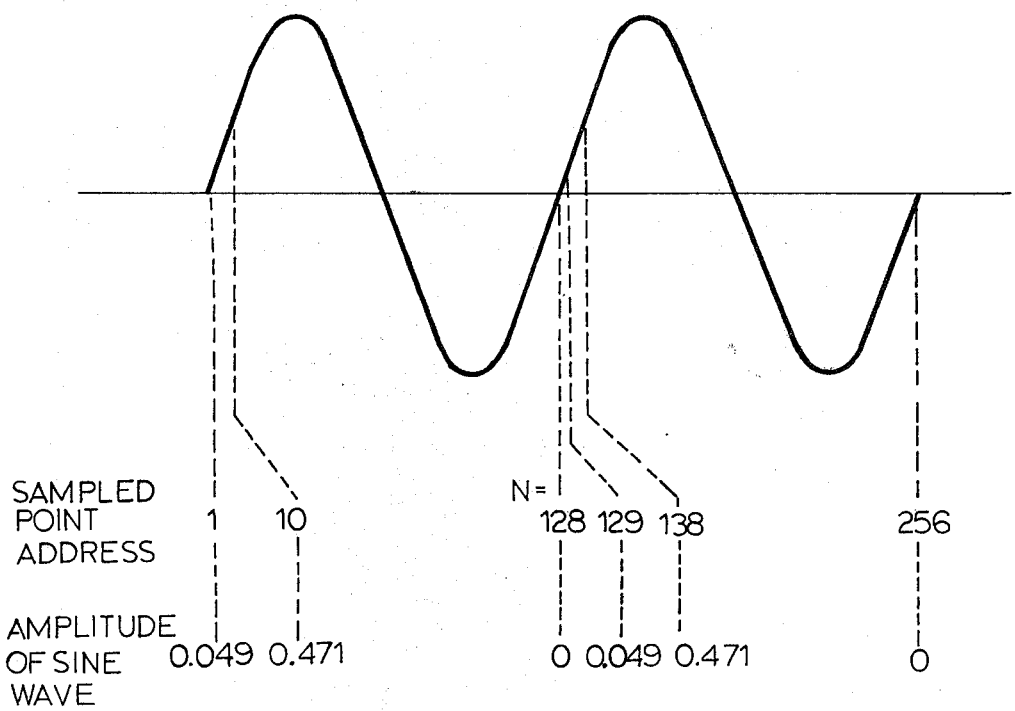
Figures 1, 7:
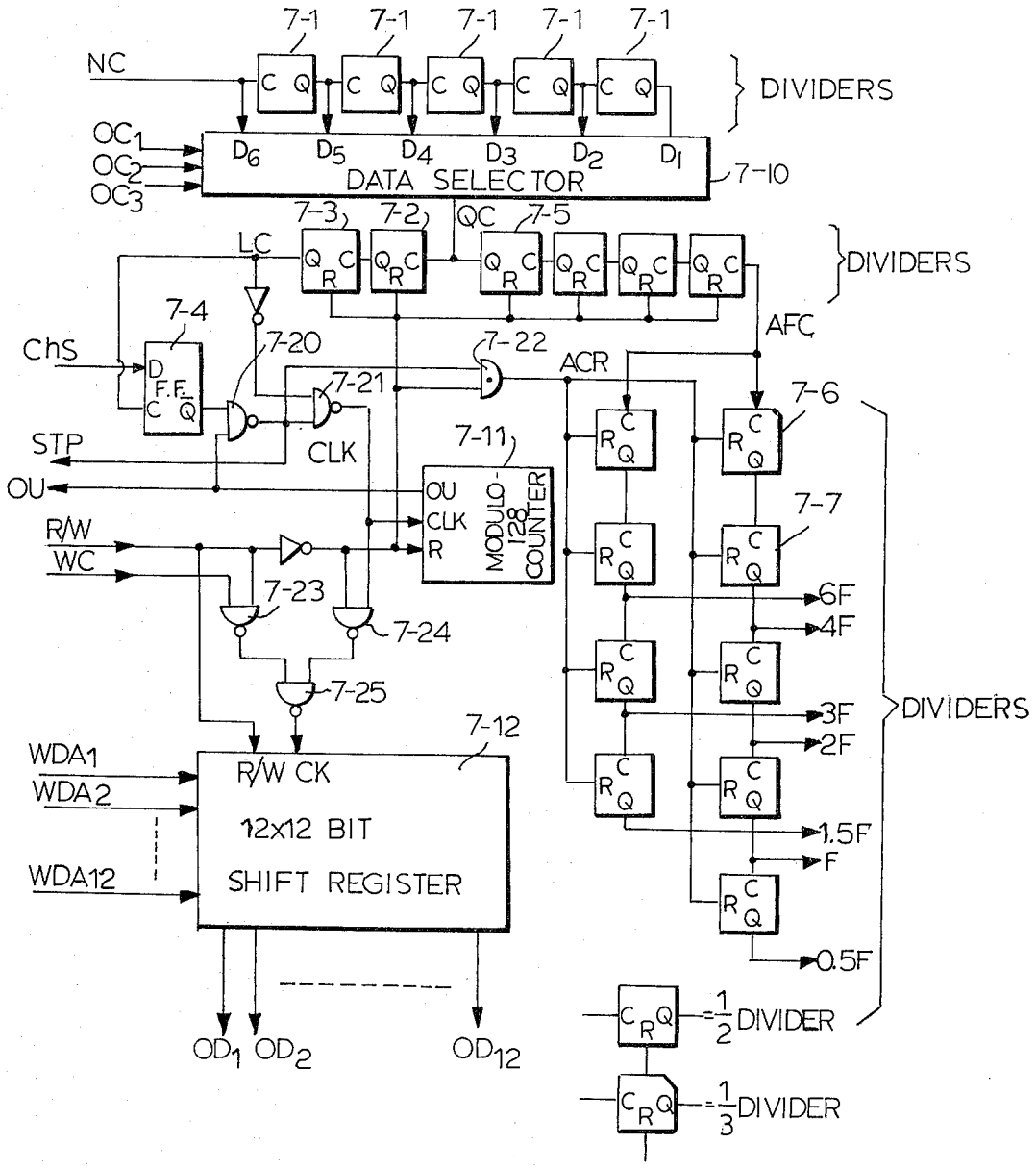
Figures 2, 7:
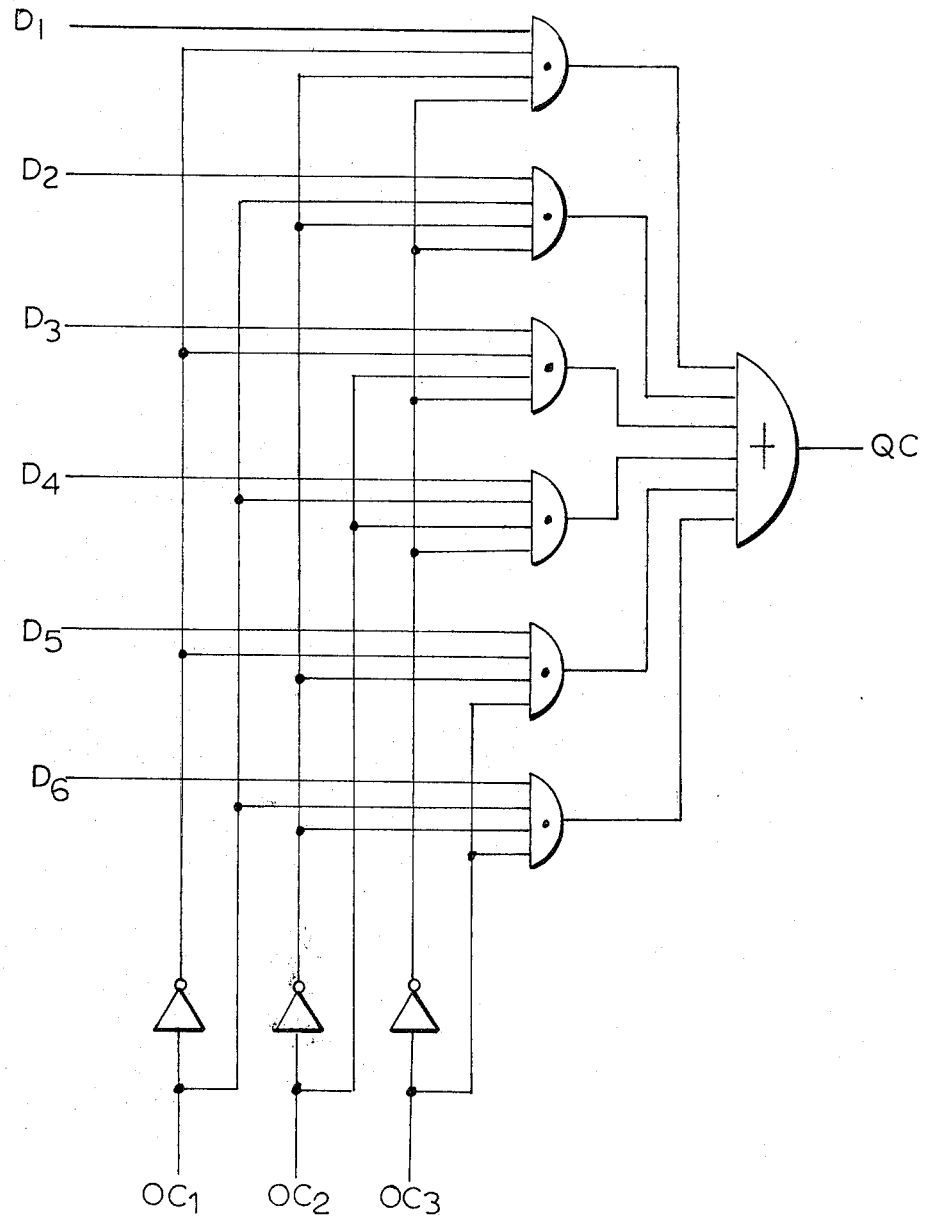
Figures 3, 7:
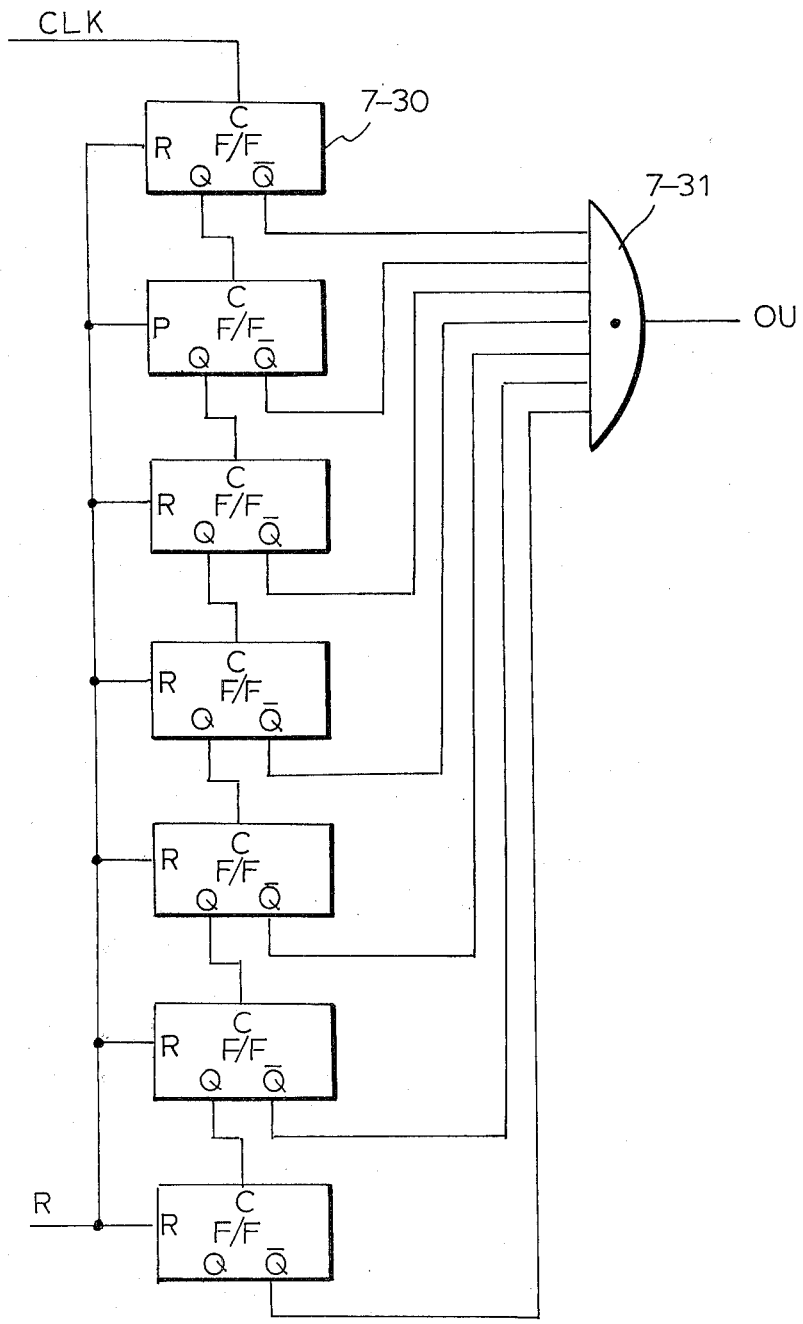
Figures 4, 7:
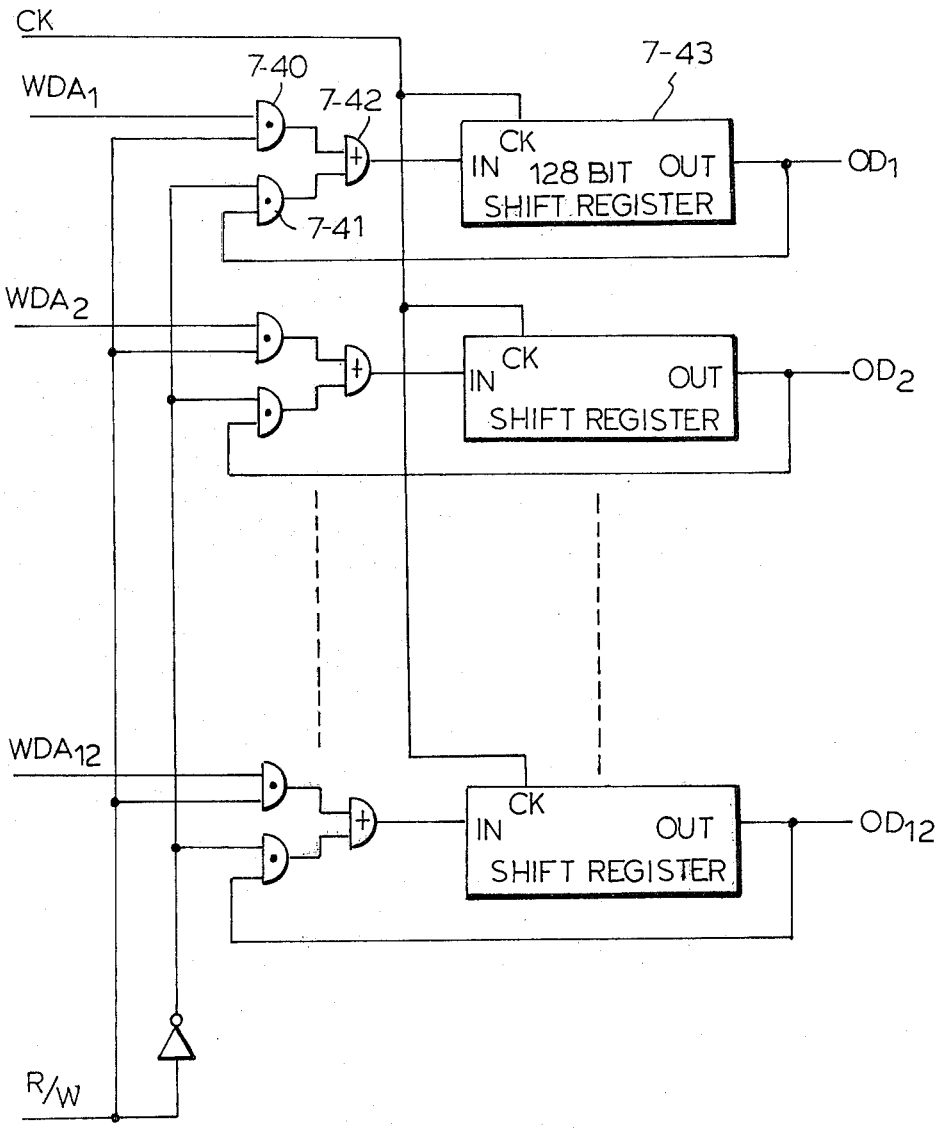
Figures 5, 7:
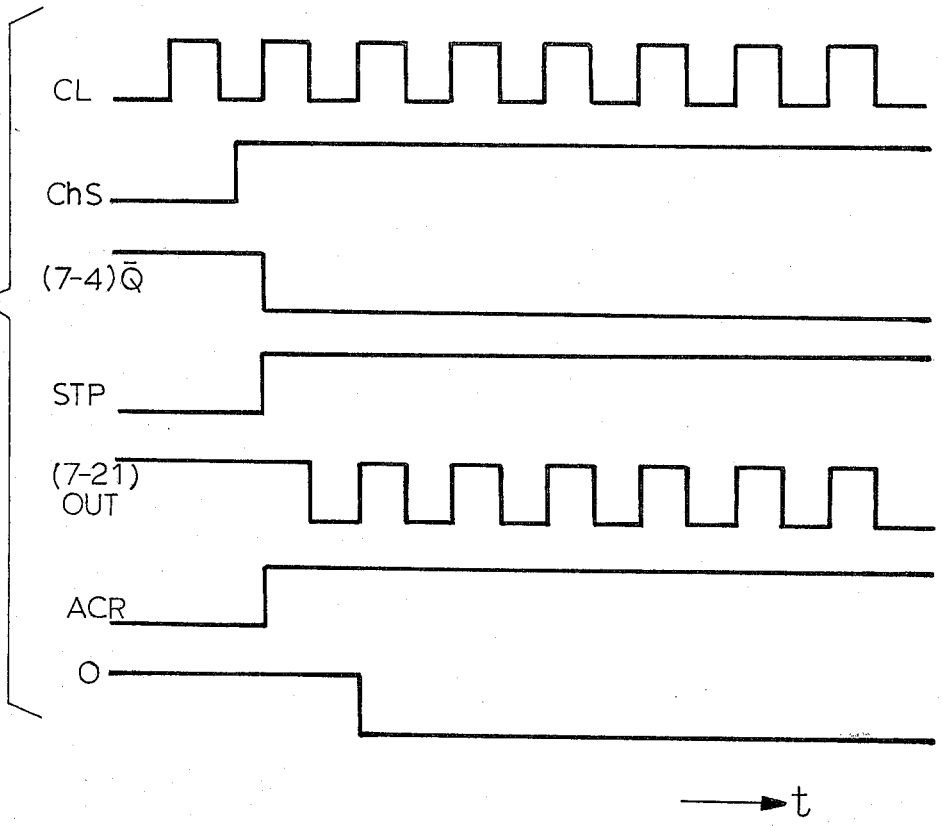
Figures 6, 7:
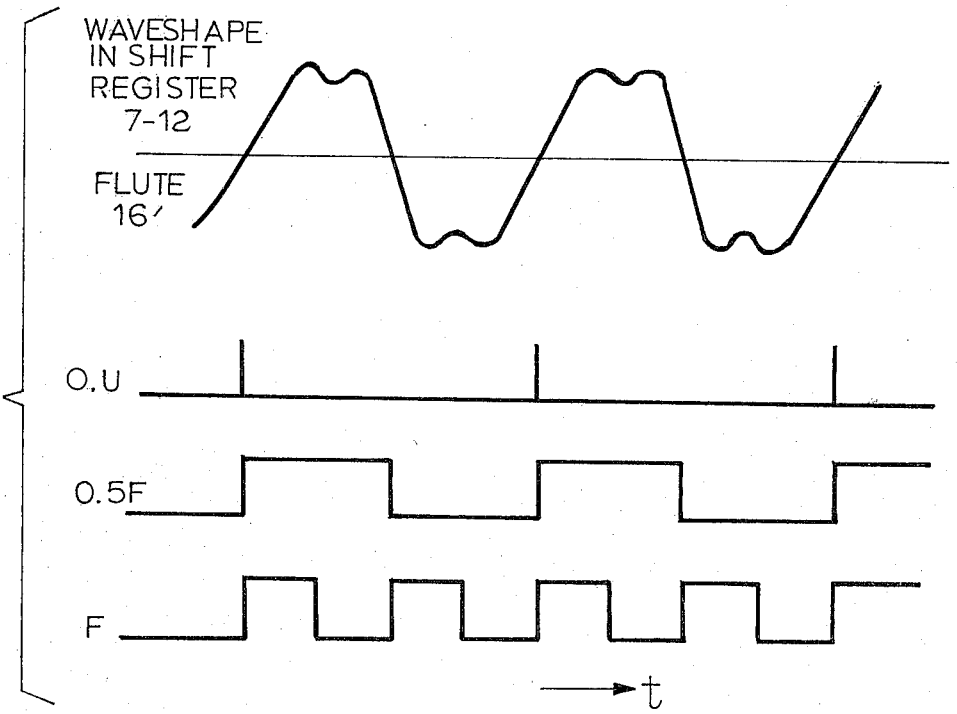
Figure 8:
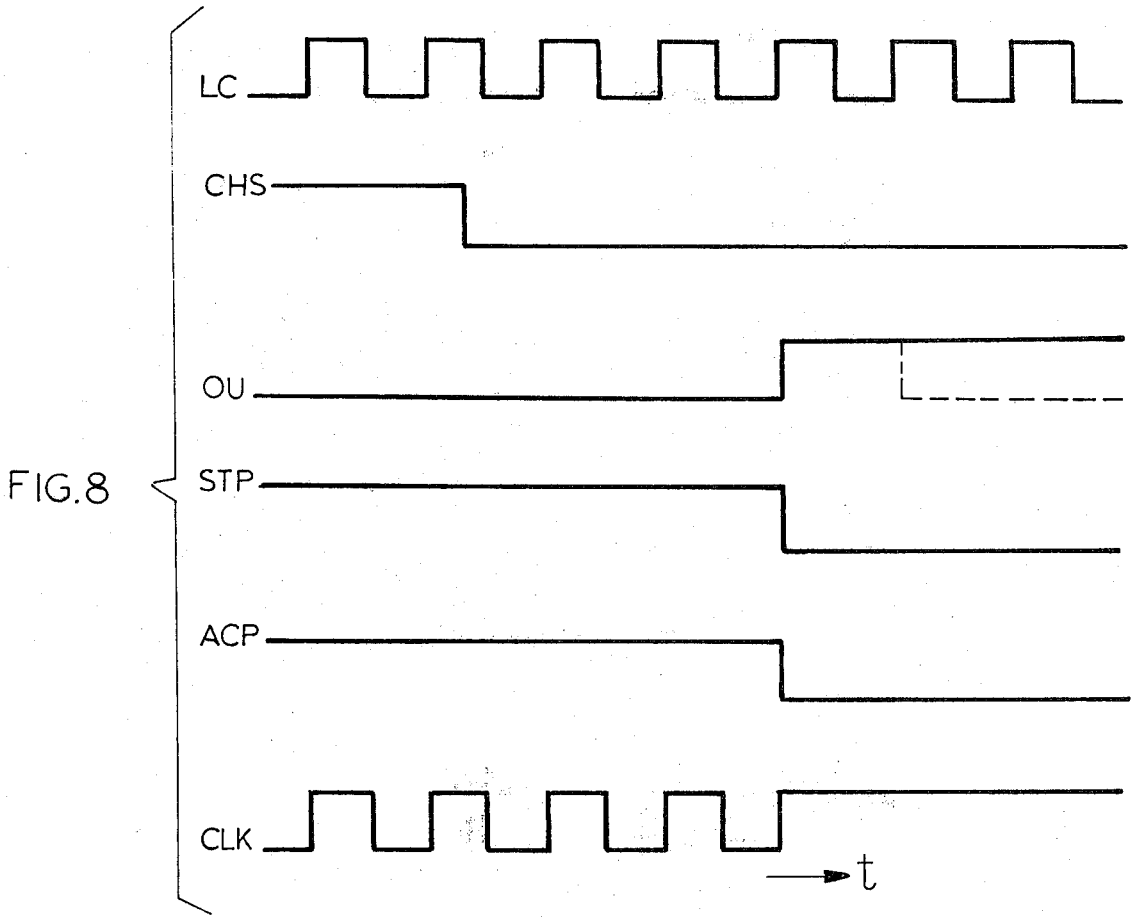
Figures 3, 9:
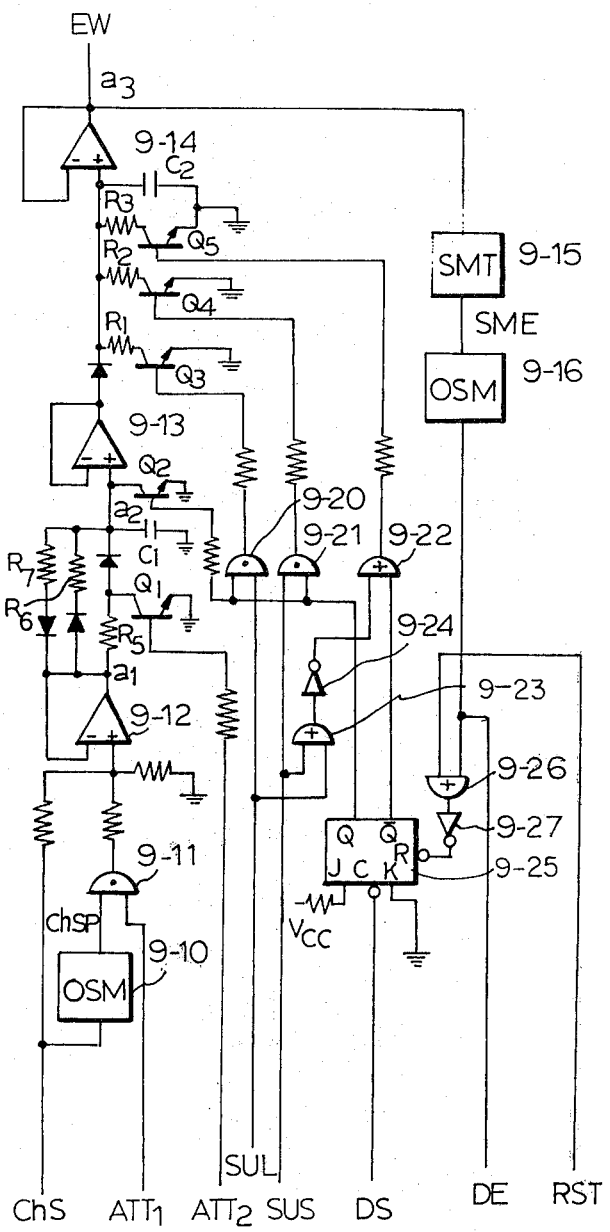
Figures 4, 9:
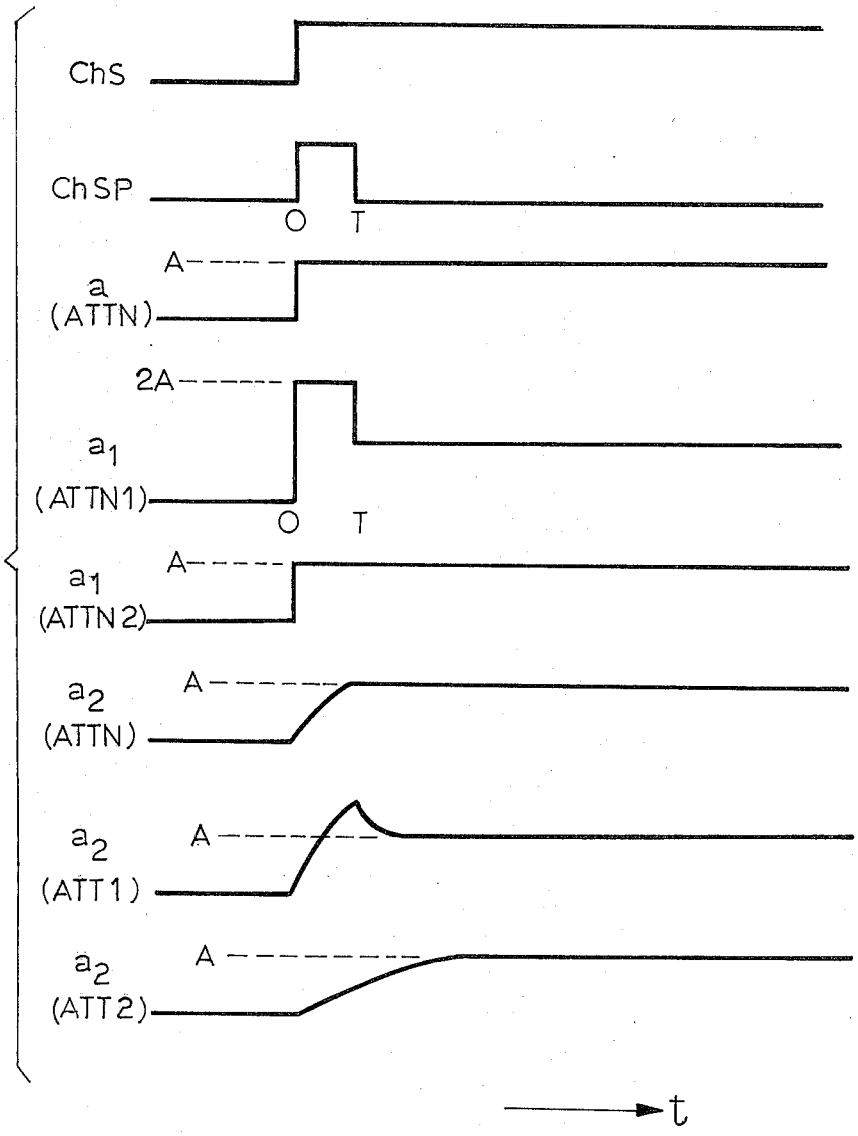
Figures 5, 9:
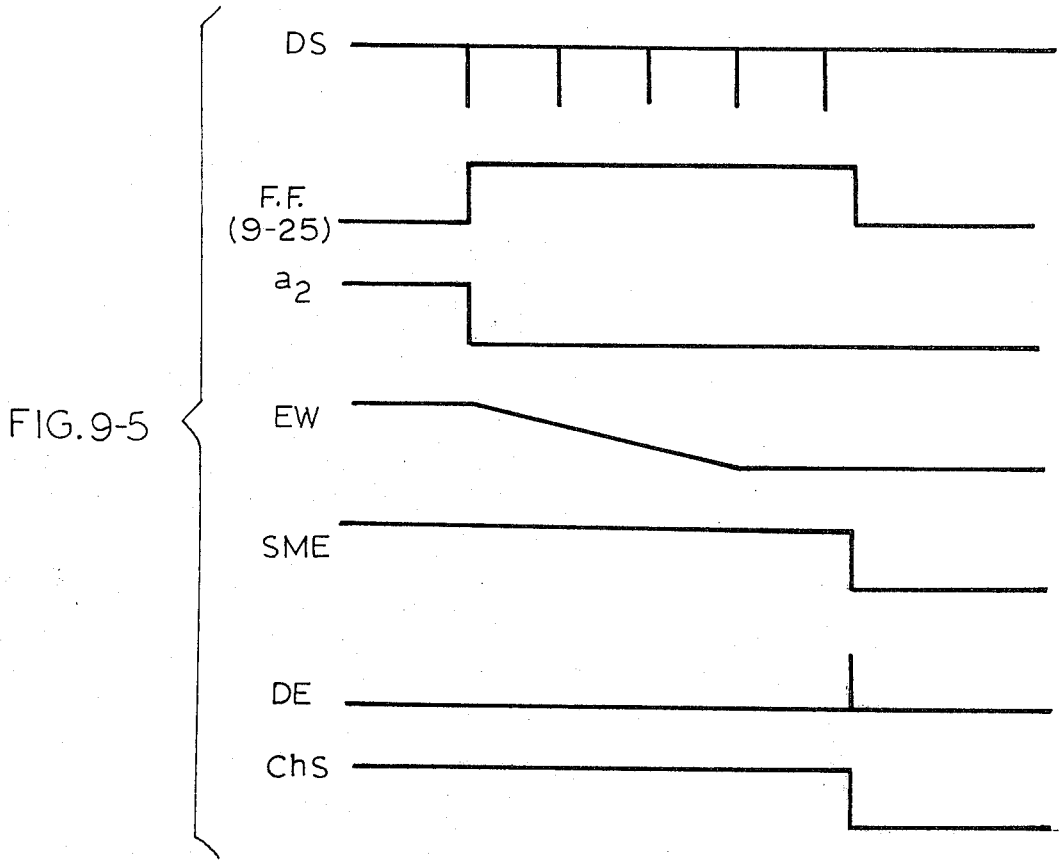
Figures 6, 9:
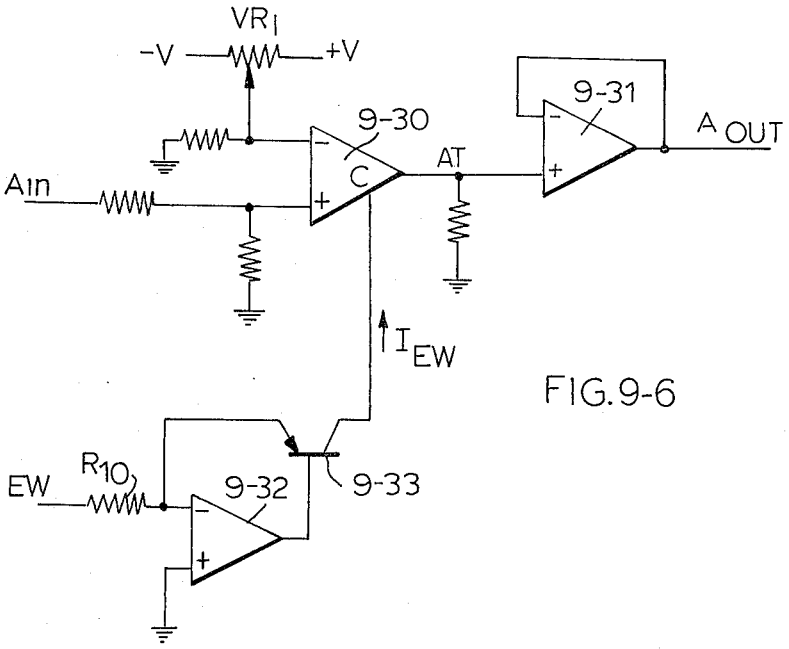
Figures 7, 9:
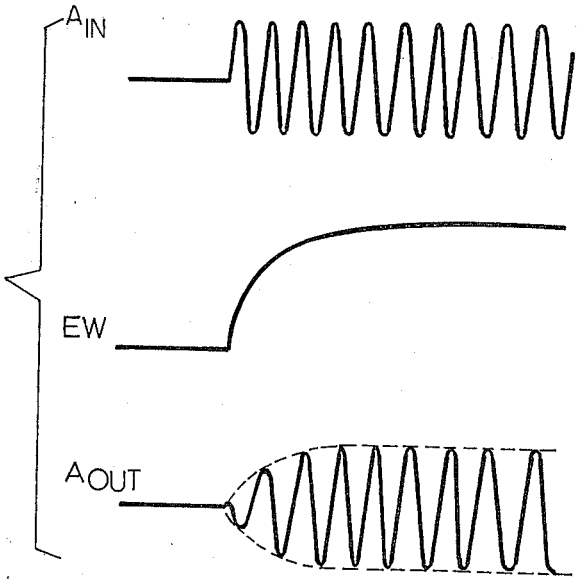

The electronic musical instrument using digital engineering in accordance with the present invention uses the analog process for envelope control. FIG. 9-1 shows a block diagram of envelope generator 0-9, in which analog tone signal $A_{IN}$ is multiplied by envelope signal EW, so that the signal $A_{IN}$ is amplitude modulated by the envelope signal EW. Amplifier 9-2 amplifies the above tone signal modulated by EW to a suitable level. Envelope control circuit 9-3 generates various envelope signal EW such as attack and sustain, under the control of channel selecting signal ChS and decay start signal DS from the generator assigner 0-2 and envelope assigning signals $ATT_1$, $ATT_2$, SUS and SUL from an envelope tablet. It also provides decay end signal DE to the generator assigner 0-2 at the end of the decay so as to release the channel.

In this embodiment, there are three kinds of envelopes for attack and sustain illustrated in FIG. 9-2. In the figure, attack 1 having an over shoot is generated when signal $ATT_1$ from the tablet is "1" and is used when an abrupt attach is desired. Attack N is the waveshape usual in an electronic musical instrment and it is generated when both $ATT_1$ and $ATT_2$ are "0". Attack 2 is a waveshape rising slowly and it is generated when $ATT_2$ is "1". Sustain N is a falling tone envelope, and after releasing the key the tone disappears after 30 to 40 ms. This is generated when both SUS and SUL are "0". Sustain S is a tone envelope with a decay time of 0.4 to 0.5 sec. after releasing the key, and it is generated when SUS is "1". Sustain L is a tone envelope with the longest decay time after releasing the key, and it is generated when SUS is "1".

FIG. 9-3 shows an embodiment of the envelope control circuit 9-3. In this embodiment, the signal is processed at TTL level (transistor transistor-logic) that is 0 volt for "0" and +5 volt for "1," and logic elements in circuit 9-3 envelope control are TTL. In FIG. 9-3, one-shot multivibrator 9-10, AND gate 9-11, operational amplifier 9-12, resistors $R_5$, $R_6$ and $R_7$, capacitor $C_1$, transistors $Q_1$ and $Q_2$, and operational amplifier 9-13 form a circuit for generating an attack envelope. The multivibrator 9-10 generates a pulse ChSP having a certain pulse width at a "0" to "1" transition of channel selecting signal ChS. The AND gate 9-11 passes signal ChSP when $ATT_1$ is "1" and inhibits it when $ATT_1$ is "0". Operational amplifier 9-12 acts as an adder, and its output waveshape $a_1$ is shown in FIG. 9-4. As shown in the figure, output $a_1$ of operational amplifier 9-12 has an over shoot only when $ATT_1$ is "1".

When $ATT_2$ is transistor $Q_1$ is off and so the output $a_1$ of operational amplifier 9-12 charges capacitor $C_1$ through resistors $R_5$ and $R_6$. When $ATT_1$ is 0 since output $a_1$ is expressed by a step function, terminal voltage $a_2$ of the capacitor at this time is shown as $a_2$ (ATTN) in FIG. 9-4. When $ATT_1$ is "1", $a_1$ has an over shoot as shown by $a_1$ (ATTN) in FIG. 9-4. Therefore, the output $a_1$ of operational amplifier 9-12 charges the capacitor $C_1$ through resistors $R_5$ and $R_6$ for a time t (FIG. 9-4) and then the charge of the capacitor is discharged through resistor $R_7$ until $a_1$ becomes $a_2$. Therefore, the terminal voltage $a_2$ of the capacitor $C_1$ an over shoot as shown by $a_2$ ($ATT_1$) in FIG. 9-4.

Then, when $ATT_2$ is "1" i.e. at +5 volt, transistor $Q_1$ turns on, and $a_1$ charges the capacitor $C_1$ through resistor $R_6$. Therefore, the waveshape has a slow rise, and the terminal voltage $a_2$ of capacitor $C_1$ is as shown by $a_2$ ($ATT_2$) in FIG. 9-4. Transistor $Q_2$ is off during the time when the key is depressed, and it discharges the capacitor $C_1$ during the decay or sustain period. Operational amplifier 9-13 acts as a buffer for terminal voltage $a_2$ of capacitor $C_1$.

Now the following describes the generation of the decay or sustain waveshape. When the key is released, generator assigner 0-2 generates decay start signal DS indicating the release of the key. Decay start signal DS is usually "1" and becomes "0" level upon the release of the key. Flip-flop 9-25 is set by decay start signal DS and stores this indication of the release of the key. While the key is depressed, the flip-flop circuit 9-25 is "0", so that AND gates 9-20 and 9-21 are closed each having an output of "0". As $\overline{Q}$ output of flip-flop 9-25 becomes "1," the output of OR gate 9-22 becomes "1" regardless of the state of SUS and SUL. Therefore, transistors $Q_3$ and $Q_4$ are off and $Q_5$ is on. Resistors $R_1$, $R_2$ and $R_3$ have resistance values expressed by the following relation:

$$R_1 > R_2 > R_3$$

Resistor $R_1$ discharges capacitor $C_2$ in the case of long sustain L, and resistor $R_2$ discharges capacitor $C_2$ in case of short sustain S, and resistor $R_3$ discharges capacitor $C_2$ in case of sustain N (normal decay). During the attack and the depression of the key, resistor $R_3$ having the fastest discharge speed is connected across capacitor $C_2$, and at this time the terminal voltage of the capacitor $C_2$ follows to output of the operational amplifier 9-13. When the key is released, flip-flop 9-25 is set by the decay start signal DS, and transistor $Q_2$ turns on which quickly discharges the voltage $a_2$ across capacitor $C_1$ to zero. Therefore, the output voltage of operational amplifier 9-13 also becomes zero. At this time, AND gates 9-20 and 9-21 open so that signal SUS and SUL appears at their respective outputs. If only the output SUS is "1", only the output of AND gate 9-21 becomes "1" and the charge of the capacitor $C_2$ is discharged through resistor $R_2$ only, because the outputs of AND gate 9-20 and OR gate 9-22 become "0" and transistors $Q_3$ and $Q_5$ are turned off, because the outputs of OR gate 9-23, invertor 9-24 and flip-flop 9-25 are "1", "0" and "0", respectively. In the case when signal SUL is "1" the charge of capacitor $C_2$ is also discharged through the resistor $R_1$. When both SUS and SUL are "0", the output of OR gate 9-22 is still "1," and the charge of the capacitor $C_2$ is discharged through resistor $R_3$.

When the charge of the capacitor $C_2$ is discharged, output $a_3$ of operational amplifier 9-14 decreases the near zero. Schmidt trigger 9-15 holds its output SME at "1" until $a_3$ becomes near zero and then output SME become "0" when $a_3$ decreases completely. The "1" to "0" transition of the output SEM, triggers multivibrator 9-16 and generates decay end signal DE. Flip-flop 9-25 is cleared by this decay end signal DE, and at the same time decay end signal DE is transferred to the generator assigner 0-2 so as to return the channel selecting signal $Ch_s$ to "0."

FIG. 9-5 shows each waveshape relating to this decay or sustain. Restart signal RST shown in FIG. 9-3 is generated from generator assigner 0-2 when the same key is again depressed before end of decay after the key is once released and the decay or sustain envelope is generated. Flip-flop 9-25 is cleared and transistor $Q_2$ is turned off by this restart signal RST. Then, the envelope control circuit 9-3 stops decay or sustain operation and returns to the state when the key is depressed.

FIG. 9-6 shows an embodiment of a multiplier circuit 9-1, in which a transconductance amplifier 9-30 attenuates or amplifies tone signal $A_{IN}$ according to the current $I_{ew}$ applied at its terminal C, and its output AT is generated as output signal $A_{OUT}$ through operational amplifier 9-31 used as a buffer. Operational amplifier 9-32 and transistor 9-33 convert the voltage of the envelope signal EW into current $I_{ew}$ proportional thereto, and EW and $I_{ew}$ have the following relation:

$$I_{ew} = EW/R_{10}$$

FIG. 9-7 shows the relation among input tone signal $A_{IN}$ of the multiplier circuit 9-1, envelope signal EW and output signal $A_{OUT}$ for the case of attack envelope of attack. As shown, the input signal $A_{IN}$ is provided with the envelope of envelope signal EW since output signal $A_{OUT}$. As the trans conductance amplifier is well known in the prior, it is not described here.

Hereinabove, an embodiment of the invention is described, but the invention is not limited to this embodiment and various modifications are possible within the scope of the invention.

Moreover, although digital processing of the information of the tone envelope is herein described, it is also possible to employ analog information processing if desired. In this case, an analog shift register comprising a charge transfer device such as a BBD (bucket brigate device) of a CCD (charge coupled device) can be used as a waveshape memory device.

What is claimed is:

1. An electronic musical instrument comprising at least one tone selecting means for selecting musical tones; waveshape calculating means coupled to said tone selecting means for calculating a waveshape represented by amplitudes at two or more than two sampled points for the selected musical tone, said calculating means being operative whenever one of said tone selecting means is actuated; a plurality of waveshape memory means coupled to said waveshape calculating means for temporarily memorizing said calculated waveshapes; a plurality of clock signal generating means corresponding to said waveshape memory means, respectively, for generating clock signals with high frequencies corresponding to pitches of depressed keyswitches of said musical instrument, said clock signal generating means being operative whenever the keyswitches are depressed; a plurality of reading means corresponding to said waveshape memory means, respectively, and coupled to said waveshape memory means for repetitively and successively reading out said memorized waveshape amplitudes by the corresponding clock signals generated by said clock signal generating means, respectively; and converting means coupled to said reading means for converting said waveshape amplitudes read out by said reading means to a musical tone, whereby a musical tone is generated by repetitively reading out the temporarily memorized musical waveshape, wherein said tone selecting means comprises coefficient determining means for determining coefficients specifying the relative amplitude of each of harmonics of the tone signal, and wave waveshape calculatng means comprises sine wave memory means for memorizing amplitudes at two or more than two sampled points of a sine wave signal of one period; and said waveshape calculating means is operative whenever said coefficient determining means is actuated, and calculates and synthesizes the waveshape by repetitively calculating the amplitude of each sampled point of a waveshape, corresponding to tone signal selected by said tone selecting means, provided in accordance with the coefficient signal from said coefficient determining means and the amplitudes of the sine wave memorized in said sine wave memory means.

2. An electronic musical instrument comprising a plurality of waveshape generating means for generating waveshapes of musical tones; a plurality of keyswitches for a number of channels greater than the number of said waveshape generating means; assigning means coupled between said waveshape generating means and said keyswitches for assigning one of said plurality of waveshape generating means to generate a waveshape selected by said keyswitches; decay memory means coupled to said assigning means for memorizing the order of decays of the plurality of musical tones; and signal generating means coupled between said decay memory means and said assigning means for generating a pseudo-decay end signal so as to clear the assigned one of said assigning means and supplying said end signal to said decay memory so as to clear the first decayed waveshape memorized therein and to memorize again a new order of decays of the musical tones, when musical tones for a number of channels greater than the number of said waveshape generating means are selected by said keyswitches.

3. An electronic musical instrument comprising a plurality of tone selecting means which comprise a plurality of tablet switches and a plurality of draw-bar switches; a tablet assigner coupled to said tablet switches for changing the ON and OFF condition of said tablet switches into a first time division multiplex signal; a draw-bar assigner coupled to said draw-bar switches for changing the ON and OFF condition of said draw-bar switches into a second time division multiplex signal; a present control circuit coupled to said tablet assigner and said draw-bar assigner for selecting at least one group from the plurality of said tablet switches and said draw-bar switches; a tablet selection detector coupled to said tablet assigner for detecting a change in said first time division multiplex signal and for generating an output signal at that change; a draw-bar selection detector coupled to said draw-bar assigner for detecting a change in said second time division multiplex signal and for generating an output signal at that change; and waveshape calculating means coupled to said tablet selection detector and said draw-bar selection detector for calculating waveshapes of a signal to be provided as a musical tone according to said output signal from said tablet selection detector or from said draw-bar selection detector.

4. An electronic musical instrument according to claim 3, wherein said instrument further comprises delay means having a number of bits corresponding to the number of said plurality of tone selecting means, and to which said time division multiplex signal is provided by scanning successively said plurality of tone selecting means, and controlling means for the change of the waveshape to be calculated by comparing said time division multiplex signal and the output signal from said delay means.

5. An electronic musical instrument according to claim 3, wherein said waveshape calculating means comprises a first memory for memorizing the condition of said tone selecting means and a predetermined calculating program; an input and output control means for controlling the signals from said tone selecting means; a central processing unit for calculating the waveshape of a musical tone according to said program by being actuated by said control circuit; a second memory for memorizing the waveshape calculated by said central processing unit; and a reading circuit for reading out the waveshape memorized in said second memory successively by said note clock signal.

6. An electronic musical instrument comprising memory means for memorizing waveshapes of musical tones represented by digitally coded amplitudes at two or more than two sampled points of said waveshapes; clock signal generating means coupled to said memory means for generating clock signals with high frequencies corresponding to pitches of depressed keyswitches of said musical instrument; assigning means coupled to said memory means and said clock signal generating means for assigning one of said memory means and one of said clock signal generating means; reading means coupled to said memory means for repetitively reading out said memorized waveshape amplitudes of assigned memory means by said clock signals; converting means coupled to outputs of said memory means for converting said read out waveshape represented by digitally coded amplitudes to an analogue musical tone; envelope generating means comprising a capacitor-resistor network for generating an envelope waveshape which is an analog representation of an attack and decay of the musical tone; and multiplying means coupled to outputs of said memory means for multiplying said analog waveshape with said converted musical tone in accordance with actuation of said keyswitches.

7. An electronic musical instrument comprising a plurality of waveshape generating means for generating waveshapes of musical tones; assigning means coupled to waveshape generating means for assigning one of said plurality of waveshape generating means to generate a waveshape selected by a keyswitch of said musical instrument; signal generating means coupled to said waveshape generating means for generating a signal indicating the phase of the waveshape of the musical tone being generated by the previously assigned waveshape generating means; and phase coincidence means coupled to said signal generating means and to said waveshape generating means for providing a predetermined phase relation, whenever two or more than two of said plurality of waveshape generating means are assigned to generate the musical tones of the same note, between two or more than two generated musical tones in accordance with the phase indicating signal from said signal generating means.

8. An electronic musical instrument according to claim 7 wherein said signal generating means comprises a note filing means for providing the phase indicating signal for each note by collecting the phase indicating signals of every note and making a logical multiplication of the more than two collected signals.

9. An electronic musical instrument according to claim 7, wherein said signal generating means comprises a dividing means for dividing a note clock signal and providing it as the phase indicating signal.

10. An electronic musical instrument according to claim 9, wherein said signal generating means further comprises filing means for providing the phase indicating signal for each note and for each octave.

11. An electronic musical instrument according to claim 10, wherein said filling means comprises means for using the phase indicating signal for the same note for octaves with frequencies higher than predetermined value.

12. An electronic musical instrument according to claim 10, wherein said filing means comprises means for using the phase indicating signal for the same note for adjacent two or more than two octaves.

13. An electronic musical instrument according to claim 7, wherein each of said plurality of waveshape generating means includes memory means for memorizing the waveshapes of musical tones, and note clock means coupled to said memory means for repetitively and successively reading out the memorized waveshapes with high frequencies corresponding to pitches of the depressed keyswitches, for continuing said reading out operation when depression of said keyswitches is released, and then stopping said reading out operation at the same position as that when the waveshapes of musical tones are written in said memory means.

* * * * *